US011377270B2

(12) United States Patent
Meyers et al.

(10) Patent No.: US 11,377,270 B2
(45) Date of Patent: Jul. 5, 2022

(54) CONTAINER LIDS WITH LATCHES

(71) Applicant: Runway Blue, LLC, Alpine, UT (US)

(72) Inventors: David O. Meyers, East Layton, UT (US); Jim Allen Colby, Highland, UT (US); Paul James Faerber, Pleasant Grove, UT (US)

(73) Assignee: Runway Blue, LLC, Alpine, UT (US)

( * ) Notice: Subject to any disclaimer, the term of this patent is extended or adjusted under 35 U.S.C. 154(b) by 221 days.

(21) Appl. No.: 16/148,892

(22) Filed: Oct. 1, 2018

(65) Prior Publication Data

US 2019/0100362 A1 Apr. 4, 2019

Related U.S. Application Data

(60) Provisional application No. 62/628,152, filed on Feb. 8, 2018, provisional application No. 62/567,080, filed on Oct. 2, 2017.

(51) Int. Cl.
*B65D 47/08* (2006.01)
*B65D 51/18* (2006.01)
(Continued)

(52) U.S. Cl.
CPC ..... *B65D 47/0885* (2013.01); *A45F 3/18* (2013.01); *B65D 43/26* (2013.01);
(Continued)

(58) Field of Classification Search
CPC ..... B65D 47/0866; B65D 47/0885; B65D 47/088; B65D 47/0876; B65D 47/0895; B65D 55/02; B65D 43/26
(Continued)

(56) References Cited

U.S. PATENT DOCUMENTS 5,203,468 A 4/1993 Hsu
6,116,476 A * 9/2000 Huang ..... B65D 47/249 222/506
(Continued)

FOREIGN PATENT DOCUMENTS

EP 3 214 011 A1 9/2017
JP 2010-241461 A 10/2010
(Continued)

OTHER PUBLICATIONS

Design U.S. Appl. No. 29/602,291, filed Apr. 28, 2017.
International Search Report and Written Opinion of PCT/US2018/053801 dated Nov. 30, 2018.

*Primary Examiner* — James N Smalley
*Assistant Examiner* — Jennifer Castriotta
(74) *Attorney, Agent, or Firm* — Sterne, Kessler, Goldstein & Fox P.L.L.C.

(57) ABSTRACT

A container lid may include a container top, a closure, and a push button. The closure may be coupled to the container top and movable between a closed closure position in which a lid opening of the container top is closed and an open closure position in which the lid opening is open. The push button may be movably coupled to the closure. The push button may include a latch configured to selectively engage the container top when the closure is in the closed closure position. The push button may be movable between a first push button position in which the latch is engageable with the container top and a second push button position in which the latch is disengaged from the container top. The closure defines a push button recess and the push button is disposed substantially within the push button recess and substantially enclosed by the closure.

28 Claims, 39 Drawing Sheets

(51) Int. Cl.

| | |
|---|---|
| ***B65D 51/24*** | (2006.01) |
| ***A45F 3/18*** | (2006.01) |
| ***B65D 55/02*** | (2006.01) |
| ***B65D 43/26*** | (2006.01) |

(52) U.S. Cl.
CPC ..... *B65D 47/0866* (2013.01); *B65D 51/18* (2013.01); *B65D 51/242* (2013.01); *B65D 55/02* (2013.01); *B65D 2251/0025* (2013.01); *B65D 2251/0081* (2013.01)

(58) Field of Classification Search
USPC ..... 215/237, 245; 220/262, 263, 264
See application file for complete search history.

(56) References Cited

U.S. PATENT DOCUMENTS

| | | | | |
|---|---|---|---|---|
| 6,702,137 | B1 | 3/2004 | Kowa | |
| 7,861,873 | B1 | 1/2011 | Bragg | |
| D667,694 | S | 9/2012 | Meyers et al. | |
| D677,121 | S | 3/2013 | Meyers et al. | |
| 8,596,493 | B2 * | 12/2013 | Vollers | B65D 47/0838 220/833 |
| 8,844,746 | B2 | 9/2014 | Meyers et al. | |
| 8,939,305 | B2 | 1/2015 | Meyer | |
| 9,392,893 | B2 | 7/2016 | Sorensen et al. | |
| 9,902,533 | B2 | 2/2018 | Meyers et al. | |
| 9,994,370 | B2 | 6/2018 | Sorensen et al. | |
| 10,214,328 | B2 | 2/2019 | Sorensen et al. | |
| 2013/0248531 | A1 | 9/2013 | Lane | |
| 2013/0319966 | A1 * | 12/2013 | Lane | A45F 3/18 215/237 |
| 2014/0224802 | A1 | 8/2014 | Gonnert et al. | |
| 2016/0000245 | A1 * | 1/2016 | Sims | B65D 47/0871 220/253 |
| 2017/0240321 | A1 | 8/2017 | Sims | |

FOREIGN PATENT DOCUMENTS

| | | | |
|---|---|---|---|
| JP | 5148544 | B2 | 2/2013 |
| WO | WO2019/070607 | A1 | 4/2019 |

* cited by examiner

CONTAINER LIDS WITH LATCHES

CROSS-REFERENCE TO RELATED APPLICATIONS

This application claims the benefit of and priority to U.S. Provisional Patent Application No. 62/567,080, filed Oct. 2, 2017 and to U.S. Provisional Patent Application No. 62/628,152, filed Feb. 8, 2018. The 62/567,080 application and the 62/628,152 application are incorporated herein by reference in their entireties.

FIELD OF THE DISCLOSURE

The present disclosure generally relates to container lids with latches.

BACKGROUND

Containers may hold a variety of different types of liquids such as water, beverages, drinks, juices, and the like. Containers also may hold various items such as energy drinks, protein drinks, shakes, foodstuffs, dressings, sauces, and liquid meal replacements.

A lid with a closure may be used to control access to an interior of the container. The lid may selectively cover an opening of the container. The closure may selectively cover a relatively smaller opening formed in the lid. The lid may be removed entirely to fill the container with ice or other contents, to wash the container, or to otherwise provide access to the interior of the container through the relatively large opening of the container. The closure may be opened to allow a user to consume contents of the container through the relatively smaller opening of the lid or to otherwise provide access to the interior of the container through the relatively smaller opening formed in the lid.

The subject matter claimed herein is not limited to embodiments that solve any disadvantages or that operate only in environments such as those described above. Rather, this background is only provided to illustrate one example technology area where some embodiments described herein may be practiced.

SUMMARY

In some embodiments of the subject disclosure, a container may hold or contain liquids, beverages, drinks, and the like. The container may allow water and other types of fluids to be transported and/or consumed. For example, the container may be used to transport or consume water, flavored waters, juices, vitamin enhanced beverages, energy drinks, thirst-quenchers and the like. In addition, the container may hold mixtures and solutions, which may include vitamins, supplements, protein powders, meal replacements, etc. Further, the container may hold various powders, solids and/or other types of materials including foodstuffs such as fruits, vegetables, soups, dressings, and the like. In some embodiments, the container may be insulated to help keep the contents at a desired temperature. The container may be a bottle, cup, vessel, or the like, and the container may have a variety of different shapes, sizes, configurations, and arrangements depending, for example, upon the intended use of the container.

Some aspects of the subject disclosure relate to container lids for containers. In some embodiments, the container lid may be selectively attached and/or detached from the container. The container lid may cover an opening of the container and may include a closure that covers one or more openings of the container lid. The container lid may seal the one or more openings with an air and/or fluid-tight seal, which may prevent the contents from leaking or spilling. The one or more openings may allow contents to be quickly and easily added to or removed from the container.

The subject technology is illustrated, for example, according to various aspects described below. Various examples of aspects of the subject technology are described as numbered clauses (1, 2, 3, etc.) for convenience. These are provided as examples and do not limit the subject technology. It is noted that any of the dependent clauses may be combined in any combination, and placed into a respective independent clause, e.g., Clause 1, 21, 32, 41, 60, 67. The other clauses can be presented in a similar manner. The following is a non-limiting summary of some examples presented herein.

Clause 1. A container lid, comprising:

a container top sized and shaped to be selectively connected to a container body, the container top having a lid opening;

a closure coupled to the container top and movable between a closed closure position in which the lid opening is closed and an open closure position in which the lid opening is open; and a push button movably coupled to the closure, the push button including a latch configured to selectively engage the container top when the closure is in the closed closure position, the push button movable between a first push button position in which the latch is engageable with the container top and a second push button position in which the latch is disengaged from the container top;

wherein the closure defines a push button recess, and the push button is disposed substantially within the push button recess and substantially enclosed by the closure.

Clause 2. The container lid of clause 1, wherein the closure includes an upper wall and a lower wall that at least partially define the push button recess and wherein the push button is disposed substantially between the upper wall and the lower wall of the closure.

Clause 3. The container lid of clause 1, further comprising a bias member configured to urge the push button toward the first push button position and to resiliently deform in response to movement of the push button to the second push button position.

Clause 4. The container lid of clause 3, wherein the push button comprises a push region and wherein the push region, the bias member, and the latch are arranged with the latch positioned between the push region and the bias member in a direction the push button moves from the first push button position to the second push button position.

Clause 5. The container lid of clause 3, wherein a projection of the bias member in a direction the push button moves from the second push button position to the first push button position intersects a push region of the push button.

Clause 6. The container lid of clause 5, wherein the projection of the bias member in the direction the push button moves from the second push button position to the first push button position further intersects the latch.

Clause 7. The container lid of clause 3, wherein:

the bias member comprises a bias spring having a first end positioned against a rearward directed face of the push button and an opposite second end positioned against a forward directed face of the closure;

the bias spring extends between the rearward directed face of the push button and the forward directed face of the closure; and the bias spring is configured to compress between the rearward directed face of the push button and the forward directed face of the closure in response to movement of the push button from the first push button position to the second push button position.

Clause 8. The container lid of clause 1, further comprising an integrally formed resilient member comprising a lid opening seal and the bias member, the bias member configured to urge the push button toward the first push button position and to resiliently deform in response to movement of the push button to the second push button position, the lid opening seal configured to selectively seal the lid opening.

Clause 9. The container lid of clause 8, wherein the bias member includes a tongue end and a tongue neck that couples the tongue end to the lid opening seal, the tongue neck comprising one or more corrugations to at least partially mechanically isolate the tongue end from the lid opening seal.

Clause 10. The container lid of clause 8, wherein the bias member includes a tongue end positioned between a rearward facing surface of the push button and a forward facing surface of the push button recess, the tongue end configured to compress between the two surfaces in response to movement of the push button from the first push button position to the second push button position and to resiliently expand in response to movement of the push button from the second push button position to the first push button position.

Clause 11. The container lid of clause 1, wherein:

the push button is slidably coupled to the closure and comprises a body and a retention tab that extends outward from the body; and the closure comprises a tab stop configured to engage the retention tab of the push button to prevent forward movement of the retention tab past the tab stop.

Clause 12. The container lid of clause 11, wherein the at least one retention tab comprises two retention tabs that extend outward from opposite sides of the body of the push button.

Clause 13. The container lid of clause 1, wherein a part of the push button wraps around and extends rearward over a front portion of the closure.

Clause 14. The container lid of clause 1, wherein:

the push button includes a body and at least one of a channel or a rail that extends front to back along at least a portion of the body;

the closure includes at least one of a rail or a channel within the push button recess that is complementary to the channel or the rail of the push button; and the rail or the channel of the closure engages the channel or the rail of the push button to inhibit vertical movement of the push button relative to the closure.

Clause 15. The container lid of clause 1, wherein the container top comprises a latch stop, the latch configured to selectively engage the latch stop to selectively engage the container top.

Clause 16. The container lid of clause 1, further comprising a lock movable relative to the closure and the push button between a locked position and an unlocked position, the lock configured to selectively inhibit the push button from moving from the first push button position to the second push button position.

Clause 17. The container lid of clause 16, wherein:

the lock is movable between a locked position and an unlocked position;

the lock in the locked position is configured to inhibit the push button from moving from the first push button position to the second push button position; and the lock in the unlocked position is configured to permit movement of the push button between the first push button position and the second push button position.

Clause 18. The container lid of clause 16, wherein:

the push button travels an engagement distance between the first push button position and the second push button position;

the closure defines a lock recess in a bottom surface of a push button recess upper wall of the closure, the lock recess having a rearward end that forms a fulcrum for the lock;

the push button defines a lock cavity in an upper surface of the push button;

the lock cavity includes a first stop in a first portion of the lock cavity and a second stop in a second portion of the lock cavity, the second stop being forward of the first stop;

the lock comprises an abutment, wherein:

when the push button is in the first push button position and the lock is in the locked position, the abutment is positioned facing the first stop of the lock cavity of the push button and spaced apart from the first stop by a distance less than the engagement distance; and when the push button is in the first push button position and the lock is in the unlocked position, the abutment is positioned facing the second stop of the lock cavity and spaced apart from the second stop by a distance equal to or greater than the engagement distance.

Clause 19. The container lid of clause 18, wherein:

a bottom surface of the lock cavity of the push button includes a first receptacle rearward of the first hard stop and a second receptacle rearward of the second hard stop; and the lock further comprises a protrusion positioned to be received in the first receptacle when the lock is in the locked position and to be received in the second receptacle when the lock is in the unlocked position.

Clause 20. The container lid of clause 18, wherein:

the closure includes a lock switch channel; and the lock further comprises a lock switch that extends through the lock switch channel to provide access to the lock.

Clause 21. A container lid, comprising:

a container top having a lid opening;

a closure coupled to the container top and movable between an open closure position in which the lid opening is open and a closed closure position in which the lid opening is closed; and a push button movably coupled to the closure and configured to selectively engage the container top to selectively retain the closure in the closed closure position, the push button comprising a retention tab, the retention tab engaging the closure to inhibit forward movement of the retention tab beyond the engagement of the retention tab with the closure.

Clause 22. The container lid of clause 21, wherein the push button comprises a resilient portion that biases the retention tab toward the closure and is resiliently deformable to selectively disengage the retention tab from the closure to allow the push button to be decoupled from the closure.

Clause 23. The container lid of clause 21, wherein the retention tab engages a rearwardly facing surface of the closure to inhibit forward movement of the retention tab past the rearwardly facing surface.

Clause 24. The container lid of clause 23, wherein:

the closure comprises a push button recess side wall that at least partially defines a push button recess, the side wall comprising the rearwardly facing surface; and the push button is positioned at least partially within the push button recess.

Clause 25. The container lid of clause 24, wherein the side wall is at least partially disposed at a rear of the push button recess.

Clause 26. The container lid of clause 24, wherein the push button comprises an arm carrying the retention tab.

Clause 27. The container lid of clause 26, wherein:

a hole is formed in the push button recess side wall;

the arm of the push button extends into the hole formed in the push button recess side wall; and the retention tab engages the push button recess side wall to inhibit forward movement of the retention tab past rearwardly facing surface.

Clause 28. The container lid of clause 27, wherein in response to application of a removal force to the retention tab, the arm resiliently deforms to permit alignment of the retention tab with the hole formed in the push button recess side wall to permit removal of the push button from the push button recess of the closure.

Clause 29. The container lid of clause 21, wherein the container top comprises a spout that defines the lid opening and the push button includes a latch configured to selectively engage a latch stop formed on an interior of the spout when the lid opening is closed by the closure.

Clause 30. The container lid of clause 21, further comprising a lid opening seal coupled to the closure, the lid opening seal including a first circumferential flange and a second circumferential flange positioned above the first circumferential flange, wherein:

the container top comprises a spout that defines the lid opening, the lid opening having a cross-sectional profile through the spout with a waist having a first diameter, the lid opening having a diameter that increases from the first diameter moving from the waist upward and downward along the lid opening; and when the closure is positioned in the closed closure position, the lid opening seal is positioned within the lid opening of the spout, the first circumferential flange of the lid opening seal is positioned below the waist of the lid opening, and the second circumferential flange is positioned above the waist of the lid opening.

Clause 31. The container lid of clause 21, further comprising a lock configured to selectively inhibit the push button from moving from the first push button position to the second push button position.

Clause 32. A container lid, comprising:

a container top having a lid opening;

a closure coupled to the container top and movable between an open closure position in which the lid opening is open and a closed closure position in which the lid opening is closed;

a push button movably coupled to the closure and configured to selectively engage the container top to selectively retain the closure in the closed closure position; and a resilient member comprising both a lid opening seal and a bias member, the lid opening seal configured to form a seal between the lid opening and the closure, the bias member urging the push button toward a first push button position in which the push button engages the container top, and the bias member resiliently deforming in response to movement of the push button to a second push button position in which the push button is disengaged from the container top.

Clause 33. The container lid of clause 32, wherein the resilient member comprises a tongue joining the lid opening seal and the bias member.

Clause 34. The container lid of clause 33, wherein the bias member comprises the tongue, the tongue urging the push button toward a first push button position in which the push button engages the container top, and the tongue resiliently deforming in response to movement of the push button to a second push button position in which the push button is disengaged from the container top.

Clause 35. The container lid of clause 34, wherein:

the tongue includes a tongue end and a tongue neck that couples the tongue end to the lid opening seal; and at least one of:

movement of the push button from the first push button position to the second push button position is configured to compress the tongue end between the push button and the closure; or movement of the push button from the first push button position to the second push button position is configured to stretch the tongue neck.

Clause 36. The container lid of clause 32, wherein the closure defines a push button recess, the push button disposed substantially within the push button recess and substantially enclosed by the closure.

Clause 37. The container lid of clause 36, wherein:

the push button comprises a retention tab configured to selectively engage the closure to selectively couple the push button to the closure; and the retention tab is disengagable from the closure externally relative to the closure.

Clause 38. The container lid of clause 32, wherein:

the container top comprises a spout, and the lid opening passes through the spout;

the push button comprises a latch configured to selectively engage the spout;

the spout comprises a latch stop configured to overhang the latch when the closure is in the closed closure position and the push button is in the first push button position; and the push button is configured to selectively engage the container top at the spout by the latch selectively engaging the latch stop.

Clause 39. The container lid of clause 32, further comprising a lid opening seal coupled to the closure, the lid opening seal including a first circumferential flange and a second circumferential flange positioned above the first circumferential flange, wherein:

the container top comprises a spout that defines the lid opening, the lid opening having a variable diameter along a height of the lid opening, the lid opening having a first diameter at an intermediate height, the variable diameter increasing moving upward from the intermediate height for at least an upper portion of the lid opening and the variable diameter increasing moving downward from the intermediate height for least a lower portion of the lid opening; and when the closure is positioned in the closed closure position, the lid opening seal is positioned within the lid opening of the spout, the first circumferential flange of the lid opening seal is positioned below the intermediate height, and the second circumferential flange is positioned above the intermediate height.

Clause 40. The container lid of clause 32, further comprising a lock movable relative to the closure and the push button.

Clause 41. A container lid comprising:

a container top having a lid opening;

a closure coupled to the container top and movable between an open closure position in which the lid opening is open and a closed closure position in which the lid opening is closed;

a push button movably coupled to the closure and configured to selectively engage the container top to selectively retain the closure in the closed closure position; and a bias member that includes both a lid opening seal configured to form a seal between the lid opening and the closure and a tongue that extends from the lid opening seal and urges the push button toward a first push button position in which the push button engages the container top, the bias member resiliently deforming in response to movement of the push button to a second push button position in which the push button is disengaged from the container top.

Clause 42. The container lid of clause 41, wherein the closure defines a push button recess, the push button disposed substantially within the push button recess and substantially enclosed by the closure.

Clause 43. The container lid of clause 42, wherein:

the push button comprises a body and at least one retention tab that extends outward from the body;

the closure comprises at least one tab stop within the push button recess; and the at least one tab stop of the closure is configured to engage the at least one retention tab of the push button to prevent forward movement of the at least one retention tab past the at least one tab stop.

Clause 44. The container lid of clause 43, wherein the at least one retention tab comprises two retention tabs that extend outward from opposite sides of the body of the push button.

Clause 45. The container lid of clause 41, wherein:

the push button comprises a body and an arm extending rearward from the body, the arm including a retention tab at an end of the arm;

the closure comprises a push button recess upper wall and a push button recess rear wall that together at least partially define the push button recess;

a hole is formed in the push button recess rear wall; and the arm of the push button extends through the hole formed in the push button recess rear wall and the retention tab engages a rear surface of the push button recess rear wall to inhibit forward movement of the retention tab past the rear surface of the push button recess rear wall.

Clause 46. The container lid of clause 45, wherein the retention tab is selectively disengageable from the rear surface of the push button recess rear wall.

Clause 47. The container lid of clause 41, wherein:

the container top comprises a spout, and the lid opening passes through the spout;

the push button comprises a latch configured to selectively engage the spout;

the spout comprises a latch stop configured to overhang the latch when the closure is in the closed closure position and the push button is in the first push button position; and the push button is configured to selectively engage the container top at the spout by the latch selectively engaging the latch stop.

Clause 48. The container lid of clause 47, wherein the latch stop comprises a lip, a shoulder, or an upper surface of a latch recess formed in the spout.

Clause 49. The container lid of clause 47, wherein the latch stop is formed on an exterior of the spout.

Clause 50. The container lid of clause 47, wherein the latch stop is formed on an interior of the spout.

Clause 51. The container lid of clause 41, wherein:

the tongue extends rearward from a front of the lid opening seal;

the tongue comprises a tongue end with forward facing surfaces and a tongue neck that couples the tongue end to the front of the lid opening seal; and the push button comprises a channel that includes a tongue end cavity configured to receive the tongue end, a tongue neck cavity configured to receive the tongue neck, and rearward facing surfaces 50C configured to be in direct contact with the forward facing surfaces of the tongue.

Clause 52. The container lid of clause 41, wherein the lid opening seal comprises at least one of:

an o-ring gasket;

a resilient oversized annular plug protrusion having an uncompressed diameter that is greater than a diameter of the lid opening; or a resilient inverse dome seal.

Clause 53. The container lid of clause 41, further comprising a lock movable relative to the closure and the push button.

Clause 54. The container lid of clause 53, wherein:

the lock is movable between a locked position and an unlocked position;

the lock in the locked position is configured to inhibit the push button from moving from the first push button position to the second push button position; and the lock in the unlocked position is configured to permit movement of the push button between the first push button position and the second push button position.

Clause 55. The container lid of clause 53, wherein:

the push button travels an engagement distance between the first push button position and the second push button position;

the closure defines a lock recess in a bottom surface of a push button recess upper wall of the closure, the lock recess having a rearward end that forms a fulcrum for the lock;

the push button defines a lock cavity in an upper surface of the push button;

the cavity includes a first stop in a first portion of the lock cavity and a second stop in a second portion of the lock cavity, the second stop being forward of the first stop;

the lock comprises an abutment, wherein:

when the push button is in the first push button position and the lock is in the locked position, the abutment is positioned facing the first stop of the lock cavity of the push button and spaced apart from the first stop by a distance less than the engagement distance; and when the push button is in the first push button position and the lock is in the unlocked position, the abutment is positioned facing the second stop of the lock cavity and spaced apart from the second stop by a distance equal to or greater than the engagement distance.

Clause 56. The container lid of clause 55, wherein:

a bottom surface of the lock cavity of the push button includes a first receptacle rearward of the first hard stop and a second receptacle rearward of the second hard stop; and the lock further comprises a protrusion positioned to be received in the first receptacle when the lock is in the locked position and to be received in the second receptacle when the lock is in the unlocked position.

Clause 57. The container lid of clause 55, wherein: the closure includes a lock switch channel; and the lock further comprises a lock switch that extends through the lock switch channel to provide access to the lock.

Clause 58. The container lid of clause 55, wherein a base is supported above the lock cavity on the upper surface of the push button when the lock is in both the locked position and the unlocked position, the base at least partially received in the lock recess in the bottom surface of the push button recess upper wall of the closure with a pivot of the base at least partially received in the fulcrum of the lock recess.

Clause 59. The container lid of clause 55, further comprising a support that extends downward from the base and wherein at least a portion of the support forms the abutment.

Clause 60. A container lid, comprising:

a container top sized and shaped to be selectively connected to a container body, the container top having a lid opening;

a closure coupled to the container op and movable between a closed closure position in which the lid opening is closed and an open closure position in which the lid opening is open; and a push button movably coupled to the closure, the push button including a latch configured to selectively engage the container top when the closure is in the closed closure position, the push button movable between a first push button position in which the latch is engageable with the container top and a second push button position in which the latch is disengaged from the container top, wherein the closure defines a push button recess, the push button disposed substantially within the push button recess and substantially enclosed by the closure.

Clause 61. The container lid of clause 60, further comprising a tongue integrally formed with the lid opening seal as a bias member configured to urge the push button toward the first push button position and to resiliently deform in response to movement of the push button to the second push button position.

Clause 62. The container lid of clause 60, further comprising a bias member configured to urge the push button toward the first push button position and to resiliently deform in response to movement of the push button to the second push button position.

Clause 63. The container lid of clause 62, wherein:

the bias member comprises a bias spring having a first end positioned against a rearward directed face of the push button and an opposite second end positioned against a forward directed face of the closure;

the bias spring extends between the rearward directed face of the push button and the forward directed face of the closure; and the bias spring is configured to compress between the rearward directed face of the push button and the forward directed face of the closure in response to movement of the push button from the first push button position to the second push button position.

Clause 64. The container lid of clause 60, wherein:

the push button is slidably coupled to the closure and comprises a body and at least one retention tab that extends outward from the body;

the closure comprises at least one tab stop within the push button recess; and the at least one tab stop of the closure is configured to engage the at least one retention tab of the push button to prevent forward movement of the at least one retention tab past the at least one tab stop.

Clause 65. The container lid of clause 64, wherein the at least one retention tab comprises two retention tabs that extend outward from opposite sides of the body of the push button.

Clause 66. The container lid of clause 60, wherein the container top comprises a latch stop, the latch configured to selectively engage the latch stop to selectively engage the container top.

Clause 67, A container lid, comprising:

a container top;

a spout that extends from the container top with a lid opening extending through the container top;

a closure pivotally coupled to the container top and configured to selectively close the lid opening;

a push button slidably coupled to the closure, the push button including a latch configured to selectively engage a latch stop formed on an exterior of the spout when the lid opening is closed by the closure; and a plug that extends from the closure into the lid opening when the lid opening is closed by the closure.

Clause 68. The container lid of clause 67, further comprising:

two pivot posts that extend upward from the container top;

two beveled axles, each of which has a beveled surface and that extends from a corresponding beveled surface of a different one of the two pivot posts toward the other of the two pivot posts, wherein the closure is coupled to the two be beveled axles and rotatable together with the two beveled axles relative to the two pivot posts;

a bias member coupled between the two beveled axles, a distance between the two beveled axles determined by a rotational position of the two beveled axles relative to the two pivot posts, wherein the bias member is configured to bias the two beveled axles to a rotational position associated with an open closure position of the closure.

Clause 69. The container lid of clause 67, wherein the closure defines a push button recess within which the push button is at least partially disposed, a top and rear of the push button being uncovered and exposed.

These and other aspects, features, and advantages of the subject technology will become more fully apparent from the following brief description of the drawings, the drawings, the detailed description of preferred embodiments, and appended claims.

BRIEF DESCRIPTION OF THE DRAWINGS

The appended drawings are incorporated in and constitute a part of this description, and contain figures of certain embodiments to further disclose the above and other aspects, principles, advantages, and features of the subject technology. It will be appreciated that these drawings depict only certain embodiments and are not intended to limit the scope of the invention. Additionally, it will be appreciated that while the drawings may illustrate certain sizes, scales, relationships, and configurations of the subject technology, the drawings are not intended to limit the scope of the claimed invention.

DETAILED DESCRIPTION

Figure 1:
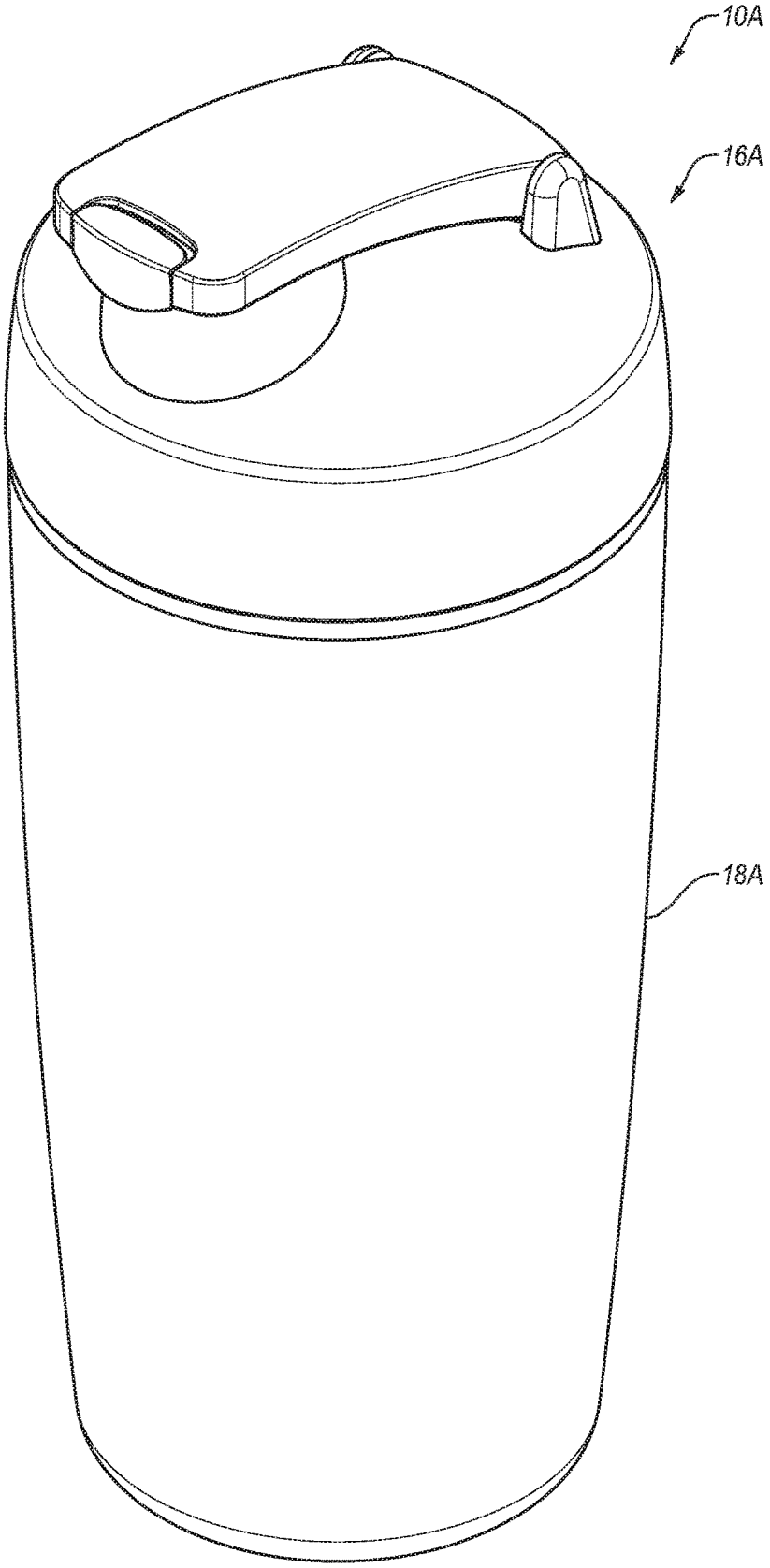
FIG. 1 is an upper perspective view of an example container.

The detailed description set forth below includes a description of various configurations of the subject technology and is not intended to represent the only configurations in which the subject technology may be practiced. The detailed description includes specific details for the purpose of providing a thorough understanding of the subject technology. However, the subject technology may be practiced without these specific details. In some instances, well-known structures and components are not shown, or are shown schematically, to avoid obscuring the concepts of the subject technology.

Although various aspects, principles, advantages, and features of the subject technology are disclosed herein with reference to liquid-dispensing containers or container lids or, in some instances, shaker cups, the present disclosure is not limited to liquid-dispensing containers or container lids or to shaker cups. It will be understood that, in light of the present disclosure, the liquid-dispensing containers disclosed herein may have a variety of suitable shapes, sizes, configurations, and arrangements. It will also be understood that containers and container lids according to the subject technology may include any suitable number of parts and components, such as vessels, selectors, valve bodies, nozzles, lid bodies, straws, and the like; and the containers and container lids may include any appropriate number and combination of features, parts, aspects, and the like. The disclosed components may be combined or subdivided in some embodiments of the subject technology. In addition, while the accompanying figures illustrate containers and container lids having particular styles and configurations, it will be appreciated that the claimed subject matter may not be limited to the illustrated styles and configurations. Further, the containers and container lids may be successfully used in connection with other types of devices.

Various exemplifying embodiments are shown in the accompanying figures. To assist in the description of the various exemplifying embodiments, words such as top, bottom, front, rear, sides, right, left, and/or variations thereof may be used to describe the accompanying figures which may be, but are not necessarily, drawn to scale. It will further be appreciated that the containers may be disposed in a variety of desired positions or orientations, and used in numerous locations, environments, and arrangements.

Some container lids include a lid opening and a closure to close the lid opening. Some such container lids include a seal member that is intended to seal the lid opening when the closure is closed to prevent inadvertent leakage of the contents of a corresponding container through the lid opening. In some container lids, the closure may be retained in a closed position by friction, interference, and/or applied pressure between the seal member and the lid opening. However, when the sealing engagement between the seal member and the lid opening provides the sole mechanism for retaining the closure in the closed position, it may be difficult to obtain both a secure seal between the seal member and the lid opening and ease of use in opening and closing the container lid. For example, a tighter sealing engagement between the seal member and the lid opening may provide a more secure seal that is also more likely to retain the closure in the closed position and thus relatively less likely to inadvertently leak than a looser seal, but may also be relatively more difficult to open and close the closure. In some example embodiments disclosed herein, a latch may retain the closure in the closed position alone or in combination with engagement (e.g., friction, interference, and/or applied pressure) between the seal member and the lid opening. In some example embodiments, the closure may be retained in the closed position primarily by a latch.

FIG. 1 is an upper perspective view of an example container 10A, arranged in accordance with at least one embodiment described herein. As shown in FIG. 1, the container 10A may include a container body 18A and a container lid 16A. The container body 18A may be sized and shaped to hold, retain and/or store one or more liquids and/or solids, generally referred to herein as contents.

The container lid 16A may cooperate with the container body 18A to secure contents such as liquids within the container body 18A. The container lid 16A may be removed entirely from the container body 18A to expose a top opening (not visible in FIG. 1) of the container body 18A through which an interior of the container body 18A may be accessed, e.g., to add contents to the container 10A, to remove contents from the container 10A, to wash an interior of the container body 18A, or to otherwise access the interior of the container body 18A.

The container lid 16A may define a lid opening (see, e.g., FIG. 3) that may be relatively small, e.g., smaller than the top opening of the container body 18A, and through which the interior of the container body 18A may be accessed. For instance, a user may consume the contents of the container 10A through the lid opening of the container lid 16A, dispense a powdered drink mix into the container 10A through the lid opening, or otherwise access the interior of the container body 18A through the lid opening of the container lid 16A.

The container lid 16A may be selectively connected to the container body 18A. For example, the container lid 16A may be selectively connected to the container body 18A by threading, snapping, twisting, sliding, or screwing the container lid 16A to the container. For example, an upper portion of the container body 18A may include one or more exterior or interior threads and a lower portion of the container lid 16A may include one or more corresponding threads. The threads may mate to allow the container lid 16A to be selectively connected to the container body 18A. The threaded connection of the container lid 16A to the container body 18A may create a secure, airtight, watertight and/or leak-proof seal. The threaded connection may require multiple turns or a single turn or less to securely connect the container body 18A and the container lid 16A. More generally, the container body 18A and the container lid 16A may be connected by any suitable number of turns. The container body 18A and the container lid 16A may also be connected using other suitable types of connections and structures depending, for example, upon the intended use of the container.

Figure 2:
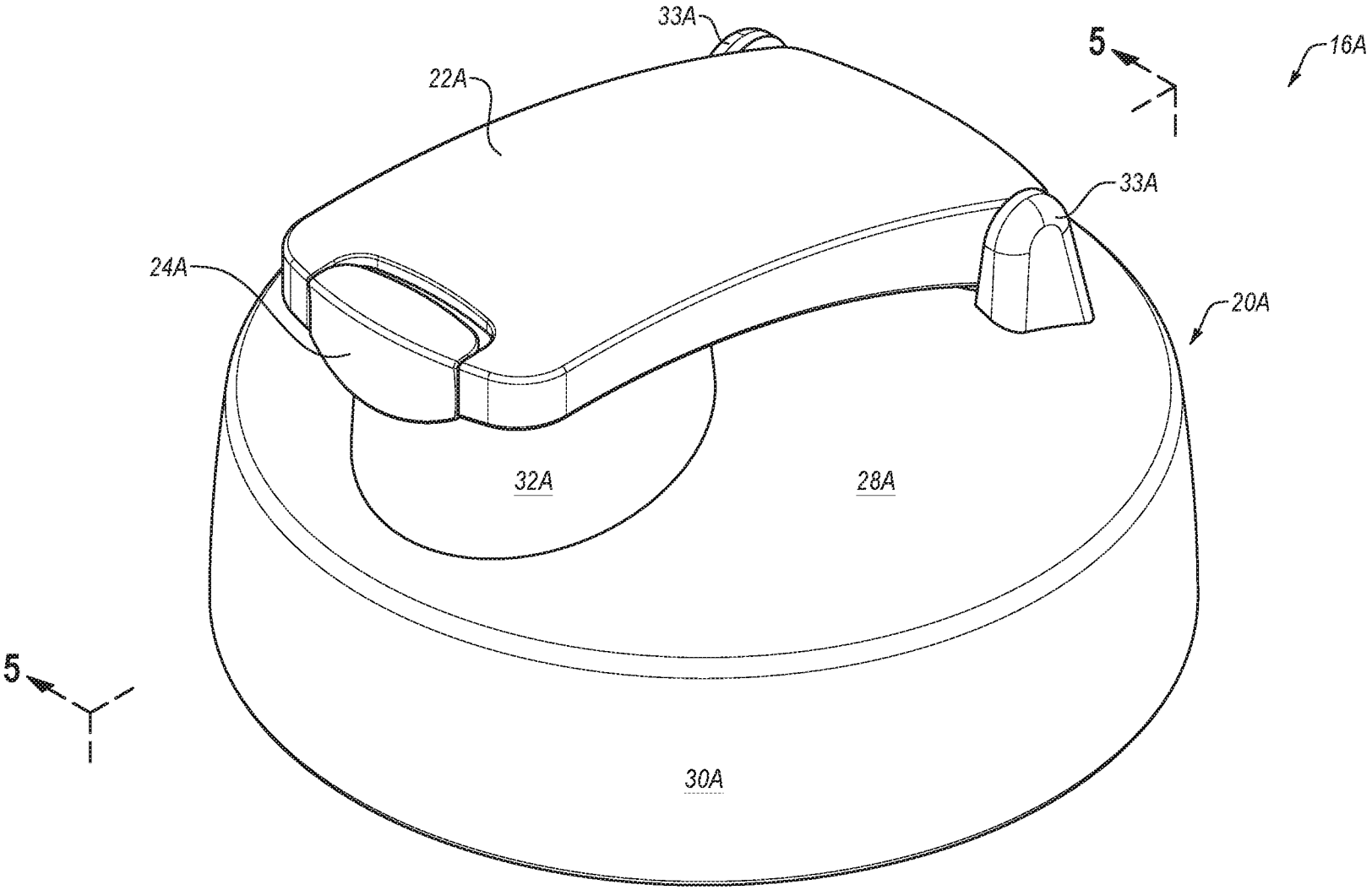
FIG. 2 is an upper perspective view of a container lid of FIG. 1.
Figure 3:
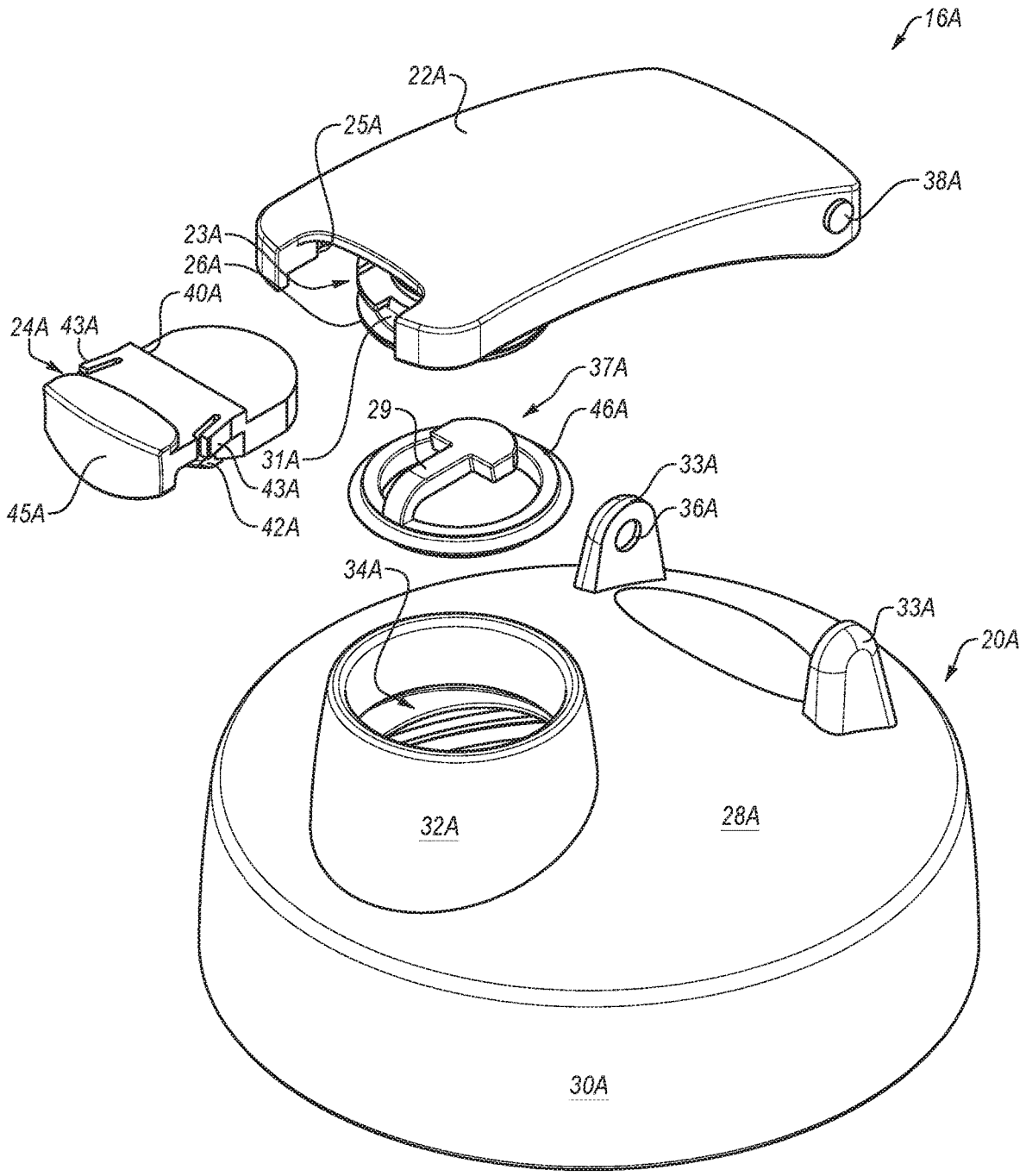
FIG. 3 is an exploded upper perspective view of the container lid of FIGS. 1 and 2.

FIG. 2 is an upper perspective view of the container lid 16A, arranged in accordance with at least one embodiment described herein. FIG. 3 is an exploded upper perspective view of the container lid 16A, arranged in accordance with at least one embodiment described herein. As illustrated in FIGS. 2 and 3, the container lid 16A may include a container top 20A, a closure 22A, a push button 24A, and a plug 26A (see, e.g., FIG. 5).

The container top 20A may include an end wall 28A, a skirt 30A, a spout 32A and/or one or more pivot posts 33A. The skirt 30A may generally extend downward from the end wall 28A and may be configured to matingly engage a top of the container body 18A. In this and other embodiments, the skirt 30A may include on an interior or exterior surface thereof one or more container engagement members to selectively secure the container top 20A to the container body 18A. For instance, the skirt 30A may include interior threads (as in FIG. 5), exterior threads, a bayonet-style mount, or other container engagement members configured to matingly engage with one or more corresponding threads, bayonet-style mounts, or other lid engagement members formed on an upper exterior or interior surface of the container body 18A to secure the container top 20A to the container body 18A.

The spout 32A may extend upward from the end wall 28A. One or more lid openings 34A may pass through the spout 32A. In some embodiments, the spout 32A may define one or more lid openings. A single generally circular lid opening 34A is depicted in FIG. 3 as an example; in other embodiments, the spout 32A may define two or more openings of any suitable size and/or shape. When the container lid 16A is coupled to the container body 18A and the closure 22A is moved to an open closure position, a user may consume or otherwise remove contents from the container 10A through the lid opening 34A. Alternatively or additionally, the user may add contents to the container 10A through the lid opening 34A.

The closure 22A may be pivotally coupled to the container top 20A and may be configured to selectively cover the lid opening 34A. For instance, the closure 22A may be rotatable between the open closure position in which the lid opening 34A is open and a closed closure position (as illustrated in FIG. 2) in which the lid opening 34A is closed.

The closure 22A may be pivotally coupled to the container top 20A through the pivot posts 33A, which may define a rotational axis of the closure 22A. In the illustrated embodiment, each of the pivot posts 33A defines an opening 36A (only one is visible in FIG. 3) configured to receive a protrusion 38A (only one is visible in FIG. 3) that is retained in the corresponding opening 36A during operation and permits the closure 22A to rotate relative to the container top 20A.

The push button 24A may be slidably coupled to the closure 22A and may be configured to selectively engage the spout 32A or other portion of the container top 20A to selectively retain the closure 22A in the closed closure position. A resilient member 37A may be configured to urge the push button 24A toward a first push button position in which the push button 24A can engage the container top 20A, e.g., at the spout 32A, and to resiliently deform in response to movement of the push button 24A to a second push button position in which the push button 24A is disengaged from the container top 20A. The resilient member 37A may thereby forward bias the push button 24A, e.g., the push button 24A may be urged forward by the resilient member 37A. In other embodiments, the push button 24A may be rearward biased by the resilient member 37A.

Figure 5:
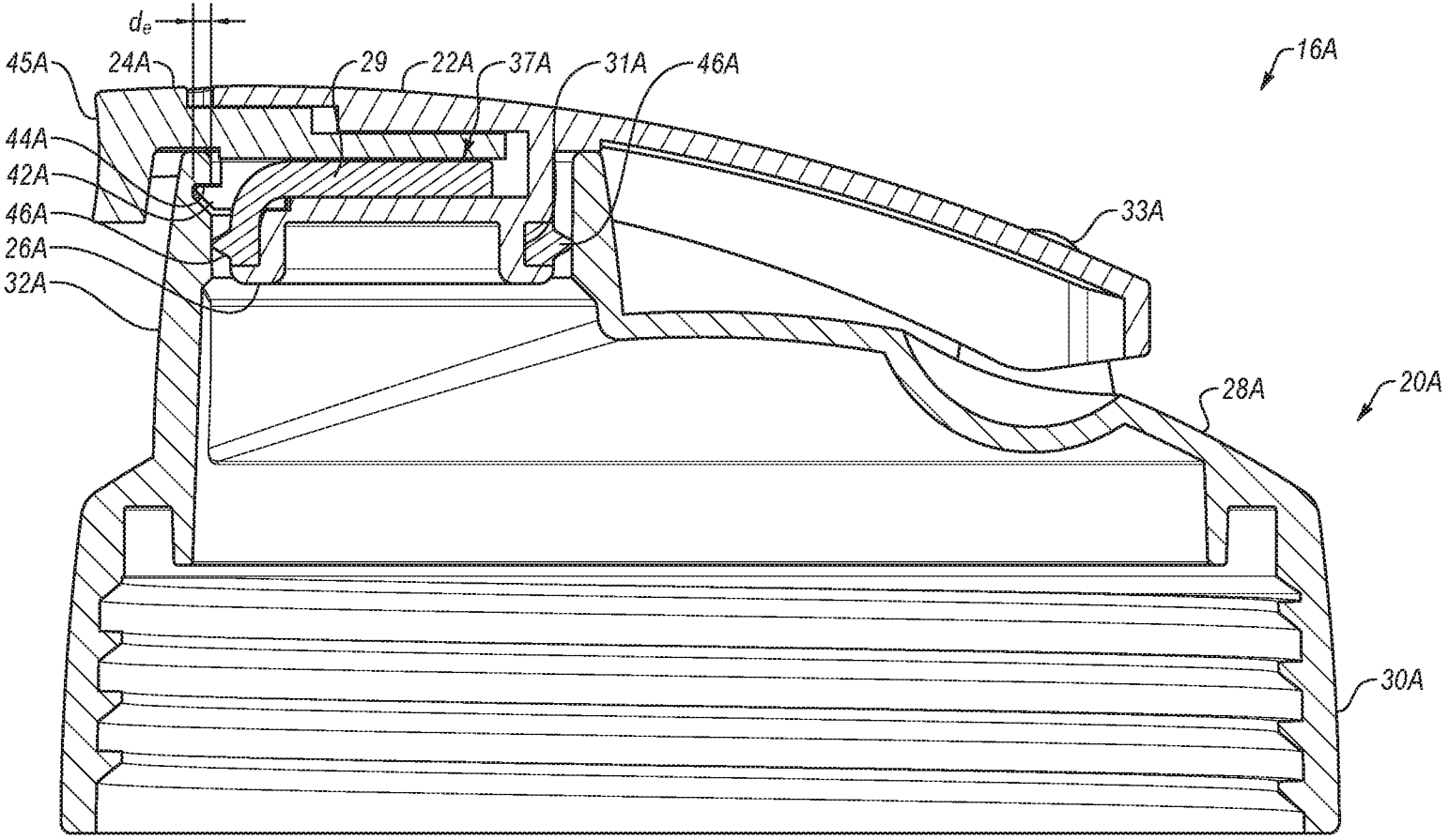
FIG. 5 is a cross-sectional view of the container lid of FIGS. 1 and 2.

As illustrated in FIG. 3, the closure 22A may have a push button recess 23A. With combined reference to FIGS. 2 and 3, the push button 24A may be disposed substantially within the push button recess 23A and may be substantially enclosed by the closure 22A. For instance, a majority of the push button 24A may be covered by and/or enclosed within the closure 22A, for example, as illustrated in FIGS. 2 and 5.

Figure 4A:
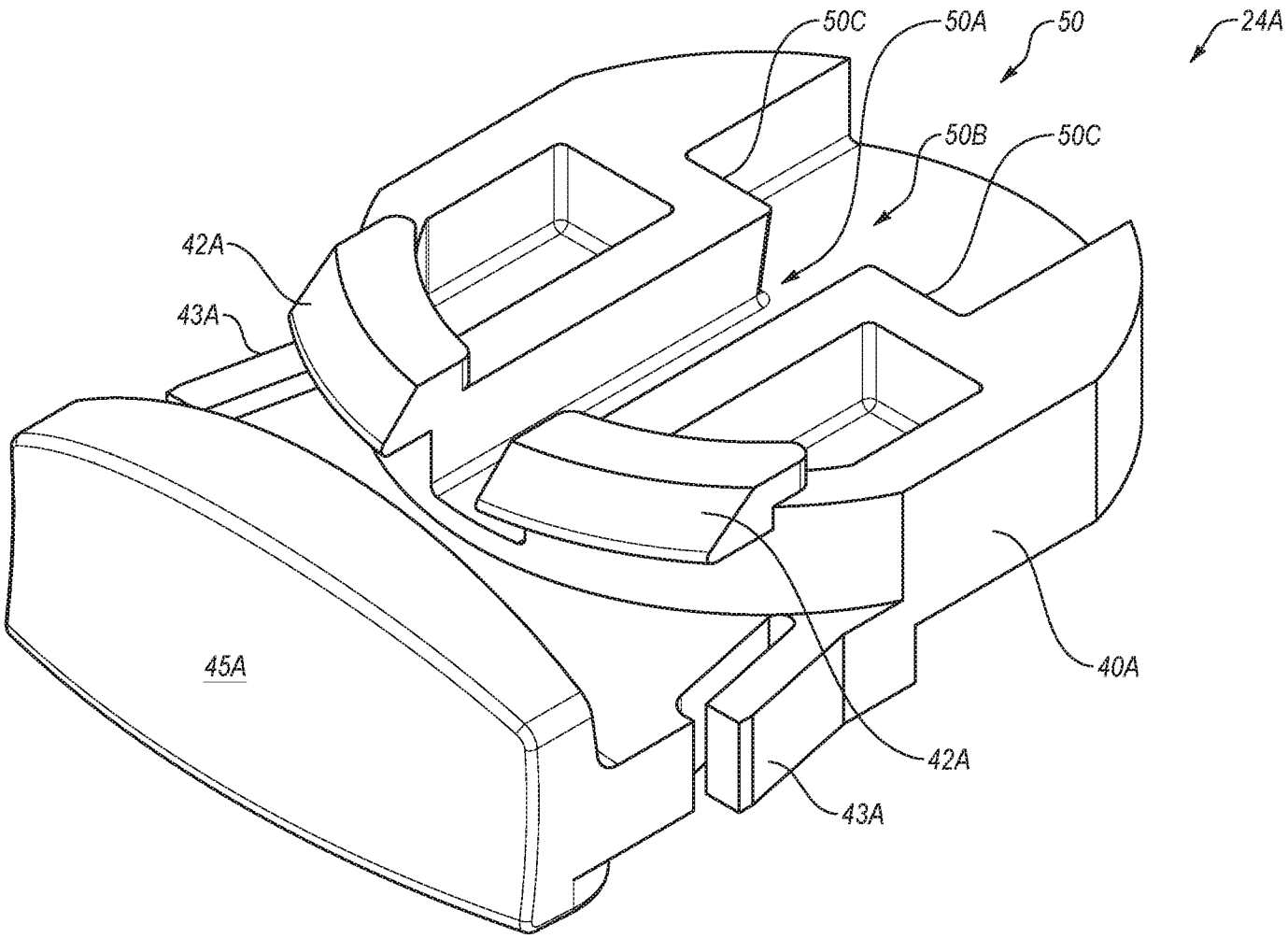
FIG. 4A is a lower perspective view of a push button of FIGS. 2 and 3.
Figure 4B:
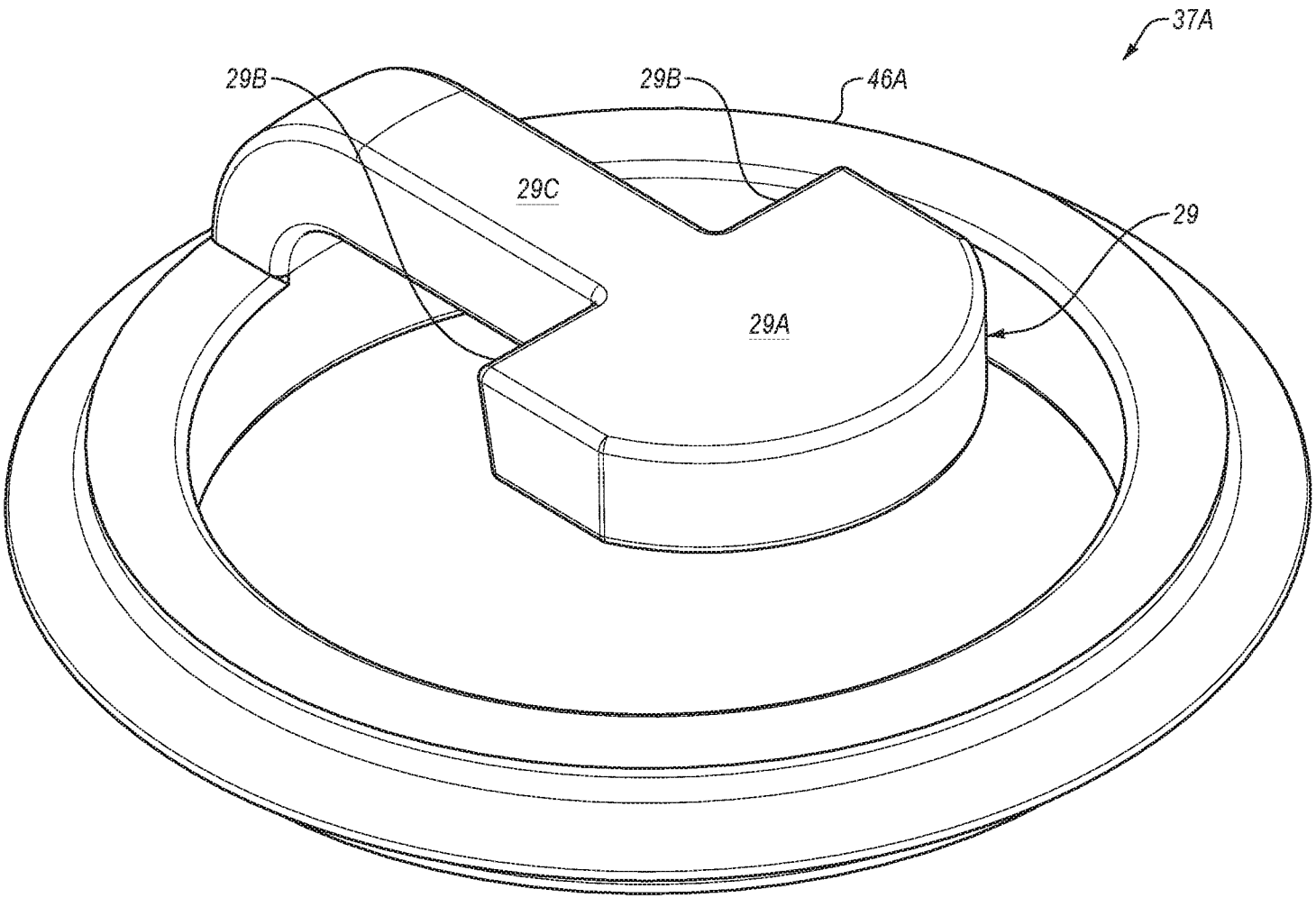
FIG. 4B is an upper perspective view of a bias member of FIGS. 2 and 3.

FIG. 4A is lower perspective view of the push button 24A of FIGS. 2 and 3, arranged in accordance with at least one embodiment described herein. FIG. 4B is an upper perspective view of the resilient member 37A of FIGS. 2 and 3, arranged in accordance with at least one embodiment described herein. FIG. 5 is a cross-sectional view of the container lid 16A of FIGS. 1 and 2 along cutting plane 5-5 in FIG. 2, arranged in accordance with at least one embodiment described herein. With combined reference to FIGS. 1-5, the push button 24A may include a body 40A, one or more latches 42A, and/or one or more retention tabs 43A. The push button 24A may include two latches 42A and two retention tabs 43A as illustrated, with the retention tabs 43A extending outward from opposite sides of the body 40A. Alternatively, the push button 24A may include a single latch 42A, three or more latches 42A, a single retention tab 43A, or three or more retention tabs 43A.

The retention tabs 43A may be configured to retain the push button 24A within the push button recess 23A of the closure 22A. Each of the retention tabs 43A may generally extend outward from the body 40A. In addition, each of the retention tabs 43A may extend forward from the body 40A or have a forward-facing surface in a forward-biased implementation of the push button 24A as illustrated, or may extend rearward from the body 40A or have a rearward-facing surface in a rearward-biased implementation of the push button 24A, or may extend laterally from the body 40A or have a lateral facing surface in a lateral-biased implementation of the push button 24A, or some combination thereof in a corresponding implementation.

The closure 22A may include at least one tab stop 25A within the push button recess 23A. Although a single tab stop 25A is visible in FIG. 3, the closure 22A may include two tab stops 25A in the embodiment of FIGS. 1-5. A number of the tab stops 25A may equal a number of the retention tabs 43A in some embodiments. Each of the tab stops 25A of the closure 22A may be configured to engage a corresponding one of the retention tabs 43A to prevent forward movement of the retention tab 43A past the corresponding tab stop 25A. Thus, after insertion of the push button 24A into the push button recess 23A to the point that the retention tabs 43A of the push button 24A are behind the tab stops 25A of the closure 22A, the push button 24A may be able to slide rearward and forward relative to the closure 22A within a defined range determined by the tab stops 25A in the forward direction and one or more other features, such as a back end of the push button recess 23A, in the rearward direction.

The latches 42A may extend forward from the body 40A in a forward-biased implementation of the push button 24A as illustrated, rearward from the body 40A in a rearward-biased implementation, laterally from the body 40A in a laterally-biased implementation, or some combination of forward and laterally or rearward and laterally in a corresponding implementation.

Each of the latches 42A may be configured to selectively engage the container top 20A, e.g., at the spout 32A. For instance, the spout 32A may include one or more latch stops 44A (FIG. 5) configured to overhang each of the latches 42A when the closure 22A is in the closed closure position (as illustrated in FIG. 5) and the push button 24A is in the first push button position (as illustrated in FIG. 5). The latch stop 44A may include a lip formed in the spout 32A, a shoulder formed in the spout, an upper surface of a latch recess formed in the spout 32A, or other suitable latch stop 44A. Moreover, the latch stop 44A may be formed on an interior of the spout 32A, for example as illustrated in FIG. 5, or on an exterior of the spout 32A (not illustrated in FIG. 5) provided the push button 24A is implemented accordingly.

As illustrated in FIG. 5, when the push button 24A is in the first push button position and the closure 22A is in the closed closure position, each of the latches 42A may extend beneath the latch stop 44A by an engagement distance $d_e$ measured from a rear edge of the latch stop 44A to a front end of each of the latches 42A. The latches 42A may be disengaged from the latch stop 44A to allow movement of the closure 22A to the open closure position by, e.g., a user pushing the push button 24A rearward through the engagement distance $d_e$ until the front end of each of the latches 42A clears the rear edge of the latch stop 44A, which may constitute the second push button position. With the push button 24A in the second push button position, there is little or no engagement between the latches 42A and the spout 32A. As such, the closure 22A (and the push button 24A) may be rotated clockwise relative to the container lid 20A in the orientation of FIG. 5 to the open closure position in which the lid opening 34A is open.

The resilient member 37A may be configured to urge the push button 24A toward the first push button position (illustrated in FIG. 5) in which the push button 24A engages the spout 32A. The resilient member 37A may also be configured to resiliently deform in response to movement of the push button 24A to the second push button position in which the push button disengages the spout 32A.

As illustrated in FIG. 4B, the resilient member 37A may include a bias member 29 and a lid opening seal 46A. The bias member 29 and the lid opening seal 46A may be integrally formed as a single and/or monolithic component as illustrated, or may be formed as discrete components that are subsequently coupled together after formation.

In some embodiments, the resilient member 37A may comprise a tongue joining the lid opening seal 46A and the bias member 29. Alternatively or additionally, the bias member 29 may comprise the tongue. The tongue may urge the push button 24A toward the first push button position and may resiliently deform in response to movement of the push button to the second push button position.

Referring to FIGS. 3 and 5, the plug 26A may define a seal seat 31A generally configured to receive therein at least a portion of the lid opening seal 46A. For instance, the seal seat 31A may include an annular channel formed around the plug 26A, the seal seat 31A or annular channel having a diameter that is about the same as an internal diameter of the lid opening seal 46A. In some embodiments, the diameter of the seal seat 31A may be slightly smaller than the diameter of the lid opening seal 46A, the lid opening seal 46A being formed of a resilient and/or stretchy material such that the lid opening seal 46A may be stretched when installed in the seal seat 31A to fit snugly around the seal seat 31A. In other embodiments, the lid opening seal 46A may be relaxed and not stretched when installed in the seal seat 31A.

Referring to FIGS. 4B and 5, the bias member 29 may extend rearward from a front of the lid opening seal 46A in a forward biased implementation. Alternatively or additionally, the bias member 29 may extend upward from the lid opening seal 46A. As indicated above, the bias member 29 may comprise a tongue, comprising one or more of a tongue end 29A and a tongue neck 29C. The tongue end 29A may include forward facing surfaces 29B in a forward biased implementation and may be coupled to the lid opening seal 46A via the tongue neck 29C that is narrower than the tongue end 29A.

Referring to FIG. 4A, the push button 24A may comprise a tongue channel 50 that may have a complementary shape to the bias member 29 of the resilient member 37A. The tongue channel 50 may be located at an underside of the push button 24A. The tongue channel 50 may include a tongue end cavity 50A and a tongue neck cavity 50B. In the illustrated embodiment, the tongue end cavity 50A may be sized and configured to receive therein the tongue end 29A of the bias member 29 while the tongue neck cavity 50B may be sized and configured to receive therein the tongue neck 29C. The tongue channel 50 may additionally include rearward facing surfaces 50C in a forward biased implementation. When the bias member 29 of the resilient member 37A is positioned within the tongue channel 50 of the push button 24A, the forward facing surfaces 29B of the tongue end 29A may be positioned adjacent to and/or in direct contact with the rearward facing surfaces 50C of the tongue channel 50 defined by the push button 24A.

As illustrated in FIG. 5, when the container lid 16A is assembled, the lid opening seal 46A of the resilient member 37A may be seated within the seal seat 31A of the plug 26A, with the bias member 29 extending rearward, and optionally upward, from the front of the lid opening seal 46A and into the tongue channel 50 of the push button 24A. With the push button 24A in the first push button position, the rearward facing surfaces 50C of the tongue channel 50 of the push button 24A may be in direct contact with the forward facing surfaces 29B of the tongue end 29. In some embodiments, with the push button 24A in the first push button position, the bias member 29, or at least the tongue neck 29C, may be at least partially stretched rearward to continually bias the push button 24A forward toward the first push button position.

Application of sufficient rearward force to the push button 24A, e.g., to a push region 45A, may overcome the continual forward bias provided by the bias member 29 and cause the push button 24A to move rearward toward the second push button position. Rearward movement of the push button 24A toward the second push button position may result in stretching of the bias member 29, or at least of the tongue neck 29C, as the push button 24A, with its rearward facing surfaces 50C of the tongue channel 50 urging against the forward facing surfaces 29B of the bias member 29, causes the tongue end 29A to move rearward. A front of the tongue neck 29C is coupled to the front of the lid opening seal 46A which in turn is seated in the seal seat 31A of the plug 26A such that the tongue neck 29C stretches along its length as rearward movement of the push button 24A causes reward movement 24A of the tongue end 29A.

When the rearward force is removed from the push button 24A, the stretched tongue neck 29C of the bias member 29 may at least partially recompress, urging the push button 24A back to the first push button position as the forward facing surfaces 29B of the bias member 29 urge forward against the rearward facing surfaces 50C in the tongue channel 50 of the push button 24A. In this and other embodiments, the container lid 16A may have a reduced part count and cost compared to some container lids that have both a bias member and a lid opening seal as discrete components.

The plug 26A may be integrally formed with the closure 22A, for example as illustrated, or may be formed as a discrete component that is coupled to the closure 22A. Alternatively or additionally, the plug 26A may be integrally formed with the lid opening seal 46A although they are illustrated as discrete components in FIGS. 1-5.

The lid opening seal 46A may be configured to seal the lid opening 34A of the spout 32A when the closure 22A is in the closed closure position. The lid opening seal 46A may include an o-ring gasket as in the embodiments of FIGS. 1-5, 14-21B, and 22-31, a resilient oversized annular plug protrusion as in the embodiment of FIGS. 10-13, a resilient inverse dome seal as in the embodiment of FIGS. 6-9, or other suitable lid opening seal.

The seal between the lid opening seal 46A and the lid opening 34A may be sufficiently tight to prevent unintentional leakage of fluids or other contents from the container 10A when the lid opening 34A is closed by the closure 22A, without being so tight as to retain by itself the closure 22A in the closed closure position under a relatively modest opening force. Instead, the latches 42A may cooperate with the latch stop 44A to retain the closure 22A in the closed closure position when the push button 24A is in the first push button position.

Figure 6:
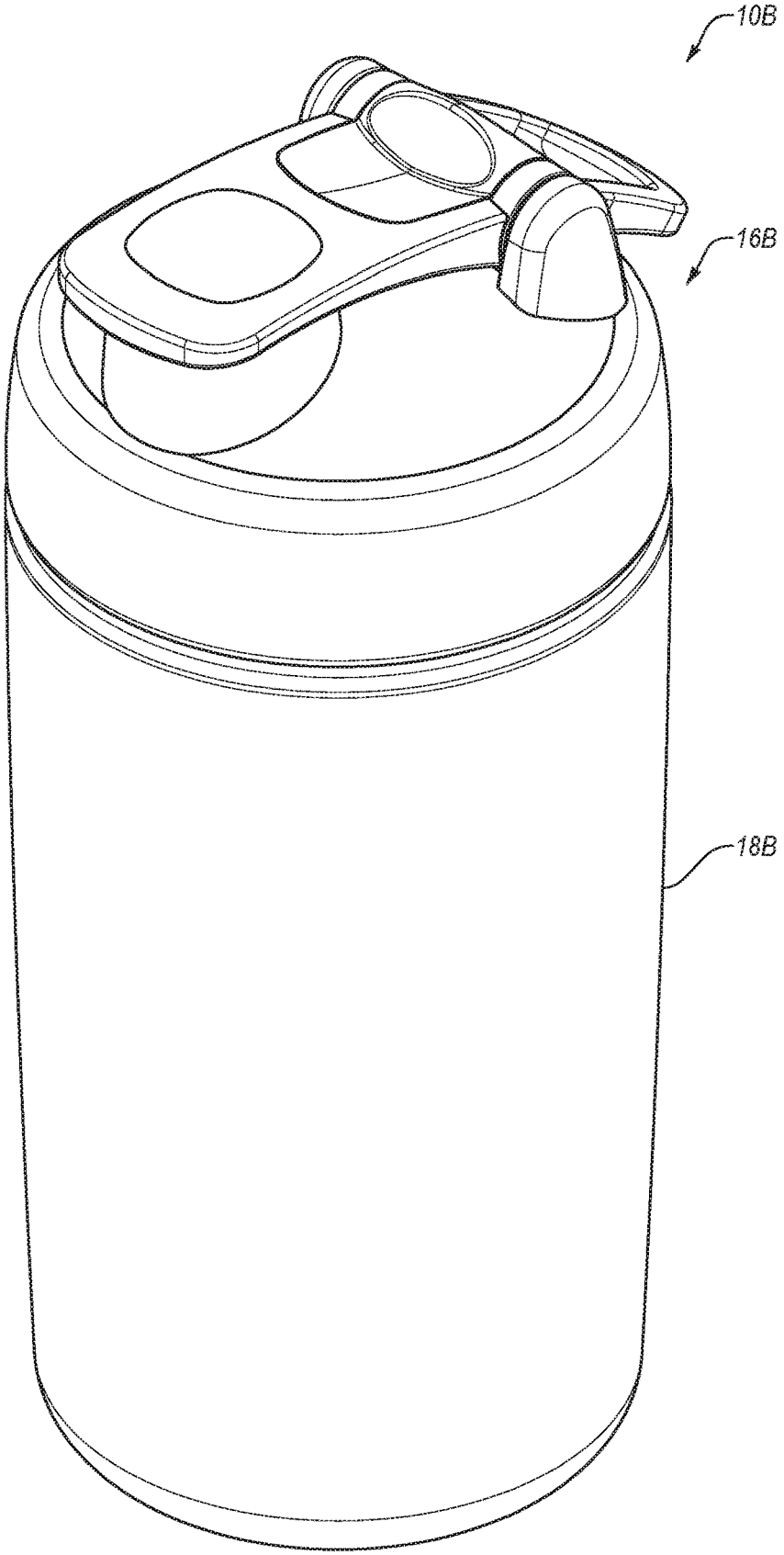
FIG. 6 is an upper perspective view of another example container.

FIG. 6 is an upper perspective view of another example container 10B, arranged in accordance with at least one embodiment described herein. As shown in FIG. 6, the container 10B may include a container body 18B and a container lid 16B. The container body 18B may be sized and shaped to hold, retain and/or store one or more liquids, solids, or other contents.

The container lid 16B may cooperate with the container body 18B to secure contents such as liquids within the container body 18B. The container lid 16B may be removed entirely from the container body 18B to expose a top opening (not visible in FIG. 6) of the container body 18B through which an interior of the container body 18B may be accessed, e.g., to add contents to the container 10B, to remove contents from the container 10B, to wash an interior of the container body 18B, or to otherwise access the interior of the container body 18B.

The container lid 16B may define a lid opening (see, e.g., FIG. 8) that may be relatively small, e.g., smaller than the top opening of the container body 18B, and through which the interior of the container body 18B may be accessed. For instance, a user may consume the contents of the container 10B through the lid opening of the container lid 16B, dispense a powdered drink mix into the container 10B through the lid opening, or otherwise access the interior of the container body 18B through the lid opening of the container lid 16B.

The container lid 16B may be selectively connected to the container body 18B. For example, the container lid 16B may be selectively connected to the container body 18B by threading, snapping, twisting, sliding, or screwing the container lid 16B to the container. For example, an upper portion of the container body 18B may include one or more exterior or interior threads and a lower portion of the container lid 16B may include one or more corresponding threads. The threads may mate to allow the container lid 16B to be selectively connected to the container body 18B. The threaded connection of the container lid 16B to the container body 18B may create a secure, airtight, watertight and/or leak-proof seal. The threaded connection may require multiple turns or a single turn or less to securely connect the container body 18B and the container lid 16B. More generally, the container body 18B and the container lid 16B may be connected by any suitable number of turns. The container body 18B and the container lid 16B may also be connected using other suitable types of connections and structures depending, for example, upon the intended use of the container.

Figure 7:
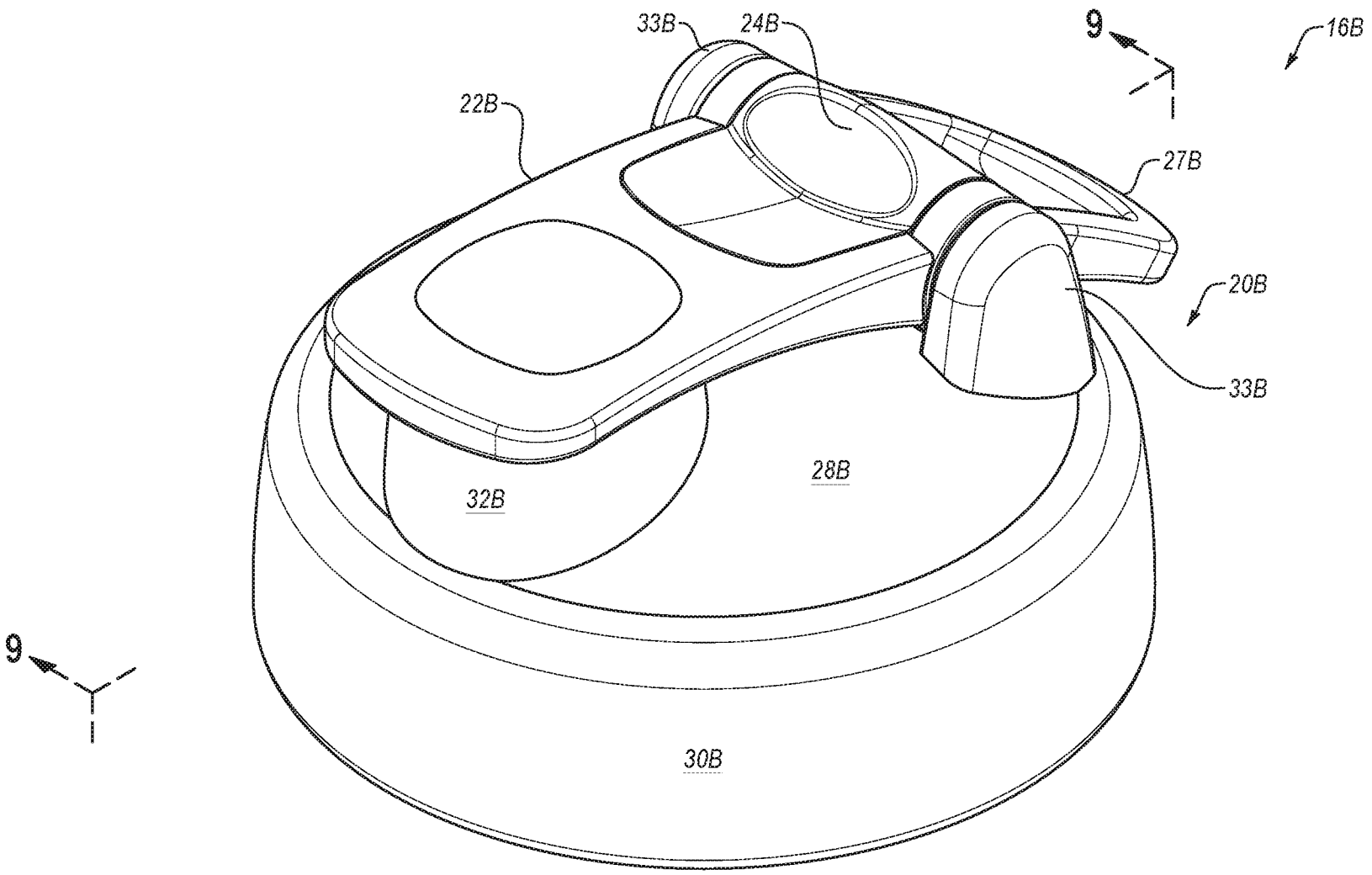
FIG. 7 is an upper perspective view of a container lid of FIG. 6.
Figure 8:
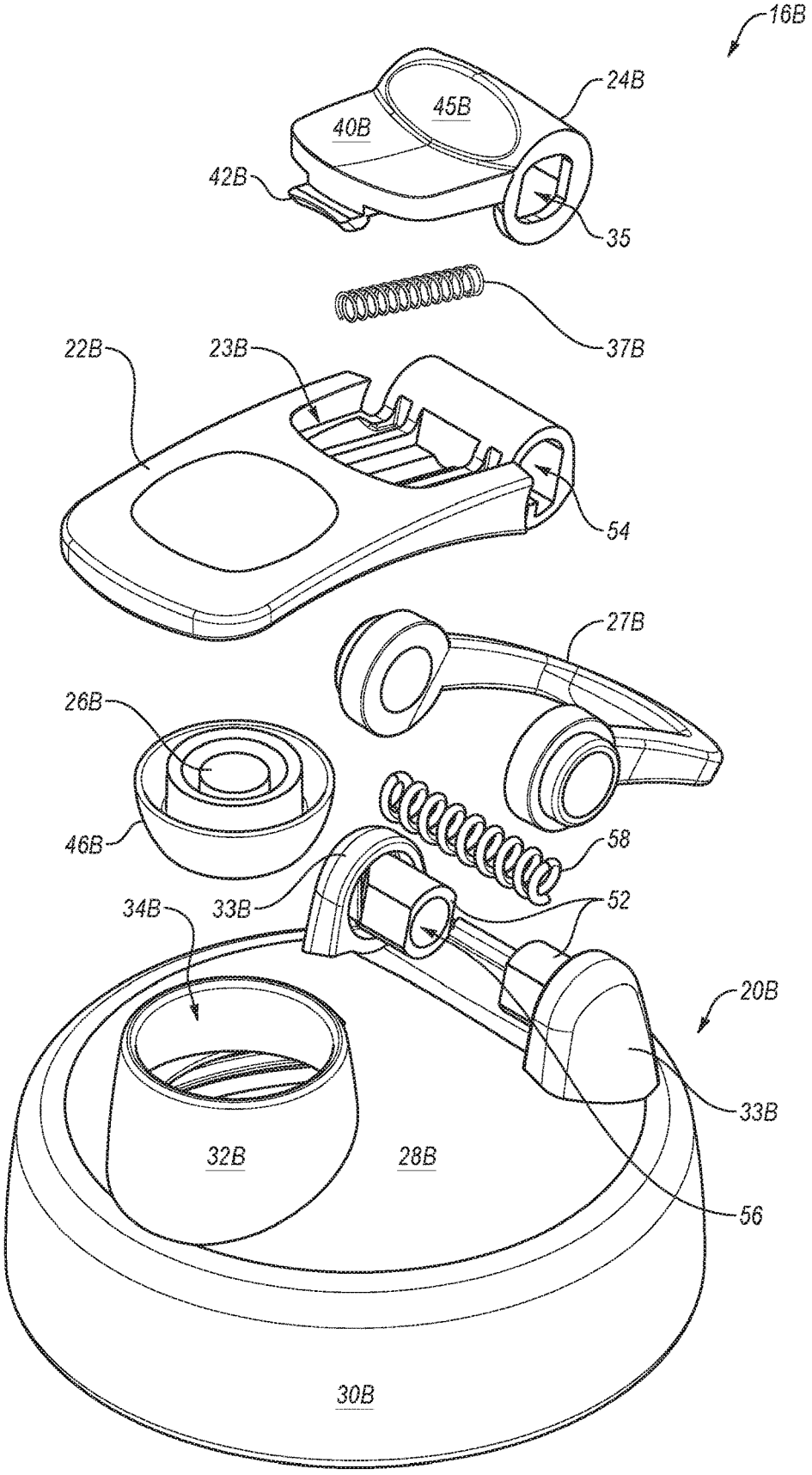
FIG. 8 is an exploded upper perspective view of the container lid of FIGS. 6 and 7.

FIG. 7 is an upper perspective view of the container lid 16B of FIG. 6, arranged in accordance with at least one embodiment described herein. FIG. 8 is an exploded upper perspective view of the container lid 16B of FIGS. 6 and 7, arranged in accordance with at least one embodiment described herein. As illustrated in FIGS. 7 and 8, the container lid 16B may include a container top 20B, a closure 22B, a push button 24B, and a plug 26B (see, e.g., FIG. 9). Alternatively or additionally, the container lid 16B may include a handle or carry loop 27B that may be configured to rotate relative to the container top 20B. The carry loop 27B may be configured to rotate independently of the closure 22B. Alternatively, the carry loop 27B may be configured to rotate together with the closure 22B.

The container top 20B may include an end wall 28B, a skirt 30B, a spout 32B and/or one or more pivot posts 33B. The skirt 30B may generally extend downward from the end wall 28B and may be configured to matingly engage a top of the container body 18B. In this and other embodiments, the skirt 30B may include on an interior or exterior surface thereof one or more container engagement members to selectively secure the container top 20B to the container body 18B. For instance, the skirt 30B may include interior threads (as in FIG. 9), exterior threads, a bayonet-style mount, or other container engagement members configured to matingly engage with one or more corresponding threads, bayonet-style mounts, or other lid engagement members formed on an upper exterior or interior surface of the container body 18B to secure the container top 20B to the container body 18B.

The spout 32B may extend upward from the end wall 28B. One or more lid openings 34B may pass through the spout 32B. In some embodiments, the spout 32B may define one or more openings. A single generally circular lid opening 34B is depicted in FIG. 8 as an example; in other embodiments, the spout 32B may define two or more openings of any suitable size and/or shape. When the container lid 16B is coupled to the container body 18B and the closure 22B is moved to an open closure position, a user may consume or otherwise remove contents from the container 10B through the lid opening 34B. Alternatively or additionally, the user may add contents to the container 10B through the lid opening 34B.

The closure 22B may be pivotally coupled to the container top 20B and may be configured to selectively cover the lid opening 34B. For instance, the closure 22B may be rotatable between the open closure position in which the lid opening 34B is open and a closed closure position (as illustrated in FIG. 7) in which the lid opening 34B is closed.

The closure 22B may be pivotally coupled to the container top 20B through the pivot posts 33B and beveled axles 52, which may define a rotational axis of the closure 22B. In the illustrated embodiment, each of the pivot posts 33B includes an inward directed beveled surface that interacts with an outward directed beveled surface of a corresponding one of the beveled axles 52 to cause the beveled axles 52 to translate toward or away from each other with rotation of the beveled axles 52 about the rotational axis.

Each of the beveled axles 52 may be configured to be received within a corresponding one of two push button axle openings 35 (only one is visible in FIG. 8) defined on opposite sides of the push button 24B and within a corresponding one of two closure axle openings 54 (only one is visible in FIG. 8). A cross-sectional shape of one or both of the push button axle openings 35 and the closure axle openings 54 may be complementary to a cross-sectional shape of the beveled axles 52. As such, rotation of the push button 24B and/or the closure 22B about the rotational axis may also cause rotation of the beveled axles 52 about the rotational axis and vice versa.

Each of the beveled axles 52 may include a bias member opening 56 (only one is visible in FIG. 8) configured to receive a corresponding one of opposite ends of a bias member 58. The bias member 58 may include a bias spring that is slightly compressed between the two beveled axles 52 even when the two beveled axles 52 are separated by a widest distance permitted by interaction of the beveled surfaces of the pivot posts 33B with the beveled surfaces of the beveled axles 52. The beveled surfaces of the pivot posts 33B and of the beveled axles 52 may be arranged such that the beveled axles 52 are closer together when the closure 22B is rotated to the closed closure position and increasingly far apart from each other as the closure 22B is rotated toward the open closure position.

The bias member 58 together with the beveled surfaces of the pivot posts 33B and of the beveled axles 52 may rotationally bias the beveled axles 52 toward the rotational position in which they are further apart from each other and may urge the beveled axles 52 toward the rotational position in which they are further apart from each other when not prevented from doing so by any counteracting forces. Insofar as the rotational position in which the beveled axles 52 are further apart from each other may correspond to the open closure position of the closure 22B and the rotational position in which the beveled axles 52 are closer to each other may correspond to the closed closure position of the closure 22B, the bias member 58 together with the beveled surfaces of the pivot posts 33B and of the beveled axles 52 may rotationally bias the closure 22B toward the open closure position. For instance, when the push button 24B is operated to disengage the latch 42B from the spout 32B, the bias member 58 together with the beveled surfaces of the pivot posts 33B and of the beveled axles 52 may cause the closure 22B to automatically flip open from the first closure position toward the second closure position. A user may apply appropriate force to the closure 22B and/or the push button 24B to overcome such bias and move the closure 22B and push button 24B back to the first closure position where the latch 42B can re-engage the spout 32B to retain the closure 22B in the first closure position.

Each of the push button axle openings 35 may be oversized in at least one dimension relative to the corresponding beveled axle 52 to permit sliding or other translational movement of the push button 24B relative to the beveled axles 52, the pivot posts 33B, and thus the spout 34B to permit engagement and disengagement of the spout 32B by the latch 42B.

The push button 24B may be slidably coupled to the closure 22B and may be configured to selectively engage the spout 32B or other portion of the container top 20B to selectively retain the closure 22B in the closed closure position. In these and other embodiments, the container lid 16B may include a bias member 37B configured to urge the push button 24B toward a first push button position in which the push button 24B can engage the container top 20B, e.g., at the spout 32B, and to resiliently deform in response to movement of the push button 24B to a second push button position in which the push button 24B is disengaged from the container top 20B. The bias member 37B may thereby forward bias the push button 24B, e.g., the push button 24B may be urged forward by the bias member 37B. In other embodiments, the push button 24B may be rearward biased by the bias member 37B.

As illustrated in FIG. 8, the closure 22B may have a push button recess 23B. With combined reference to FIGS. 7 and 8, the push button 24B may be at least partially disposed within the push button recess 23B. In the illustrated embodiment, a top and rear of the push button 24B may be uncovered and exposed. In some embodiments, the push button 24B may be coupled to the pivot posts 33B while the closure 22B may also be coupled to the pivot posts 33B to be maintained in position (or within a range of positions) relative to the closure 22B, rather than including retention tabs, for example as in the embodiment of FIGS. 1-5.

Figure 9:
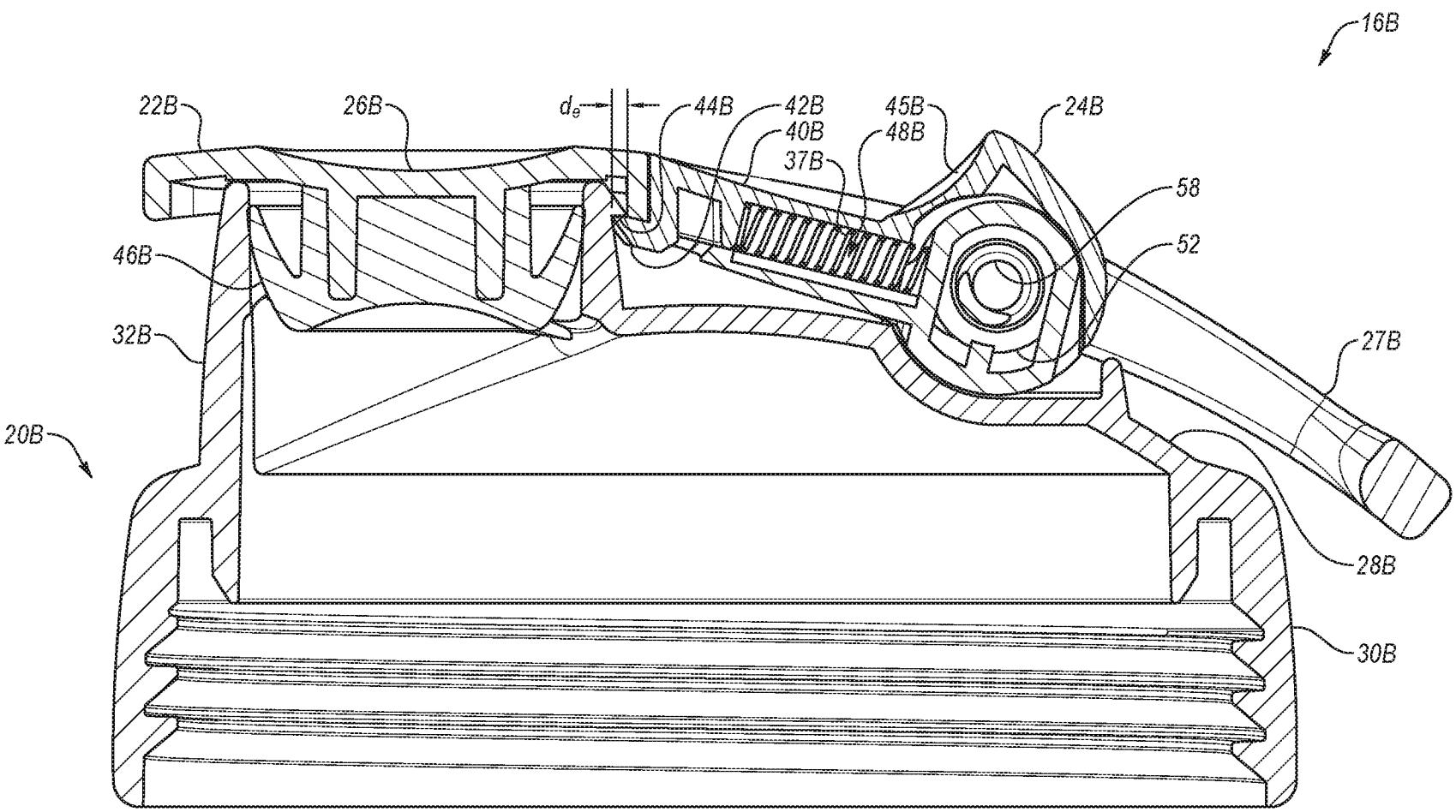
FIG. 9 is a cross-sectional view of the container lid of FIGS. 6 and 7.

FIG. 9 is a cross-sectional view of the container lid 16B of FIGS. 6 and 7 along cutting plane 9-9 in FIG. 7, arranged in accordance with at least one embodiment described herein. With combined reference to FIGS. 6-9, the push button 24B may include a body 40B and one or more latches 42B. The push button 24B may include one latch 42B, for example, as illustrated in FIG. 8, or two or more latches 42B. Alternatively or additionally, the push button 24B may include retention tabs as described elsewhere.

The latch 42B may extend forward from the body 40B in a forward-biased implementation of the push button 24B as illustrated, rearward from the body 40B in a rearward-biased implementation, laterally from the body 40B in a laterally-biased implementation, or some combination of forward and laterally or rearward and laterally in a corresponding implementation.

The latch 42B may be configured to selectively engage the container top 20B, e.g., at the spout 32B. For instance, the spout 32B may include one or more latch stops 44B (FIG. 9) configured to overhang each of the latch 42B when the closure 22B is in the closed closure position (as illustrated in FIG. 9) and the push button 24B is in the first push button position (as illustrated in FIG. 9). The latch stop 44B may include a lip formed in the spout 32B, a shoulder formed in the spout, an upper surface of a latch recess formed in the spout 32B, or other suitable latch stop 44B. Moreover, the latch stop 44B may be formed on an exterior of the spout 32B, for example as illustrated in FIG. 9, or on an interior of the spout 32B (not illustrated in FIG. 9) provided the push button 24B is implemented accordingly. Implementing the latch stop 44B on the rear exterior of the spout 32B, for example as illustrated in FIG. 9, may reduce a likelihood of material buildup on the latch stop 44B compared to the latch stop 44A of FIG. 5 implemented on the interior of the spout 32A of FIG. 5.

As illustrated in FIG. 9, when the push button 24B is in the first push button position and the closure 22B is in the closed closure position, the latch 42B may extend beneath the latch stop 44B by an engagement distance $d_e$ measured from a rear edge of the latch stop 44B to a front end of the latch 42B. The latch 42B may be disengaged from the latch stop 44B to allow movement of the closure 22B to the open closure position by, e.g., a user pushing the push button 24B rearward through the engagement distance $d_e$ until the front end of the latch 42B clears the rear edge of the latch stop 44B, which may constitute the second push button position. With the push button 24B in the second push button position, there is little or no engagement between the latch 42B and the spout 32B. As such, the closure 22B (and the push button 24B) may be rotated clockwise relative to the container lid 20B in the orientation of FIG. 9 to the open closure position in which the lid opening 34B is open.

As illustrated in FIGS. 8 and 9, the bias member 37B may include a bias spring positioned in a cavity 48B. A front of the cavity 48B is defined by the push button 24B and a rear of the cavity 48B is defined by the closure 22B. The bias member 37B may be slightly compressed in the cavity 48B between the push button 24B and the closure 22B to continually bias the push button 24B forward toward the first push button position. Application of sufficient rearward force to the push button 24B, e.g., to a push region 45B of the push button 24B, may cause the push button 24B to move rearward toward the second push button position, resulting in compression of the bias member 37B by the push button 24B. When the rearward force is removed from the push button 24B, the compressed bias member 37B may at least partially decompress, urging the push button 24B back to the first push button position.

The plug 26B may be integrally formed with the closure 22B, or may be formed as a discrete component that is coupled to the closure 22B, for example as illustrated. The plug 26B may further include a lid opening seal 46B configured to seal the lid opening 34B of the spout 32B when the closure 22B is in the closed closure position. The lid opening seal 46B may be integrally formed with the plug 26B, or may be formed as a discrete component that is coupled to the plug 26B as illustrated. The lid opening seal 46B may include a resilient inverse dome seal as in the embodiment of FIGS. 6-9, an o-ring gasket as in the embodiments of FIGS. 1-5, 14-21B, and 22-31, a resilient oversized annular plug protrusion as in the embodiment of FIGS. 10-13, or other suitable lid opening seal.

The seal between the lid opening seal 46B and the lid opening 34B may be sufficiently tight to prevent unintentional leakage of fluids or other contents from the container 10B when the lid opening 34B is closed by the closure 22B, without being so tight as to retain by itself the closure 22B in the closed closure position under a relatively modest opening force. Instead, the latch 42B may cooperate with the latch stop 44B to retain the closure 22B in the closed closure position when the push button 24B is in the first push button position.

Figure 10:
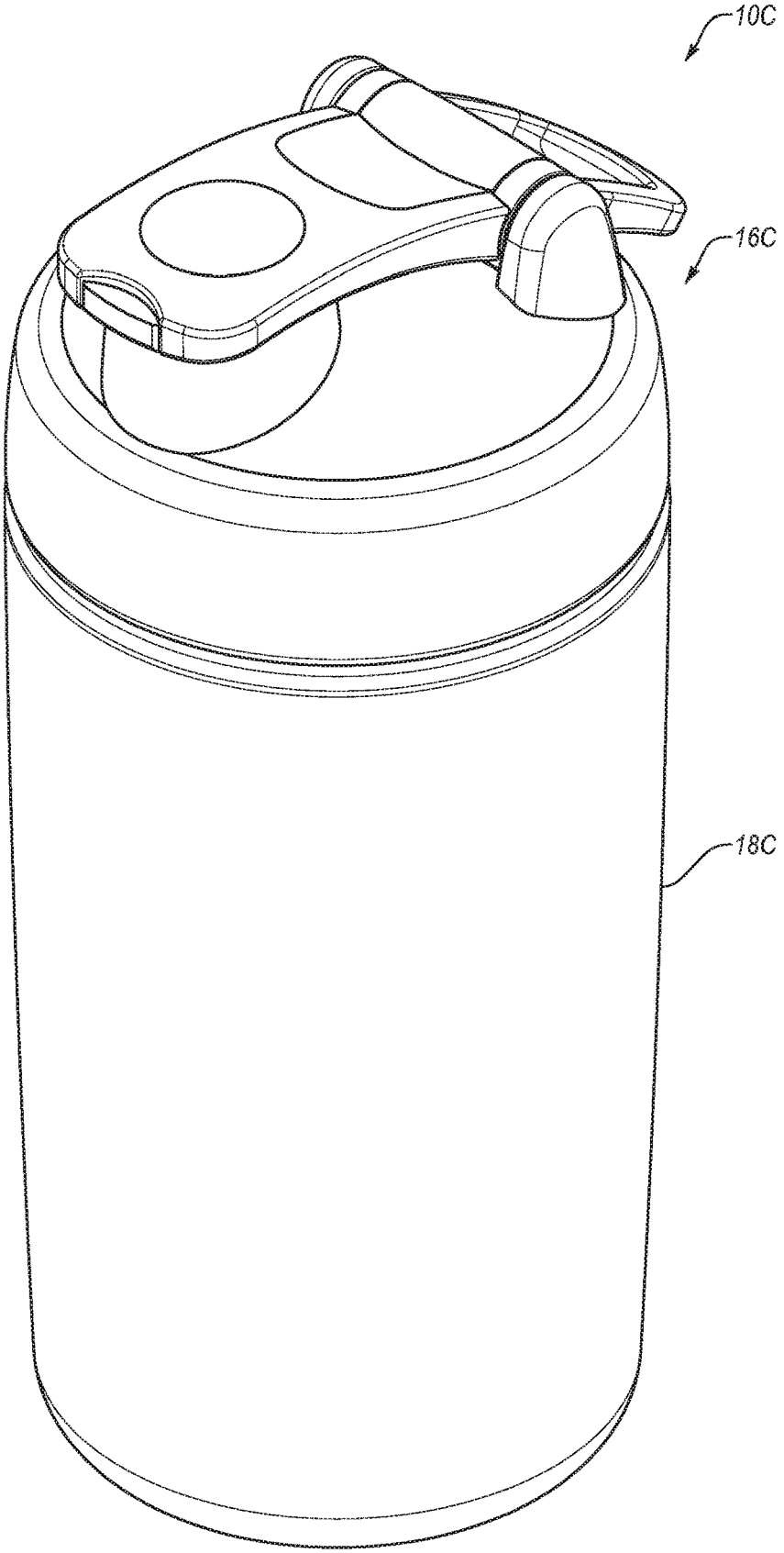
FIG. 10 is an upper perspective view of another example container.

FIG. 10 is an upper perspective view of another example container 10C, arranged in accordance with at least one embodiment described herein. As shown in FIG. 10, the container 10C may include a container body 18C and a container lid 16C. The container body 18C may be sized and shaped to hold, retain and/or store one or more liquids and/or solids, generally referred to herein as contents.

The container lid 16C may cooperate with the container body 18C to secure contents such as liquids within the container body 18C. The container lid 16C may be removed entirely from the container body 18C to expose a top opening (not visible in FIG. 10) of the container body 18C through which an interior of the container body 18C may be accessed, e.g., to add contents to the container 10C, to remove contents from the container 10C, to wash an interior of the container body 18C, or to otherwise access the interior of the container body 18C.

The container lid 16C may define a lid opening (see, e.g., FIG. 12) that may be relatively small, e.g., smaller than the top opening of the container body 18C, and through which the interior of the container body 18C may be accessed. For instance, a user may consume the contents of the container 10C through the lid opening of the container lid 16C, dispense a powdered drink mix into the container 10C through the lid opening, or otherwise access the interior of the container body 18C through the lid opening of the container lid 16C.

The container lid 16C may be selectively connected to the container body 18C. For example, the container lid 16C may be selectively connected to the container body 18C by threading, snapping, twisting, sliding, or screwing the container lid 16C to the container. For example, an upper portion of the container body 18C may include one or more exterior or interior threads and a lower portion of the container lid 16C may include one or more corresponding threads. The threads may mate to allow the container lid 16C to be selectively connected to the container body 18C. The threaded connection of the container lid 16C to the container body 18C may create a secure, airtight, watertight and/or leak-proof seal. The threaded connection may require multiple turns or a single turn or less to securely connect the container body 18C and the container lid 16C. More generally, the container body 18C and the container lid 16C may be connected by any suitable number of turns. The container body 18C and the container lid 16C may also be connected using other suitable types of connections and structures depending, for example, upon the intended use of the container.

Figure 11:
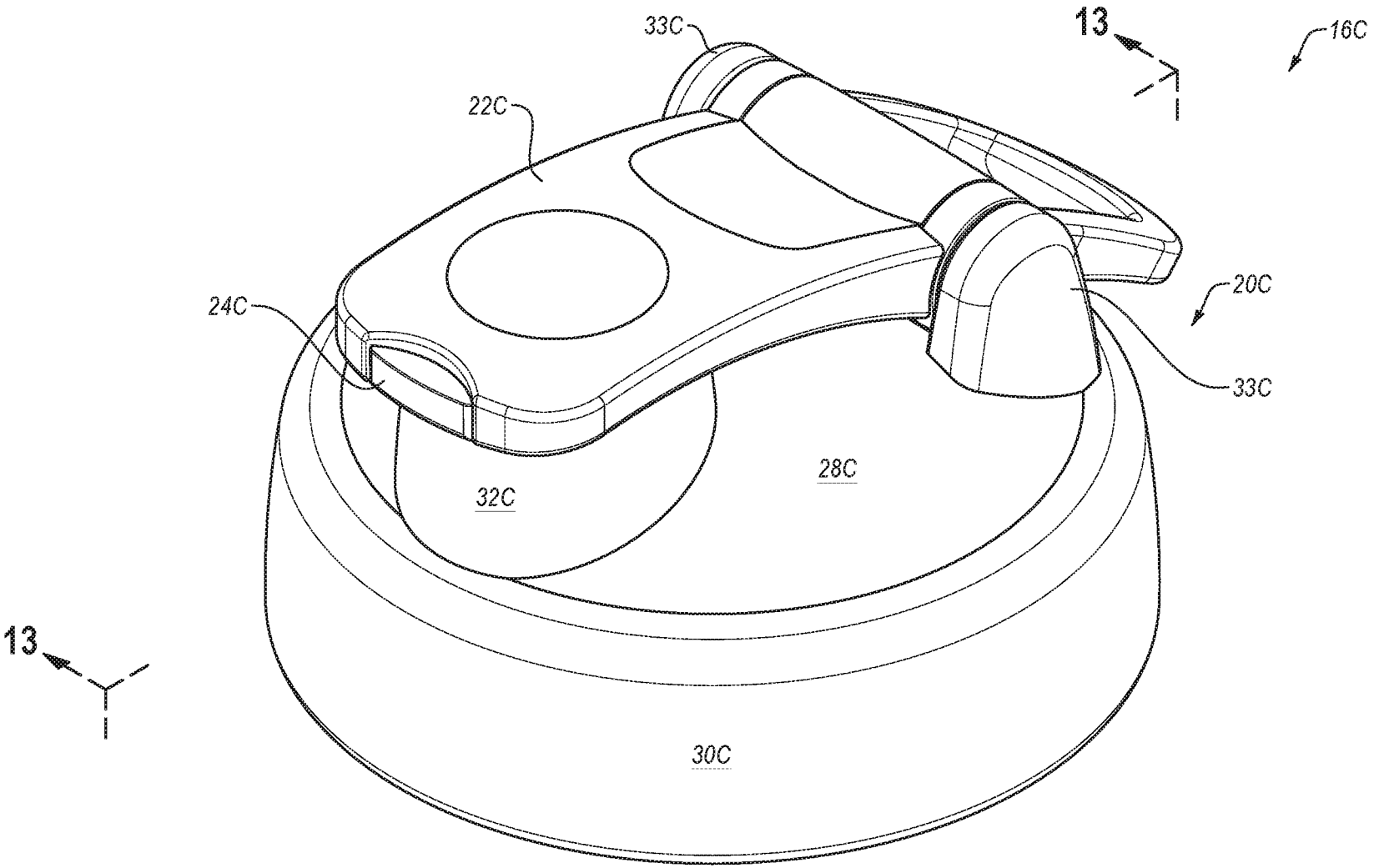
FIG. 11 is an upper perspective view of a container lid of FIG. 10.
Figure 12:
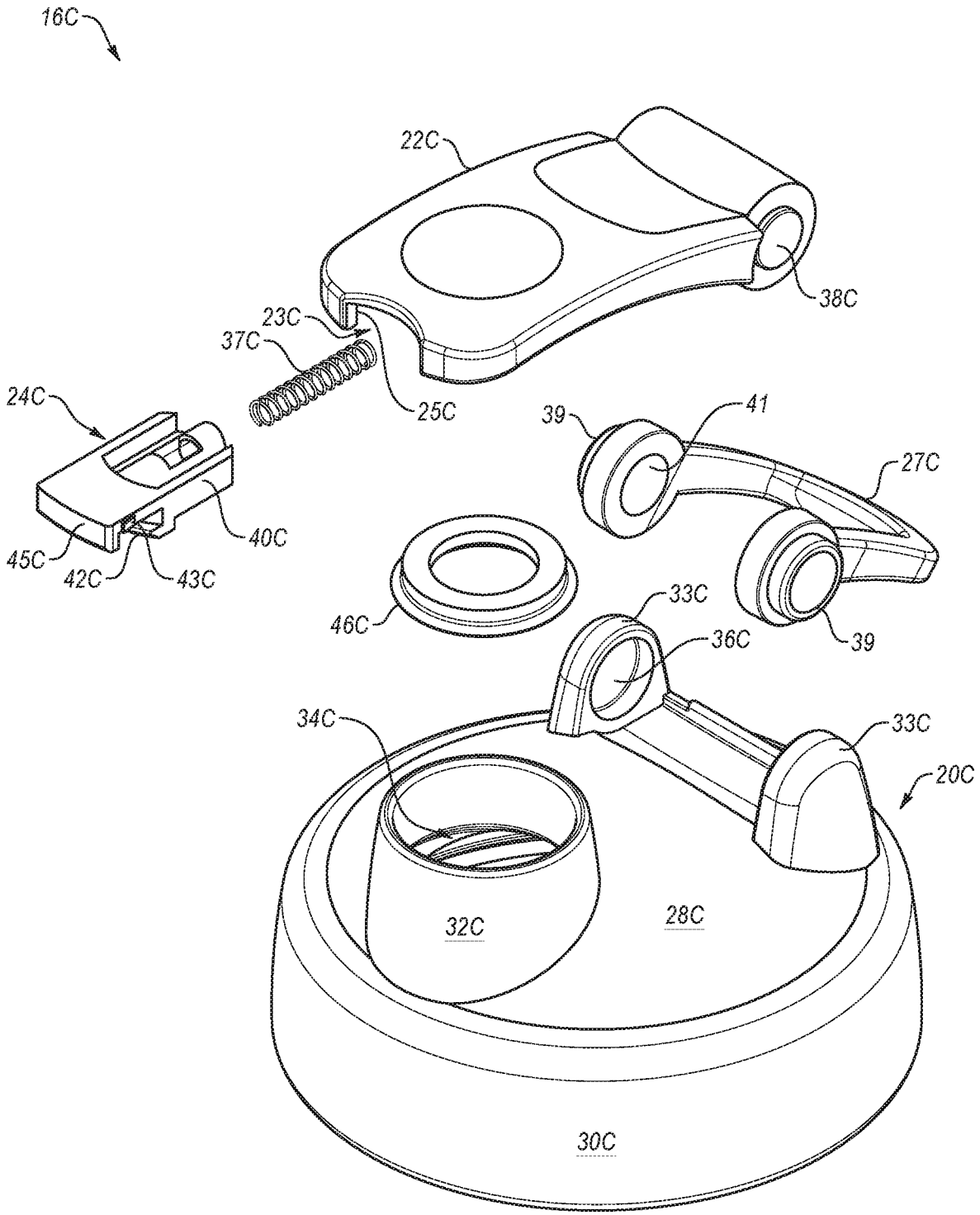
FIG. 12 is an exploded upper perspective view of the container lid of FIGS. 10 and 11.
Figure 13:
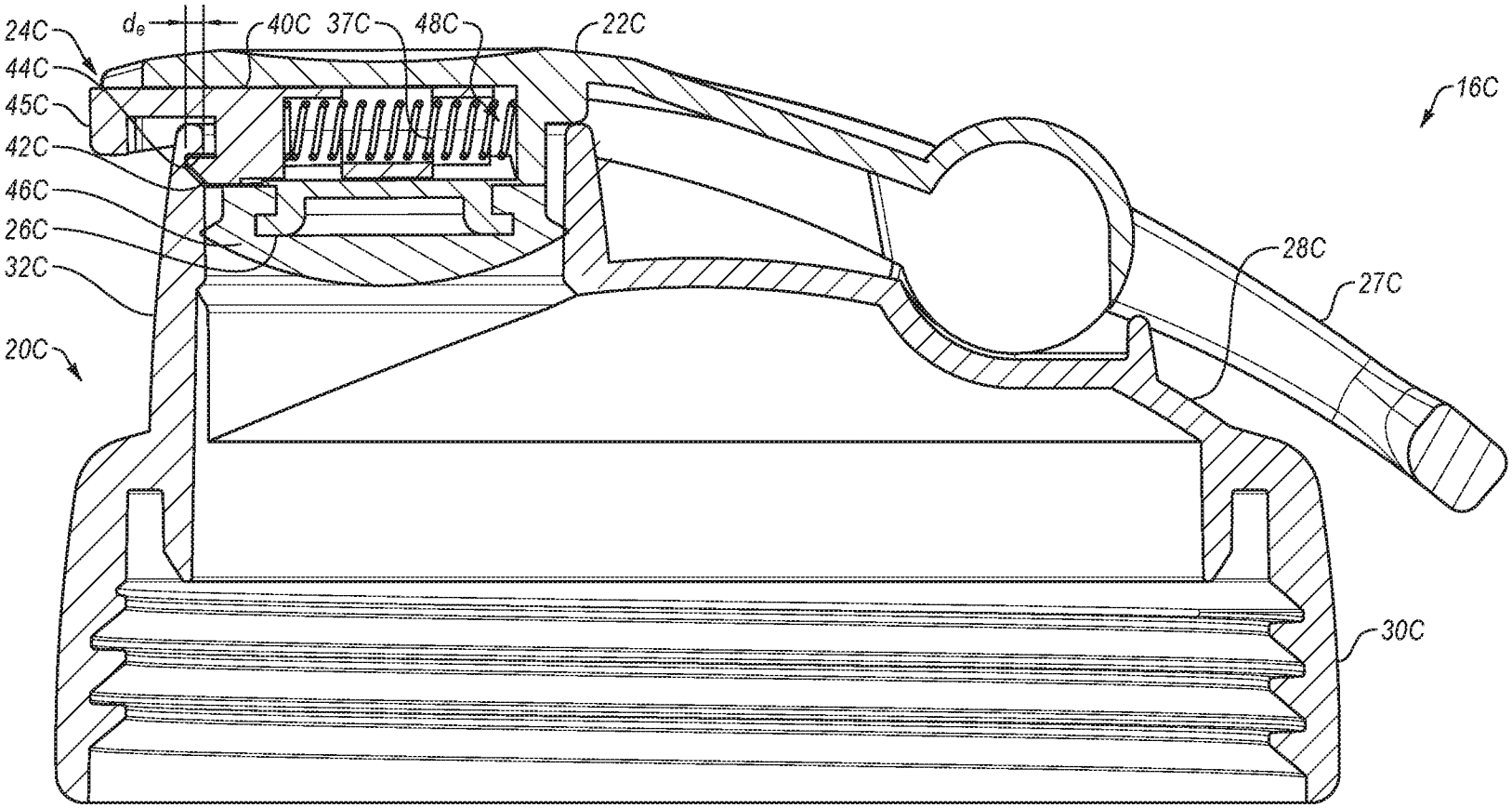
FIG. 13 is a cross-sectional view of the container lid of FIGS. 10 and 11.

FIG. 11 is an upper perspective view of the container lid 16C of FIG. 10, arranged in accordance with at least one embodiment described herein. FIG. 12 is an exploded upper perspective view of the container lid 16C of FIGS. 10 and 11, arranged in accordance with at least one embodiment described herein. FIG. 13 is a cross-sectional view of the container lid 16C of FIGS. 10 and 11 along cutting plane 13-13 in FIG. 11, arranged in accordance with at least one embodiment described herein. As illustrated in FIGS. 11-13, the container lid 16C may include a container top 20C, a closure 22C, a push button 24C, and a plug 26C (see, e.g., FIG. 13). Alternatively or additionally, the container lid 16C may include a handle or carry loop 27C that may be configured to rotate relative to the container top 20C. The carry loop 27C may be configured to rotate independently of the closure 22C. Alternatively, the carry loop 27C may be configured to rotate together with the closure 22C.

The container top 20C may include an end wall 28C, a skirt 30C, a spout 32C and/or one or more pivot posts 33C. The skirt 30C may generally extend downward from the end wall 28C and may be configured to matingly engage a top of the container body 18C. In this and other embodiments, the skirt 30C may include on an interior or exterior surface thereof one or more container engagement members to selectively secure the container top 20C to the container body 18C. For instance, the skirt 30C may include interior threads (as in FIG. 13), exterior threads, a bayonet-style mount, or other container engagement members configured to matingly engage with one or more corresponding threads, bayonet-style mounts, or other lid engagement members formed on an upper exterior or interior surface of the container body 18C to secure the container top 20C to the container body 18C.

The spout 32C may extend upward from the end wall 28C. One or more lid openings 34C may pass through the spout 32C. In some embodiments, the spout 32C may define one or more lid openings. A single generally circular lid opening 34C is depicted in FIG. 12 as an example; in other embodiments, the spout 32C may define two or more openings of any suitable size and/or shape. When the container lid 16C is coupled to the container body 18C and the closure 22C is moved to an open closure position, a user may consume or otherwise remove contents from the container 10C through the lid opening 34C. Alternatively or additionally, the user may add contents to the container 10C through the lid opening 34C.

The closure 22C may be pivotally coupled to the container top 20C and may be configured to selectively cover the lid opening 34C. For instance, the closure 22C may be rotatable between the open closure position in which the lid opening 34C is open and a closed closure position (as illustrated in FIG. 11) in which the lid opening 34C is closed.

The closure 22C may be pivotally coupled to the container top 20C through the pivot posts 33C, which may define a rotational axis of the closure 22C. In the illustrated embodiment, each of the pivot posts 33C defines an opening 36C (only one is visible in FIG. 12) configured to receive a protrusion 39 of the carry loop 27C. The carry loop 27C may define openings 41 (only one is visible in FIG. 12) configured to receive a corresponding protrusion 38C (only one is visible in FIG. 12) of the closure 22C. The protrusions 38C of the closure 22C are retained in the openings 41 of the carry loop 27C while the protrusions 39 of the carry loop 27C are retained in the openings 36C of the pivot posts 33C during operation to permit the closure 22C and/or the carry loop 27C to rotate relative to the container top 20C and/or relative to each other.

The push button 24C may be slidably coupled to the closure 22C and may be configured to selectively engage the spout 32C or other portion of the container top 20C to selectively retain the closure 22C in the closed closure position. In these and other embodiments, the container lid 16C may include a bias member 37C configured to urge the push button 24C toward a first push button position in which the push button 24C can engage the container top 20C, e.g., at the spout 32B, and to resiliently deform in response to movement of the push button 24C to a second push button position in which the push button 24C is disengaged from the container top 20C. The bias member 37C may thereby forward bias the push button 24C, e.g., the push button 24C may be urged forward by the bias member 37C. In other embodiments, the push button 24C may be rearward biased by the bias member 37C.

As illustrated in FIG. 12, the closure 22C may have a push button recess 23C. With combined reference to FIGS. 11-13, the push button 24C may be disposed substantially within the push button recess 23C and may be substantially enclosed by the closure 22C. For instance, a majority of the push button 24C may be covered by and/or enclosed within the closure 22C, for example, as illustrated in FIGS. 11 and 13.

The push button 24C may include a body 40C, one or more latches 42C, and/or one or more retention tabs 43C (only one is visible in FIG. 12). The push button 24C may include one latch 42C and two retention tabs 43C, for example as illustrated in FIG. 12, with the retention tabs 43C extending outward from opposite sides of the body 40C. Alternatively, the push button 24C may include two or more latches 42C, a single retention tab 43C, or three or more retention tabs 43C.

The retention tabs 43C may be configured to retain the push button 24C within the push button recess 23C of the closure 22C. Each of the retention tabs 43C may generally extend outward from the body 40C. In addition, each of the retention tabs 43C may extend forward from the body 40C or have a forward-facing surface in a forward-biased implementation of the push button 24C as illustrated, or may extend rearward from the body 40C or have a rearward-facing surface in a rearward-biased implementation of the push button 24C, or may extend laterally from the body 40C or have a lateral facing surface in a lateral-biased implementation of the push button 24C, or some combination thereof in a corresponding implementation.

The closure 22C may include at least one tab stop 25C within the push button recess 23C. Although a single tab stop 25C is visible in FIG. 12, the closure 22C may include two tab stops 25C in the embodiment of FIGS. 10-13. A number of the tab stops 25C may equal a number of the retention tabs 43C in some embodiments. Each of the tab stops 25C of the closure 22C may be configured to engage a corresponding one of the retention tabs 43C to prevent forward movement of the retention tab 43C past the corresponding tab stop 25C. Thus, after insertion of the push button 24C into the push button recess 23C to the point that the retention tabs 43C of the push button 24C are behind the tab stops 25C of the closure 22C, the push button 24C may be able to slide rearward and forward relative to the closure 22C within a defined range determined by the tab stops 25C in the forward direction and one or more other features, such as a back end of the push button recess 23C, in the rearward direction.

The latch 42C may extend forward from the body 40C in a forward-biased implementation of the push button 24C as illustrated, rearward from the body 40C in a rearward-biased implementation, laterally from the body 40C in a laterally-biased implementation, or some combination of forward and laterally or rearward and laterally in a corresponding implementation.

The latch 42C may be configured to selectively engage the container top 20C, e.g., at the spout 32C. For instance, the spout 32C may include one or more latch stops 44C (FIG. 13) configured to overhang each of the latch 42C when the closure 22C is in the closed closure position (as illustrated in FIG. 13) and the push button 24C is in the first push button position (as illustrated in FIG. 13). The latch stop 44C may include a lip formed in the spout 32C, a shoulder formed in the spout, an upper surface of a latch recess formed in the spout 32C, or other suitable latch stop 44C. Moreover, the latch stop 44C may be formed on an interior of the spout 32C, for example as illustrated in FIG. 13, or on an exterior of the spout 32C (not illustrated in FIG. 13) provided the push button 24C is implemented accordingly.

As illustrated in FIG. 13, when the push button 24C is in the first push button position and the closure 22C is in the closed closure position, the latch 42C may extend beneath the latch stop 44C by an engagement distance $d_e$ measured from a rear edge of the latch stop 44C to a front end of the latch 42C. The latch 42C may be disengaged from the latch stop 44C to allow movement of the closure 22C to the open closure position by, e.g., a user pushing the push button 24C rearward through the engagement distance $d_e$ until the front end of the latch 42C clears the rear edge of the latch stop 44C, which may constitute the second push button position. With the push button 24C in the second push button position, there is little or no engagement between the latch 42C and the spout 32C. As such, the closure 22C (and the push button 24C) may be rotated clockwise relative to the container lid 20C in the orientation of FIG. 13 to the open closure position in which the lid opening 34C is open.

As illustrated in FIGS. 12 and 13, the bias member 37C may include a bias spring positioned in a cavity 48C. A front of the cavity 48C may be defined by the push button 24C and a rear of the cavity 48C may be defined by the closure 22C. The bias member 37C may be slightly compressed in the cavity 48C between the push button 24C and the closure 22C to continually bias the push button 24C forward toward the first push button position. Application of sufficient rearward force to the push button 24C, e.g., to a push region 45C, may cause the push button 24C to move rearward toward the second push button position, resulting in compression of the bias member 37C by the push button 24C. When the rearward force is removed from the push button 24C, the compressed bias member 37C may at least partially decompress, urging the push button 24C back to the first push button position.

The plug 26C may be integrally formed with the closure 22C, for example as illustrated, or may be formed as a discrete component that is coupled to the closure 22C. The plug 26C may further include a lid opening seal 46C configured to seal the lid opening 34C of the spout 32C when the closure 22C is in the closed closure position. The lid opening seal 46C may be integrally formed with the plug 26C, or may be formed as a discrete component that is coupled to the plug 26C as illustrated. The lid opening seal 46C may include a resilient oversized annular plug protrusion as illustrated. In this and other embodiments, the oversized annular plug protrusion of the lid opening seal 46C may have an uncompressed diameter that is greater than a diameter of the lid opening 34C. The oversized annular plug protrusion may be at least partially compressed to fit within the lid opening 34C and form a seal. Alternatively, the lid opening seal 46C may include an o-ring gasket as in the embodiments of FIGS. 1-5, 14-21B, and 22-31, a resilient inverse dome seal as in the embodiment of FIGS. 6-9, or other suitable lid opening seal.

The seal between the lid opening seal 46C and the lid opening 34C may be sufficiently tight to prevent unintentional leakage of fluids or other contents from the container 10C when the lid opening 34C is closed by the closure 22C, without being so tight as to retain by itself the closure 22C in the closed closure position under a relatively modest opening force. Instead, the latch 42C may cooperate with the latch stop 44C to retain the closure 22C in the closed closure position when the push button 24C is in the first push button position.

Figure 14:
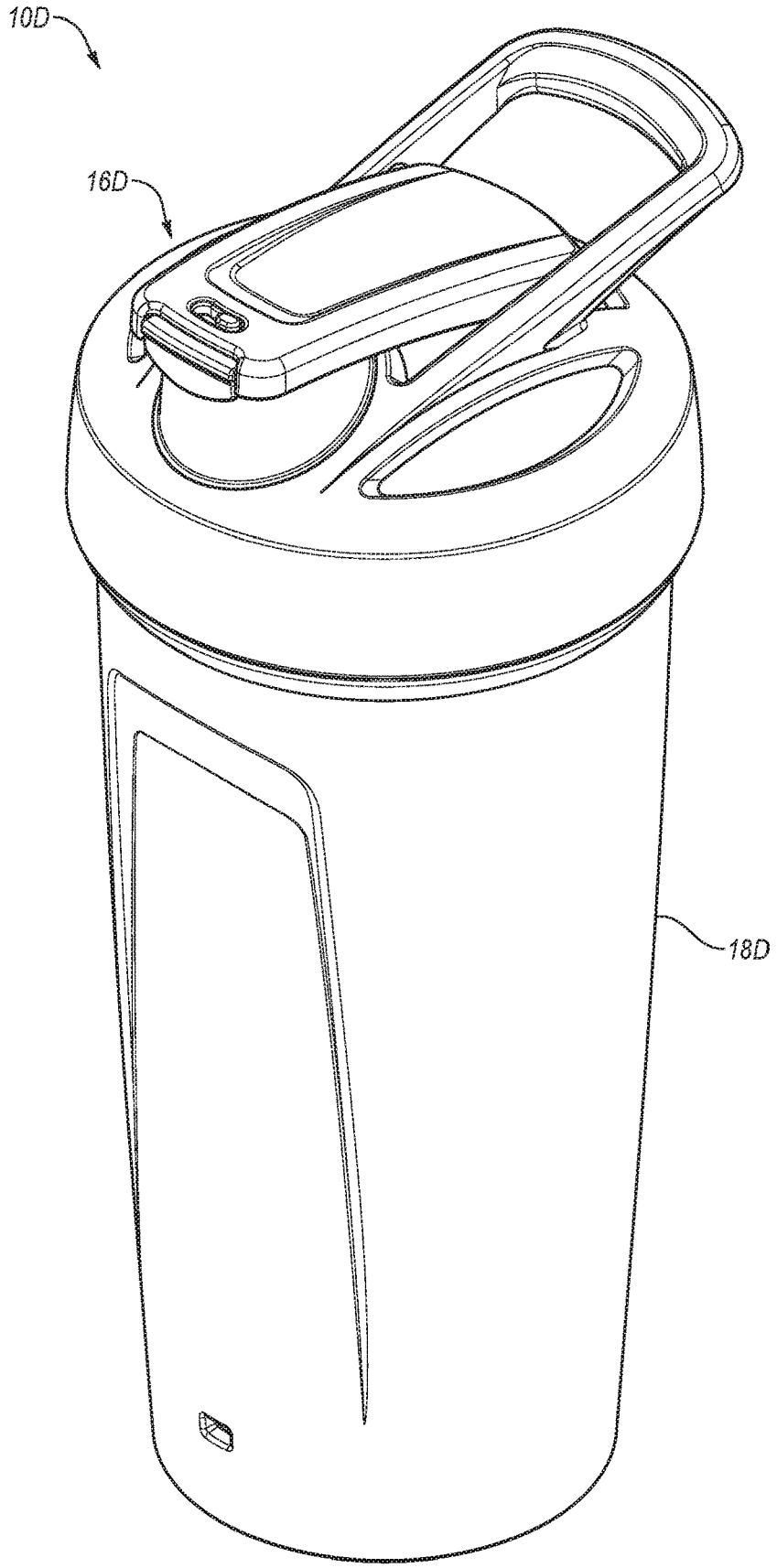
FIG. 14 is an upper perspective view of another example container.

FIG. 14 is an upper perspective view of another example container 10D, arranged in accordance with at least one embodiment described herein. As shown in FIG. 14, the container 10D may include a container body 18D and a container lid 16D. The container body 18D may be sized and shaped to hold, retain and/or store one or more liquids and/or solids, generally referred to herein as contents.

The container lid 16D may cooperate with the container body 18D to secure contents such as liquids within the container body 18D. The container lid 16D may be removed entirely from the container body 18D to expose a top opening (not visible in FIG. 14) of the container body 18D through which an interior of the container body 18D may be accessed, e.g., to add contents to the container 10D, to remove contents from the container 10D, to wash an interior of the container body 18D, or to otherwise access the interior of the container body 18D.

The container lid 16D may define a lid opening (see, e.g., FIG. 16) that may be relatively small, e.g., smaller than the top opening of the container body 18D, and through which the interior of the container body 18D may be accessed. For instance, a user may consume the contents of the container 10D through the lid opening of the container lid 16D, dispense a powdered drink mix into the container 10D through the lid opening, or otherwise access the interior of the container body 18D through the lid opening of the container lid 16D.

The container lid 16D may be selectively connected to the container body 18D. For example, the container lid 16D may be selectively connected to the container body 18D by threading, snapping, twisting, sliding, or screwing the container lid 16D to the container. For example, an upper portion of the container body 18D may include one or more exterior or interior threads and a lower portion of the container lid 16D may include one or more corresponding threads. The threads may mate to allow the container lid 16D to be selectively connected to the container body 18D. The threaded connection of the container lid 16D to the container body 18D may create a secure, airtight, watertight and/or leak-proof seal. The threaded connection may require multiple turns or a single turn or less to securely connect the container body 18D and the container lid 16D. More generally, the container body 18D and the container lid 16D may be connected by any suitable number of turns. The container body 18D and the container lid 16D may also be connected using other suitable types of connections and structures depending, for example, upon the intended use of the container.

Figure 15A:
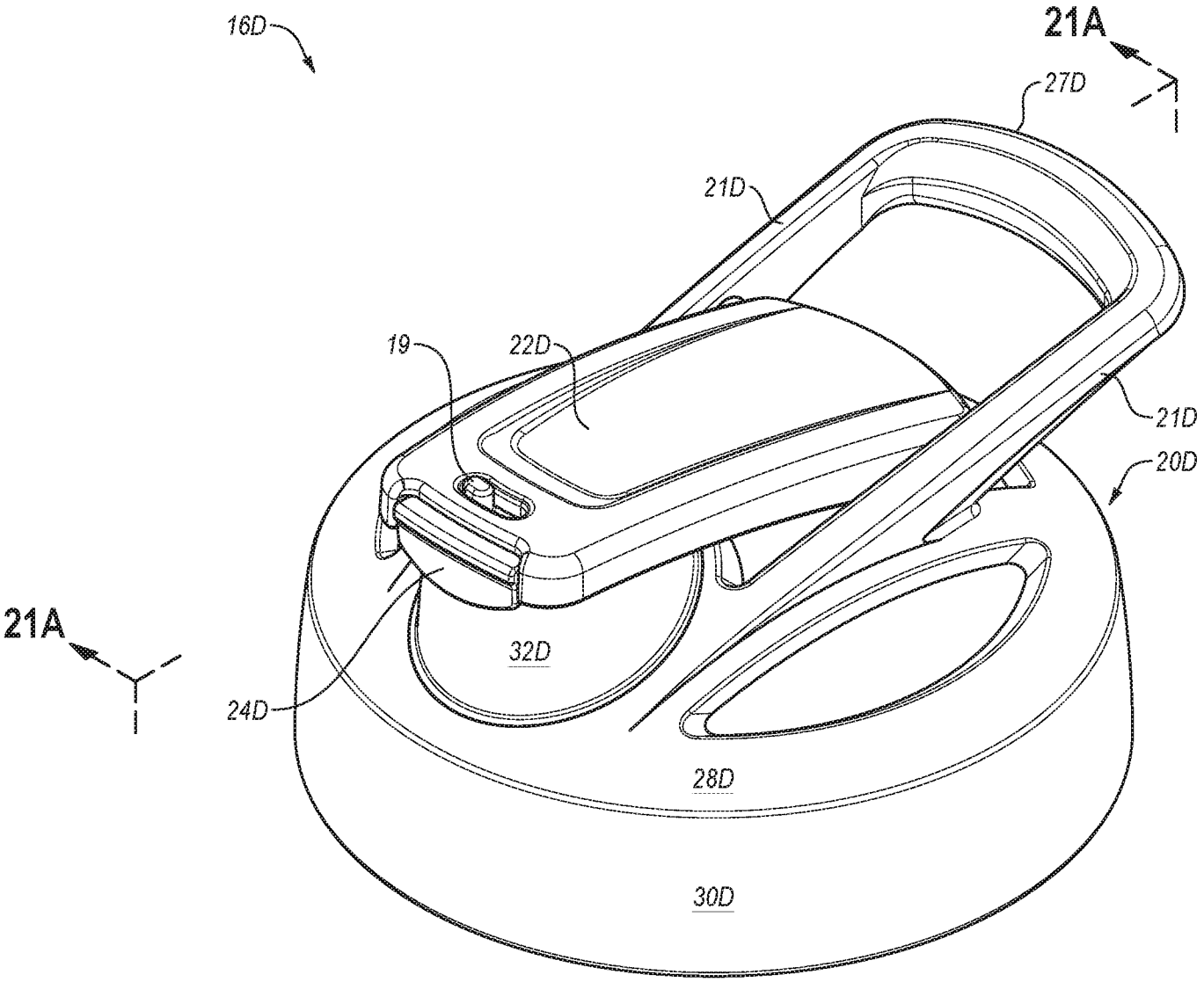
FIGS. 15A and 15B are upper perspective views of a container lid of FIG. 14.
Figure 15B:
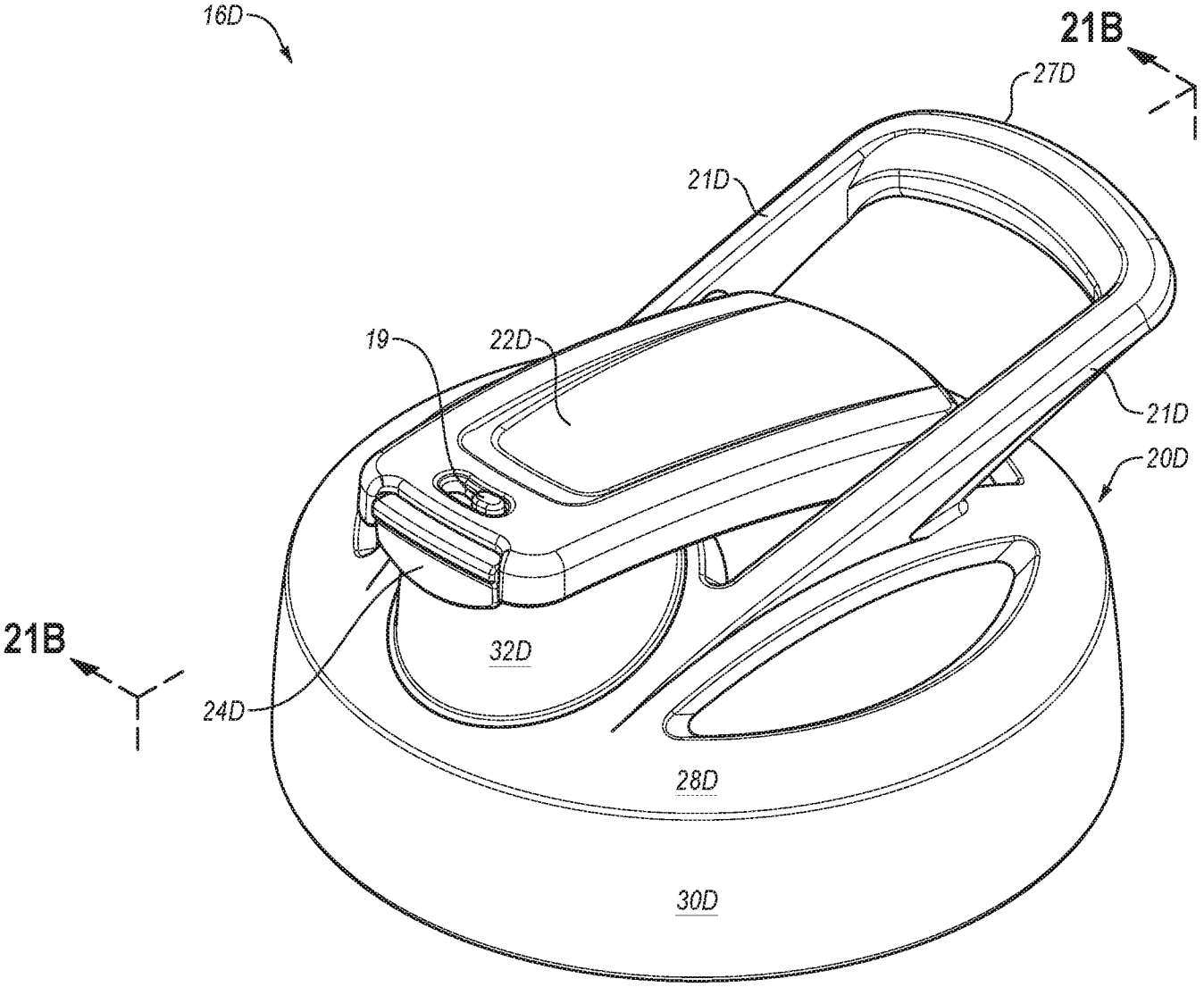
Figure 16:
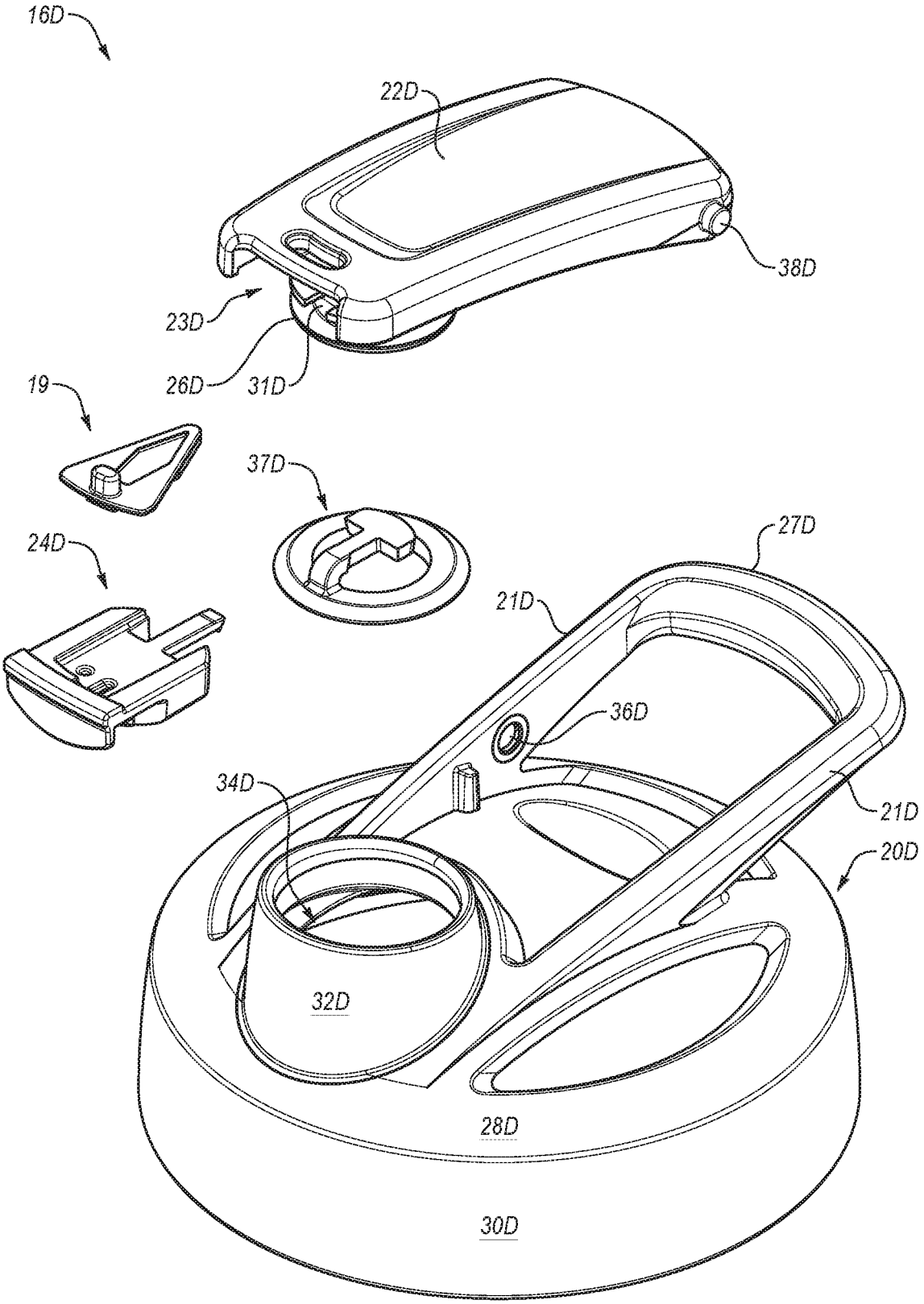
FIG. 16 is an exploded upper perspective view of the container lid of FIGS. 14, 15A, and 15B.

FIGS. 15A and 15B are upper perspective views of the container lid 16D, arranged in accordance with at least one embodiment described herein. FIG. 16 is an exploded upper perspective view of the container lid 16D, arranged in accordance with at least one embodiment described herein. As illustrated in FIGS. 15A-16, the container lid 16D may include a container top 20D, a closure 22D, a push button 24D, and a plug 26D (see, e.g., FIGS. 21A and 21B). Alternatively or additionally, the container lid 16D may include a lock 19 to selectively lock the push button 24D in a particular position, such as in a first push button position described below. FIG. 15A illustrates the lock 19 in a locked position and FIG. 15B illustrates the lock 19 in an unlocked position.

The container top 20D may include an end wall 28D, a skirt 30D, a spout 32D and a carry loop 27D. The skirt 30D may generally extend downward from the end wall 28D and may be configured to matingly engage a top of the container body 18D. In this and other embodiments, the skirt 30D may include on an interior or exterior surface thereof one or more container engagement members to selectively secure the container top 20D to the container body 18D. For instance, the skirt 30D may include interior threads (as in FIG. 21A), exterior threads, a bayonet-style mount, or other container engagement members configured to matingly engage with one or more corresponding threads, bayonet-style mounts, or other lid engagement members formed on an upper exterior or interior surface of the container body 18D to secure the container top 20D to the container body 18D.

The spout 32D may extend upward from the end wall 28D. One or more lid openings 34D may pass through the spout 32D. In some embodiments, the spout 32D may define one or more lid openings. A single generally circular lid opening 34D is depicted in FIG. 16 as an example; in other embodiments, the spout 32D may define two or more openings of any suitable size and/or shape. When the container lid 16D is coupled to the container body 18D and the closure 22D is moved to an open closure position, a user may consume or otherwise remove contents from the container 10D through the lid opening 34D. Alternatively or additionally, the user may add contents to the container 10D through the lid opening 34D.

The closure 22D may be pivotally coupled to the container top 20D and may be configured to selectively cover the lid opening 34D. For instance, the closure 22D may be rotatable between the open closure position in which the lid opening 34D is open and a closed closure position (as illustrated in FIGS. 15A and 15B) in which the lid opening 34D is closed.

The closure 22D may be pivotally coupled to the container top 20D through carry loop arms 21D of the carry loop 27D, which may define a rotational axis of the closure 22D. The carry loop arms 21D can comprise one or more pivot posts similar to pivot posts 33A, 33B, 33C disclosed herein. In some embodiments, the rotational axis of the closure 22D may be defined by one or more pivot posts, such as disclosed herein for example, while omitting the carry loop 27D. In the illustrated embodiment, each of the carry loop arms 21D defines an opening 36D (only one is visible in FIG. 16) configured to receive a protrusion 38D (only one is visible in FIG. 16) that is retained in the corresponding opening 36D during operation and permits the closure 22D to rotate relative to the container top 20D.

The push button 24D may be slidably coupled to the closure 22D and may be configured to selectively engage the spout 32D or other portion of the container top 20D to selectively retain the closure 22D in the closed closure position. A resilient member 37D may be configured to urge the push button 24D toward the first push button position in which the push button 24D can engage the container top 20D, e.g., at the spout 32D, and to resiliently deform in response to movement of the push button 24D to a second push button position in which the push button 24D is disengaged from the container top 20D. The resilient member 37D may thereby forward bias the push button 24D, e.g., the push button 24D may be urged forward by the resilient member 37D. In other embodiments, the push button 24D may be rearward biased by the resilient member 37D.

As illustrated in FIG. 16, the closure 22D may have a push button recess 23D. With combined reference to FIGS. 15A-16, the push button 24D may be disposed substantially within the push button recess 23D and may be substantially enclosed by the closure 22D. For instance, a majority of the push button 24D, e.g., by length, width, height, surface area and/or volume, may be covered by and/or enclosed within the closure 22D, for example, as illustrated in FIGS. 15A, 15B, 21A, and 21B.

Figure 17A:
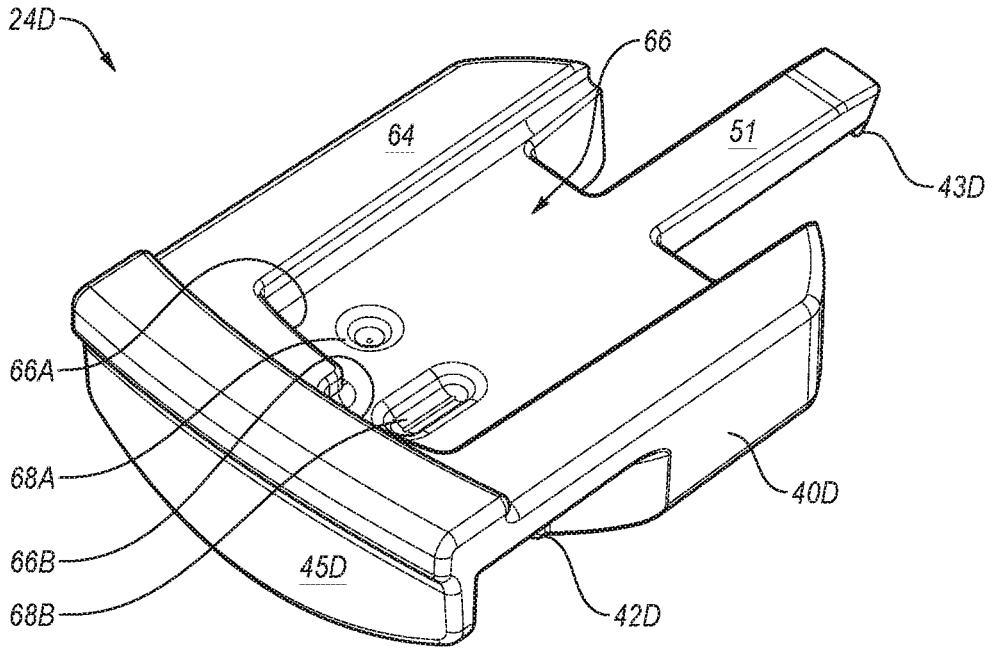
FIGS. 17A and 17B respectively include a front upper perspective view and a front lower perspective view of a push button of FIGS. 15A-16.
Figure 17B:
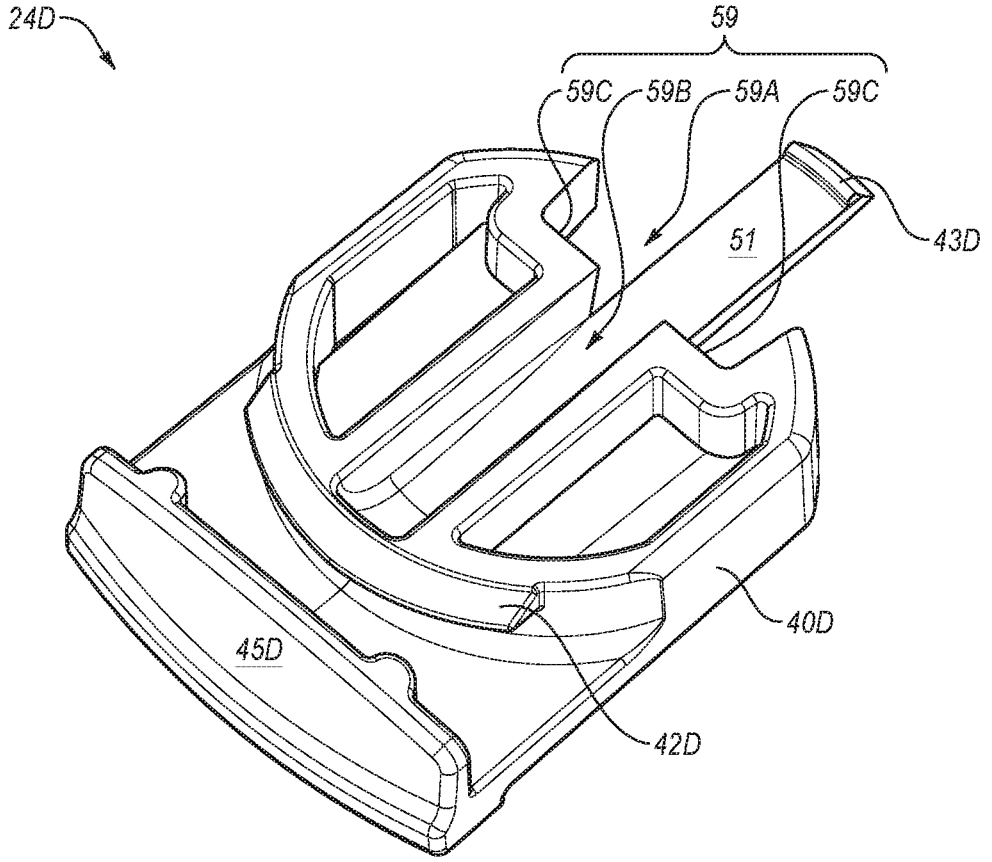
Figure 18A:
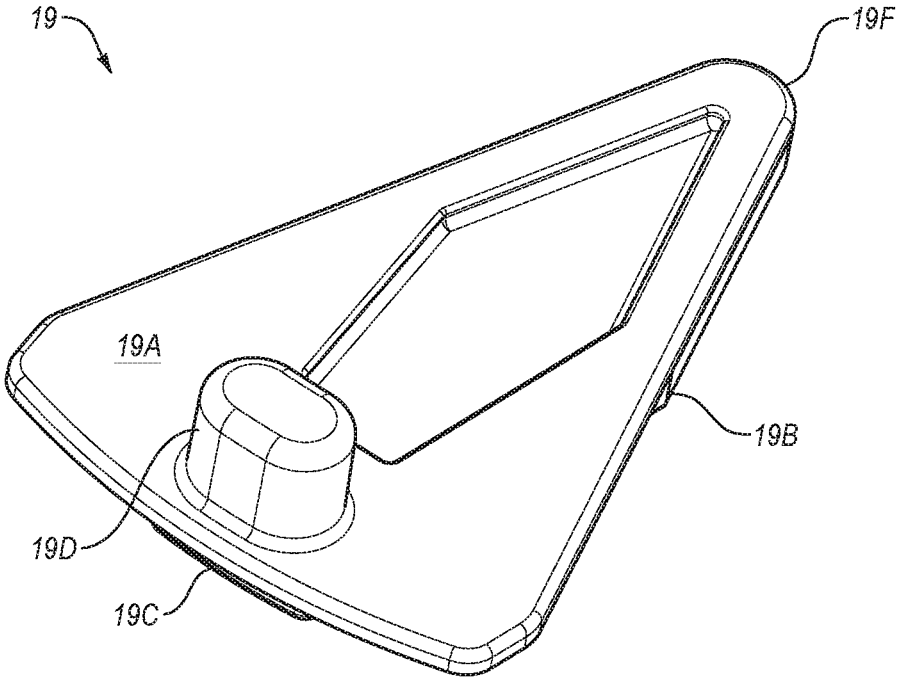
FIGS. 18A and 18B respectively include a front upper perspective view and a front lower perspective view of a lock of FIGS. 15A-16.
Figure 18B:
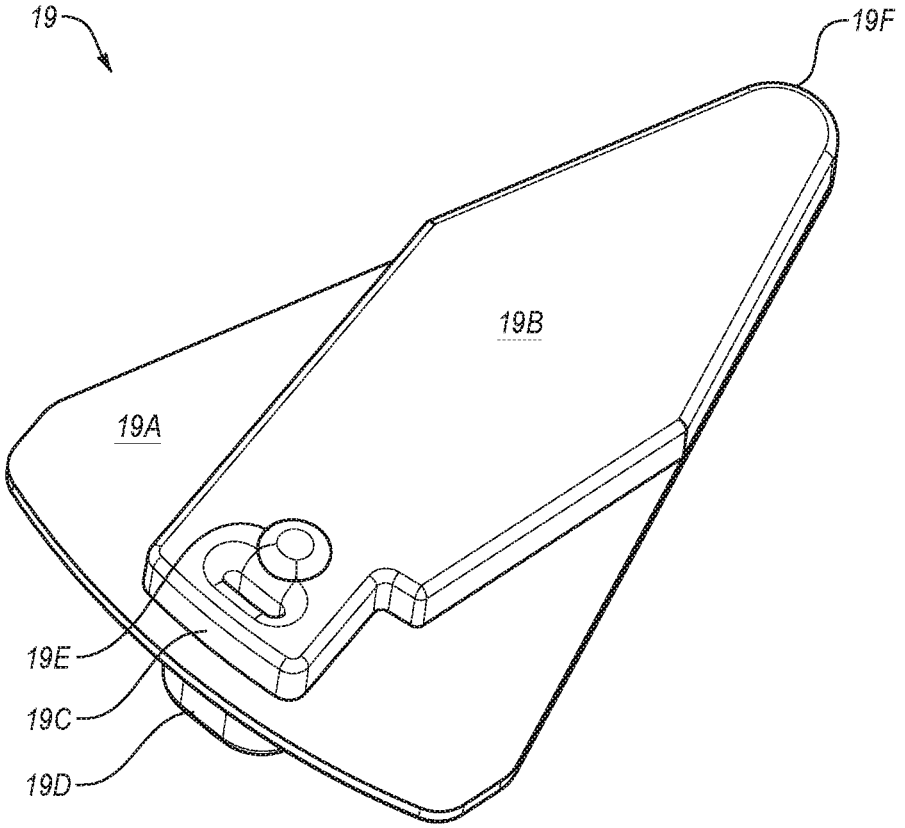
Figure 19:
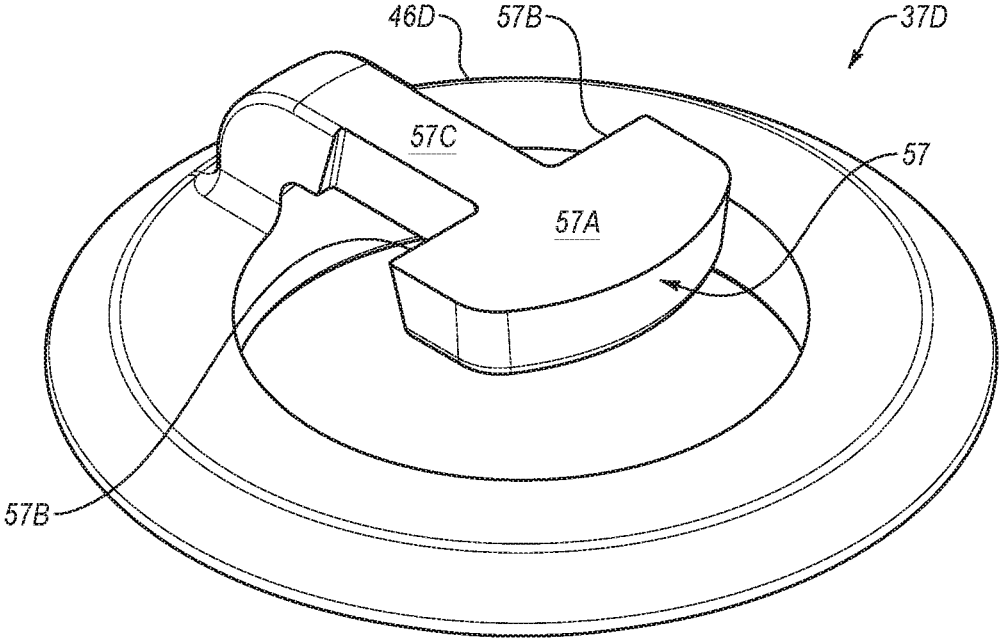
FIG. 19 is an upper perspective view of a bias member of FIGS. 15A-16.
Figure 20:
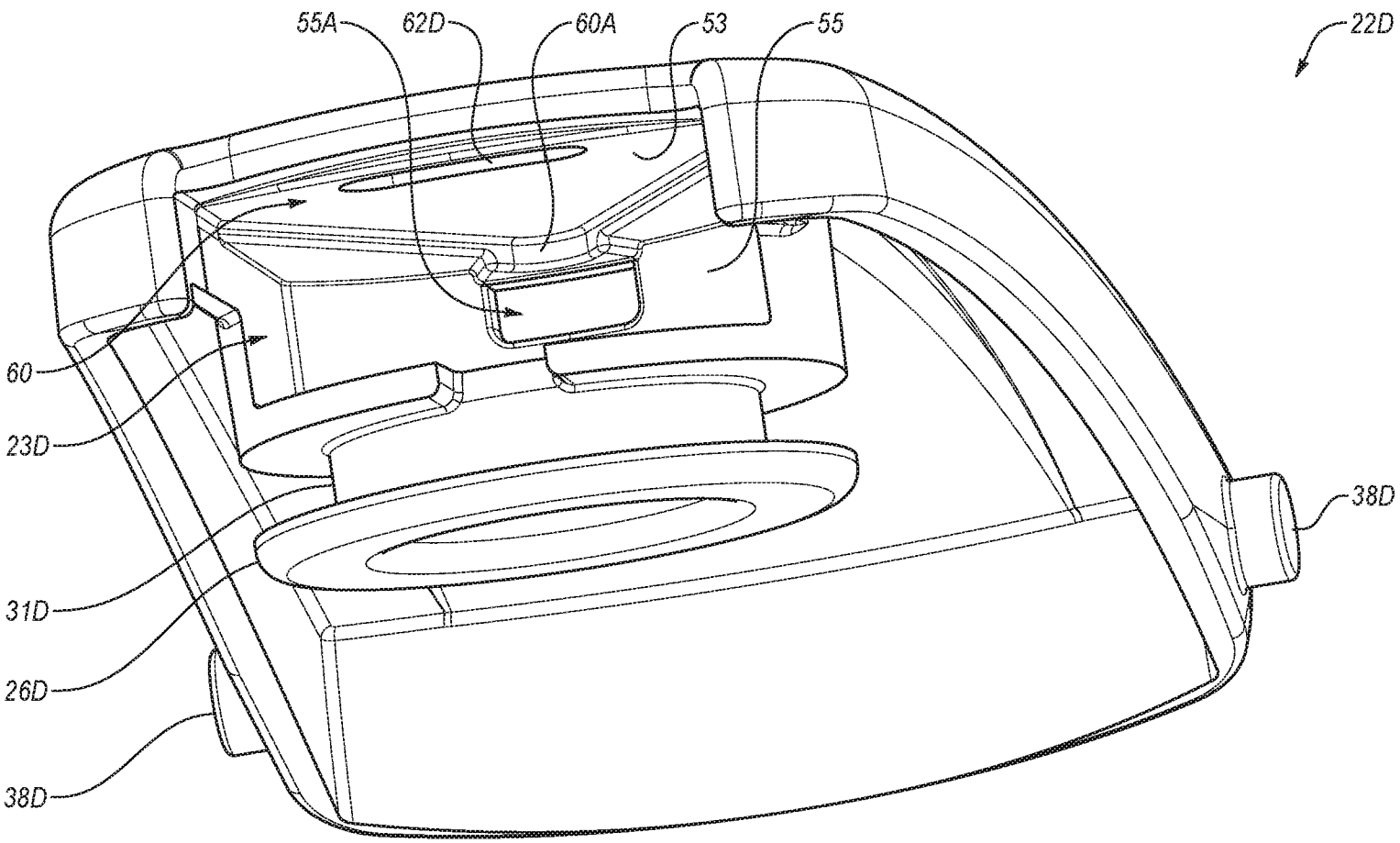
FIG. 20 is a front lower perspective view of a closure of FIGS. 15A-16.
Figure 21A:
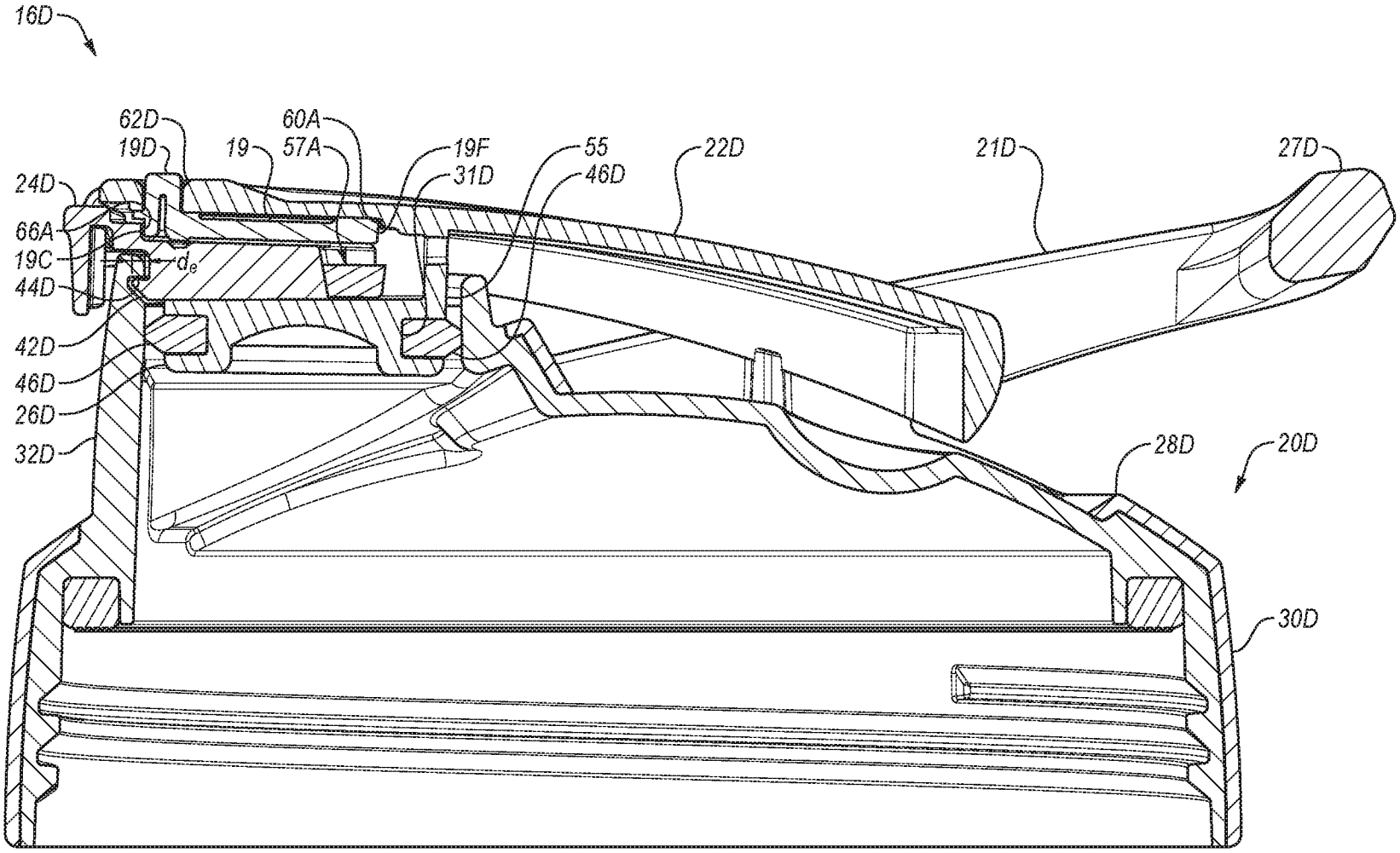
FIG. 21A is a cross-sectional view of the container lid of FIGS. 15A-16 with the lock in a locked position.
Figure 21B:
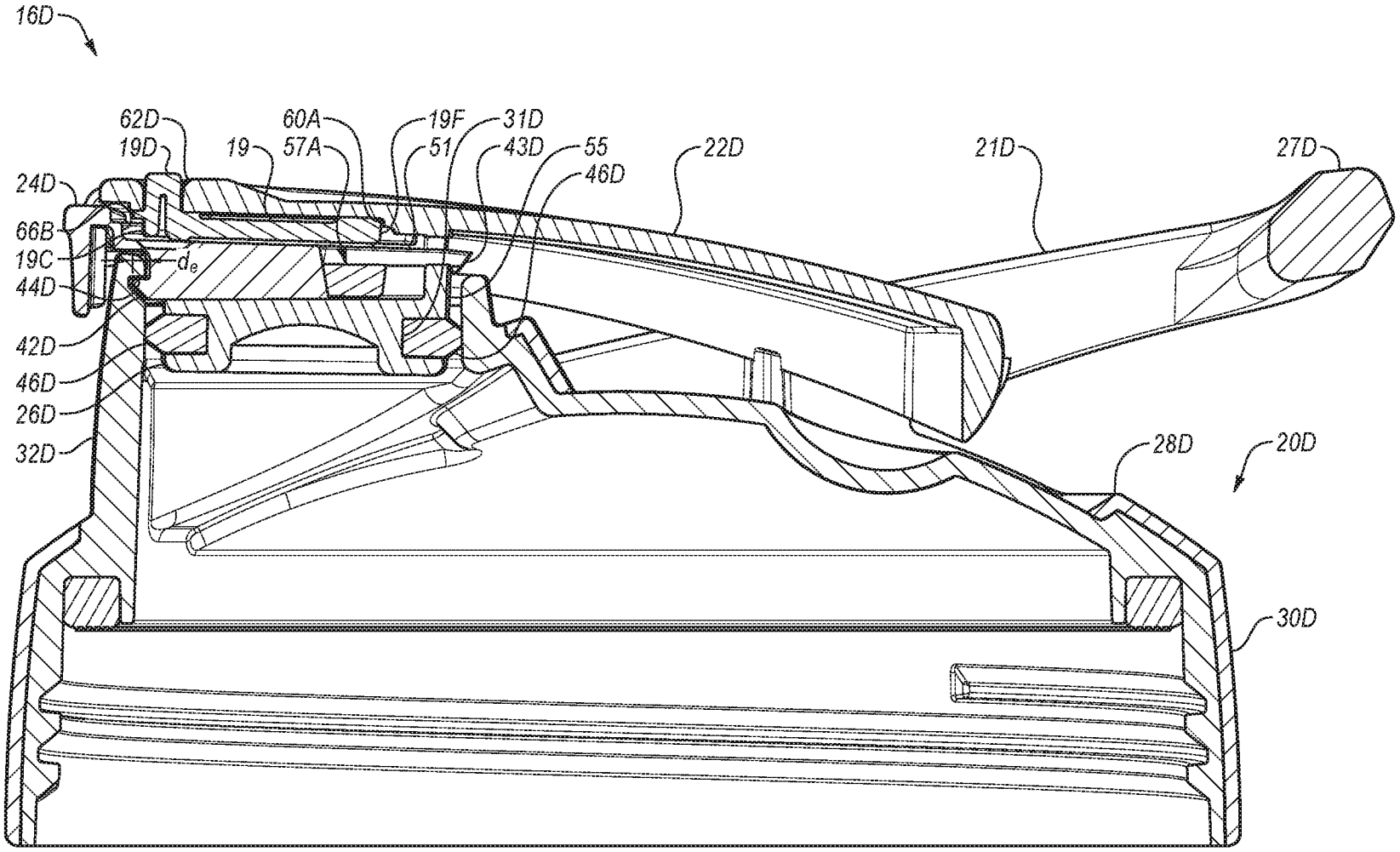
FIG. 21B is a cross-sectional view of the container lid of FIGS. 15A-16 with the lock in an unlocked position.

FIGS. 17A and 17B respectively include a front upper perspective view and a front lower perspective view of the push button 24D of FIGS. 15A-16, arranged in accordance with at least one embodiment described herein. FIGS. 18A and 18B respectively include a front upper perspective view and a front lower perspective view of the lock 19 of FIGS. 15A-16, arranged in accordance with at least one embodiment described herein. FIG. 19 is an upper perspective view of the resilient member 37D of FIGS. 15A-16, arranged in accordance with at least one embodiment described herein. FIG. 20 is a front perspective view of the closure 22D of FIGS. 15A-16, arranged in accordance with at least one embodiment described herein. FIG. 21A is a cross-sectional view, taken along cutting plane 21A-21A in FIG. 15A, of the container lid 16D of FIGS. 15A-16 with the lock 19 in the locked position, arranged in accordance with at least one embodiment described herein. The cutting plane 21A-21A is aligned to pass approximately through a middle of a lock switch 19D of the lock 19 with the lock 19 in the locked position. FIG. 21B is a cross-sectional view, taken along cutting plane 21B-21B in FIG. 15B, of the container lid 16D of FIGS. 15A-16 with the lock 19 in the unlocked position, arranged in accordance with at least one embodiment described herein. The cutting plane 21B-21B is aligned to pass approximately through the middle of the lock switch 19D with the lock 19 in the unlocked position.

With combined reference to FIGS. 14-21B, the push button 24D may include a body 40D, an arm 51 that extends rearward from the body 40D, one or more latches 42D, and/or one or more retention tabs 43D. The push button 24D may include a single latch 42D and a single retention tab 43D as illustrated, with the retention tab 43D included at a rearward end of one arm 51. Alternatively, the push button 24D may include two or more latches 42D, two or more arms 51, or two or more retention tabs 43D. The retention tab 43D may be configured to retain the push button 24D within the push button recess 23D of the closure 22D. Other retention tabs described herein may be implemented instead of or in addition to the retention tab 43D.

The push button recess 23D of the closure 22D can have a push button recess upper wall 53 and a push button recess rear wall 55. The push button recess upper wall 53 and the push button recess rear wall 55 may together at least partially define the push button recess 23D. At least one hole 55A is formed in the push button recess rear wall 55 that is large enough to accommodate passage of the retention tab 43D through the hole 55A. A number of the holes 55A may equal a number of the retention tabs 43D in some embodiments. In other embodiments, a single hole 55A may accommodate two or more retention tabs 43D.

The arm 51 of the push button 24D may extend through the hole 55A with the retention tab 43D located rearward of a rear surface of the push button recess rear wall 55 when the push button 24D is assembled together with the closure 22D, as illustrated in FIG. 21B. The rear surface of the push button recess rear wall 55 may include or function as a tab stop for the retention tab 43D. Accordingly, the retention tab 43D may be configured to engage the rear surface of the push button recess rear wall 55 to inhibit forward movement of the retention tab 43D past the rear surface of the push button recess rear wall 55. Thus, after insertion of the push button 24D into the push button recess 23D to the point that the retention tab 43D of the push button 24D is behind the rear surface of the push button recess rear wall 55 as illustrated in FIG. 21B, the push button 24D may be able to slide rearward and forward relative to the closure 22D within a defined range determined by the retention tab 43D and the rear surface of the push button recess rear wall 55 in the forward direction and one or more other features, such as a back end of the body 40D of the push button 24D and a front surface of the push button recess rear wall 55, in the rearward direction.

The arm 51 may extend rearward from the body 40D in a forward-biased implementation of the push button 24D as illustrated, forward from the body 40D in a rearward-biased implementation, laterally from the body 40D in a laterally-biased implementation, or some combination of forward and laterally or rearward and laterally in a corresponding implementation.

In some embodiments, the retention tab 43D may be selectively disengageable from the rear surface of the push button recess rear wall 55 to permit disassembly and reassembly of the push button 24D and the closure 22D. In other embodiments, the retention tab 43D may not be disengageable from the rear surface of the push button recess rear wall 55 without plastic deformation or detachment of the retention tab 43D or other components or portions thereof. The arm 51 may include a resilient material and the retention tab 43D may be biased by the arm 51 to engage the rear surface of the push button recess rear wall 55. Accordingly, and in response to application of a removal force to the retention tab 43D in a direction toward a top of the closure 22D, the arm 51 may be configured to resiliently deform to permit alignment of the retention tab 43D with the hole 55A to permit removal of the push button 24D from the push button recess 23D. In particular, with the arm 51 resiliently deformed to accommodate alignment of the retention tab 43D with the hole 55A, the retention tab 43D may be pushed forward and at least into the hole 55A, to then pull forward on the push button 24D until the retention tab 43D clears the push button recess rear wall 55 and the push button 24D may then be completely removed from the push button recess 23D.

The latch 42D may be configured to selectively engage the container top 20D, e.g., at the spout 32D. For instance, the spout 32D may include one or more latch stops 44D (FIGS. 21A and 21B) configured to overhang the latch 42D when the closure 22D is in the closed closure position (as illustrated in FIGS. 21A and 21B) and the push button 24D is in the first push button position (as illustrated in FIGS. 21A and 21B). The latch stop 44D may include a lip formed in the spout 32D, a shoulder formed in the spout 32D, an upper surface of a latch recess formed in the spout 32D, or other suitable latch stop 44D. Moreover, the latch stop 44D may be formed on an interior of the spout 32D, for example as illustrated in FIGS. 21A and 21B, or on an exterior of the spout 32D (not illustrated in FIGS. 21A and 21B) provided the push button 24D is implemented accordingly.

As illustrated in FIGS. 21A and 21B, when the push button 24D is in the first push button position and the closure 22D is in the closed closure position, the latch 42D may extend beneath the latch stop 44D by an engagement distance $d_e$ measured from a rear edge of the latch stop 44D to a front end of the latch 42D. The latch 42D may be disengaged from the latch stop 44D to allow movement of the closure 22D to the open closure position by, e.g., a user pushing the push button 24D rearward through the engagement distance $d_e$ until the front end of the latch 42D clears the rear edge of the latch stop 44D, which may constitute the second push button position. With the push button 24D in the second push button position, there is little or no engagement between the latch 42D and the spout 32D. As such, the closure 22D (and the push button 24D) may be rotated clockwise relative to the container lid 20D in the orientation of FIGS. 21A and 21B to the open closure position in which the lid opening 34D is open.

The resilient member 37D may be configured to urge the push button 24D toward the first push button position (illustrated in FIG. 21A) in which the push button 24D engages the spout 32D. The resilient member 37D may also be configured to resiliently deform in response to movement of the push button 24D to the second push button position in which the push button disengages the spout 32D.

As illustrated in FIG. 19, the resilient member 37D may include a bias member 57 and a lid opening seal 46D. The bias member 57 and the lid opening seal 46D may be integrally formed as a single and/or monolithic component as illustrated, or may be formed as discrete components that are subsequently coupled together after formation.

In some embodiments, the resilient member 37D may comprise a tongue joining the lid opening seal 46D and the bias member 57. Alternatively or additionally, the bias member 57 may comprise the tongue. The tongue may urge the push button 24D toward the first push button position and may resiliently deform in response to movement of the push button to the second push button position.

Referring to FIGS. 16 and 20-21B, the plug 26D may define a seal seat 31D generally configured to receive therein at least a portion of the lid opening seal 46D. For instance, the seal seat 31D may include an annular channel formed around the plug 26D, the seal seat 31D or annular channel having a diameter that is about the same as an internal diameter of the lid opening seal 46D. In some embodiments, the diameter of the seal seat 31D may be slightly smaller than the diameter of the lid opening seal 46D, the lid opening seal 46D being formed of a resilient and/or stretchy material such that the lid opening seal 46D may be stretched when installed in the seal seat 31D to fit snugly around the seal seat 31D. In other embodiments, the lid opening seal 46D may be relaxed and not stretched when installed in the seal seat 31D.

Referring to FIGS. 19, 21A, and 21B, the bias member 57 may extend rearward from a front of the lid opening seal 46D in a forward biased implementation. Alternatively or additionally, the bias member 57 may extend upward from the lid opening seal 46D. As previously indicated, the bias member 57 may comprise a tongue, comprising one or more of a tongue end 57A and a tongue neck 57C. The tongue end 57A may include forward facing surfaces 57B in a forward biased implementation and may be coupled to the lid opening seal 46D via the tongue neck 57C that is narrower than the tongue end 57A.

Referring to FIGS. 17A and 17B, the push button 24D may comprise a tongue channel 59 that may have a complementary shape to the bias member 57 of the resilient member 37D. The tongue channel 59 may be located at an underside of the push button 24D. The tongue channel 59 may include a tongue end cavity 59A and a tongue neck cavity 59B. In the illustrated embodiment, the tongue end cavity 59A may be sized and configured to receive therein the tongue end 57A of the bias member 57 while the tongue neck cavity 59B may be sized and configured to receive therein the tongue neck 57C. The tongue channel 59 may additionally include rearward facing surfaces 59C in a forward biased implementation. When the bias member 57 of the resilient member 37D is positioned within the tongue channel 59 of the push button 24D, the forward facing surfaces 57B of the tongue end 57A may be positioned adjacent to and/or in direct contact with the rearward facing surfaces 59C of the tongue channel 59 defined by the push button 24D.

As illustrated in FIGS. 21A and 21B, when the container lid 16D is assembled, the lid opening seal 46D of the resilient member 37D may be seated within the seal seat 31D of the plug 26D, with the bias member 57 extending rearward, and optionally upward, from the front of the lid opening seal 46D and into the tongue channel 59 of the push button 24D. With the push button 24D in the first push button position, the rearward facing surfaces 59C of the tongue channel 59 of the push button 24D may be in direct contact with the forward facing surfaces 57B of the tongue end 57. In some embodiments, with the push button 24D in the first push button position, the bias member 57, or at least the tongue neck 57C, may be at least partially stretched rearward to continually bias the push button 24D forward toward the first push button position.

Application of sufficient rearward force to the push button 24D, e.g., to a push region 45D, may overcome the continual forward bias provided by the bias member 57 and cause the push button 24D to move rearward toward the second push button position. Rearward movement of the push button 24D toward the second push button position may result in stretching of the bias member 57, or at least of the tongue neck 57C, as the push button 24D, with its rearward facing surfaces 59C of the tongue channel 59 urging against the forward facing surfaces 57B of the bias member 57, causes the tongue end 57A to move rearward. A front of the tongue neck 57C is coupled to the front of the lid opening seal 46D which in turn is seated in the seal seat 31D of the plug 26D such that the tongue neck 57C stretches along its length as rearward movement of the push button 24D causes reward movement of the tongue end 57A.

When the rearward force is removed from the push button 24D, the stretched tongue neck 57C of the bias member 57 may at least partially recompress, urging the push button 24D back to the first push button position as the forward facing surfaces 57B of the bias member 57 urge forward against the rearward facing surfaces 59C in the tongue channel 59 of the push button 24D. In this and other embodiments, the container lid 16D may have a reduced part count and cost compared to some container lids that have both a bias member and a lid opening seal as discrete components.

The lock 19 may be movable relative to one or both of the push button 24D and the closure 22D. The lock 19 may be movably coupled to one, both, or neither of the push button 24D and the closure 22D. In general, the lock 19 may be movable between the locked position (FIG. 21A) and the unlocked position (FIG. 21B). In the locked position, the lock 19 may be positioned to inhibit or to prevent the push button 24D from moving from the first push button position to the second push button position. In the unlocked position, the lock may be positioned to accommodate or to permit movement of the push button 24D between the first push button position and the second push button position.

In some embodiments, the lock 19 may be at least partially positioned between the push button 24D and the closure 22D. The lock 19 may be positioned at least partially within a cavity and/or recess formed in one or both of the push button 24D and the closure 22D. For example, the closure 22D may define a lock recess 60 (FIG. 20) in a bottom surface of the closure 22D, such as, for example, in a bottom surface of the push button recess upper wall 53. The lock recess 60 illustrated in FIG. 20 has a rearward end that forms a fulcrum 60A for movement of the lock 19. In addition or alternative to inclusion of the lock recess 60, the closure 22D may comprise a lock switch channel or recess 62D to provide access through the closure 22D for a user to move the lock 19 between the locked and unlocked positions.

Referring to FIG. 17A, the push button 24D includes an upper surface 64 and defines a lock cavity 66 in the upper surface 64. The lock cavity 66 includes a first stop 66A in a first portion of the lock cavity 66 and a second stop 66B in a second portion of the lock cavity 66. The second stop 66B is located forward of the first stop 66A. In addition, a bottom surface of the lock cavity 66 may include a first receptacle 68A rearward of the first stop 66A and a second receptacle 68B rearward of the second stop 66B. The second receptacle 68B can have a shape that is elongate in a forward-rearward direction. The receptacles 68A, 68B can comprise dimples, depressions, openings, passages, recesses, or a combination thereof, for example.

Referring to FIGS. 18A and 18B, the lock 19 may include an abutment 19C. The abutment 19C can comprise one or more surfaces arranged for contact with the first stop 66A when the push button 24D is advanced toward the second push button position while the lock 19 is in the locked position. For example, the abutment can comprise one or more forwardly facing surfaces as illustrated in FIGS. 18A and 18B.

The abutment 19C may optionally extend (e.g., downwardly or upwardly) from a base 19A. The base 19A can be planar, for example as illustrated in FIGS. 18A and 18B, or can have other configurations.

The abutment 19C may form a part of a support 19B. The support 19B may extend from the base 19A, if present. The support 19B may optionally be formed as a plateau extending downward from the base 19A. The support 19B may facilitate movement and/or positioning of the lock 19 and/or support the abutment 19C during contact with the first stop 66A resisting movement of the push button 24D. The support 19B may have recesses in one or more sides, e.g., in an upper and/or a lower side.

Referring to FIGS. 17A-18B, the support 19B may be positioned within the lock cavity 66 and the base 19A, if present, may be supported on or by the upper surface 64 of the push button 24D when the lock 19 is in both the locked position and the unlocked position. For example, the base 19A may be supported by the upper surface 64 of the push button 24D along some or all of a front of the base 19A, one or both front corners of the base 19A, and one or more sides of the base 19A, whether the lock 19 is in the locked or the unlocked position.

In addition, referring to FIGS. 18A, 18B, and 20, the lock 19 may be at least partially received in the lock recess 60 in the bottom surface of the push button recess upper wall 53 of the closure 22D. For example, the base 19A and/or the support 19B may be at least partially received in the lock recess 60. A pivot 19F of the lock 19 may be at least partially received in the fulcrum 60A of the lock recess 60. The pivot 19F may be formed by the base 19A and/or the support 19B.

Referring to FIG. 21A, when the push button 24D is in the first push button position and the lock 19 is in the locked position, the abutment 19C of the lock 19 may be positioned facing the first stop 66A of the lock cavity 66 of the push button 24D and spaced apart from the first stop 66A by a distance less than the engagement distance $d_e$ and as little as zero. Positioning the abutment 19C relative to the first stop 66A in this manner while the closure 22D is in the closed closure position may prevent the closure 22D from being inadvertently opened through inadvertent rearward movement of the push button 24D. In particular, an inadvertent rearward push, or even an intentional rearward push, on the push button 24D may cause the push button 24D to travel rearward, if at all, from the first push button position only up to the point where the first stop 66A contacts the abutment 19C. Since the first stop 66A is spaced apart from the abutment 19C by the distance less than the engagement distance $d_e$ when the push button 24D is in the first push button position, the push button 24D may be unable to inadvertently travel rearward through the engagement distance $d_e$ to the point where the latch 42D clears the latch stop 44D such that the closure 22D remains in the closed closure position.

Referring to FIG. 21B, when the push button 24D is in the first push button position and the lock is in the unlocked position, the abutment 19C of the lock 19 may be positioned facing the second stop 66B of the lock cavity 66 of the push button 24D and spaced apart from the second stop 66B by a distance equal to or greater than the engagement distance $d_e$, which may permit movement of the push button 24D from the first push button position to the second push button position. In particular, with the lock 19 in the unlocked position, a rearward push on the push button 24D may cause the push button 24D to travel rearward from the first push button position through at least the engagement distance $d_e$, at which point the latch 42D clears the latch stop 44D such that the closure 22D can then be opened.

Referring again to FIGS. 18A and 18B, the lock 19 may further include the lock switch 19D and/or a protrusion 19E. The lock switch 19D can extend upward from the base 19A, support 19B, and/or abutment 19C at or near a front of the base 19A. As illustrated in FIGS. 21A and 21B, the lock switch 19D extends upward through the lock switch channel 62D formed in the push button recess upper wall 53 of the closure 22D. The switch 19D can be manipulated, e.g., by a user, to move the lock 19 between the locked and unlocked positions.

The protrusion 19E may be received in either of the first and second receptacle 68A and 68B of the lock cavity 66. The first receptacle 68A may be associated with the locked position of the lock 19 while the second receptacle 68B may be associated with the unlocked position of the lock 19. For example, the protrusion 19E may be received in the first receptacle 68A when the lock 19 is in the locked position, and the protrusion 19E may be received in the second receptacle 68B when the lock 19 is in the unlocked position. In some embodiments, an interaction of the protrusion 19E with the first and second receptacles 68A and 68B may provide tactile feedback to indicate when the lock 19 has been moved into a corresponding one of the locked and unlocked positions. Alternatively or additionally, the interaction of the protrusion 19E with the first and second receptacles 68A and 68B may inhibit inadvertent movement of the lock 19 between the locked and unlocked positions.

The carry loop 27D, including carry loop arms 21D, is illustrated in FIGS. 15A-16, 21A, and 21B as attached to or formed with the container lid 20D. The carry loop 27D and/or the carry loop arms 21D may be flexible and/or semi-flexible and/or may be movable relative to some or all of the container lid 20D.

The plug 26D may be integrally formed with the closure 22D, for example as illustrated, or may be formed as a discrete component that is coupled to the closure 22D. Alternatively or additionally, the plug 26D may be integrally formed with the lid opening seal 46D although they are illustrated as discrete components in FIGS. 14-21B.

The lid opening seal 46D may be configured to seal the lid opening 34D of the spout 32D when the closure 22D is in the closed closure position. The lid opening seal 46D may include an o-ring gasket as in the embodiment of FIGS. 1-5, 14-21B, and 22-31, a resilient oversized annular plug protrusion as in the embodiment of FIGS. 10-13, a resilient inverse dome seal as in the embodiment of FIGS. 6-9, or other suitable lid opening seal.

The seal between the lid opening seal 46D and the lid opening 34D may be sufficiently tight to prevent unintentional leakage of fluids or other contents from the container 10D when the lid opening 34D is closed by the closure 22D, without being so tight as to retain by itself the closure 22D in the closed closure position under a relatively modest opening force. Instead, the latch 42D may cooperate with the latch stop 44D to retain the closure 22D in the closed closure position when the push button 24D is in the first push button position.

Figure 22:
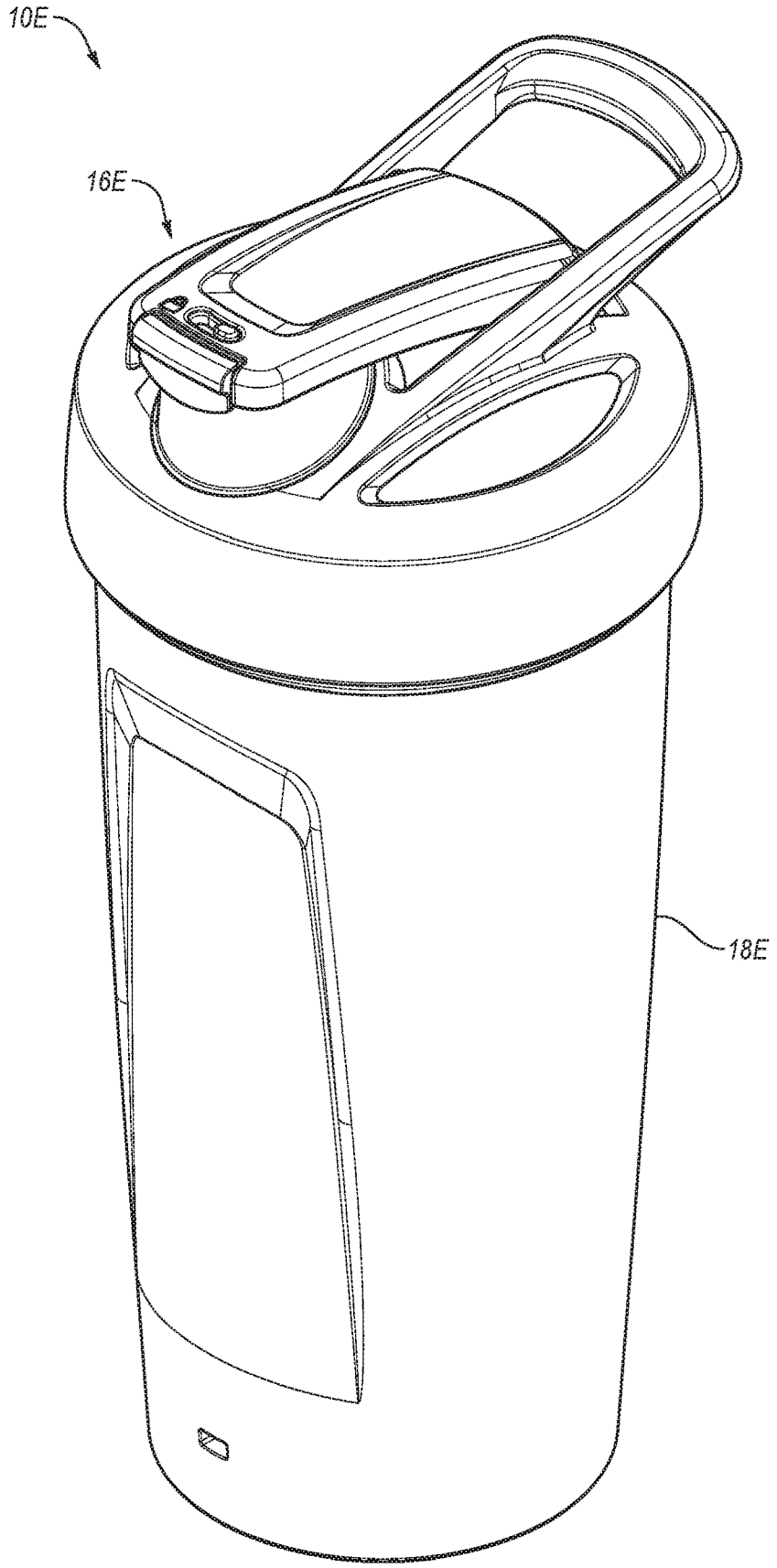
FIG. 22 is an upper perspective view of another example container.

FIG. 22 is an upper perspective view of another example container 10E, arranged in accordance with at least one embodiment described herein. As shown in FIG. 22, the container 10E may include a container body 18E and a container lid 16E. The container body 18E may be sized and shaped to hold, retain and/or store one or more liquids and/or solids, generally referred to herein as contents.

The container lid 16E may cooperate with the container body 18E to secure contents such as liquids within the container body 18E. The container lid 16E may be removed entirely from the container body 18E to expose a top opening 102 (FIG. 29A) of the container body 18E through which an interior of the container body 18E may be accessed, e.g., to add contents to the container 10E, to remove contents from the container 10E, to wash an interior of the container body 18E, or to otherwise access the interior of the container body 18E.

The container lid 16E may define a lid opening 34E (see, e.g., FIG. 24) through which the interior of the container body 18E may be accessed. For instance, a user may consume the contents of the container 10E through the lid opening 34E of the container lid 16E, dispense a powdered drink mix into the container 10E through the lid opening 34E, or otherwise access the interior of the container body 18E through the lid opening 34E of the container lid 16E. The lid opening 34E may refer to a passage through a spout 32E (see, e.g., FIG. 24), which lid opening/passage 34E may include a top aperture of the spout 32E as well as a remainder of the passage through the spout 32E. The lid opening 34A, 34B, 34C, 34D discussed elsewhere herein similarly refers to a passage that may extend through a corresponding spout 32A, 32B, 32C, 32D. The top aperture of the lid opening 34E may be relatively small, e.g., smaller than the top opening 102 of the container body and/or an end wall of the container top. A bottom aperture of the lid opening can be larger or smaller than the top aperture of the lid opening.

Figure 29A:
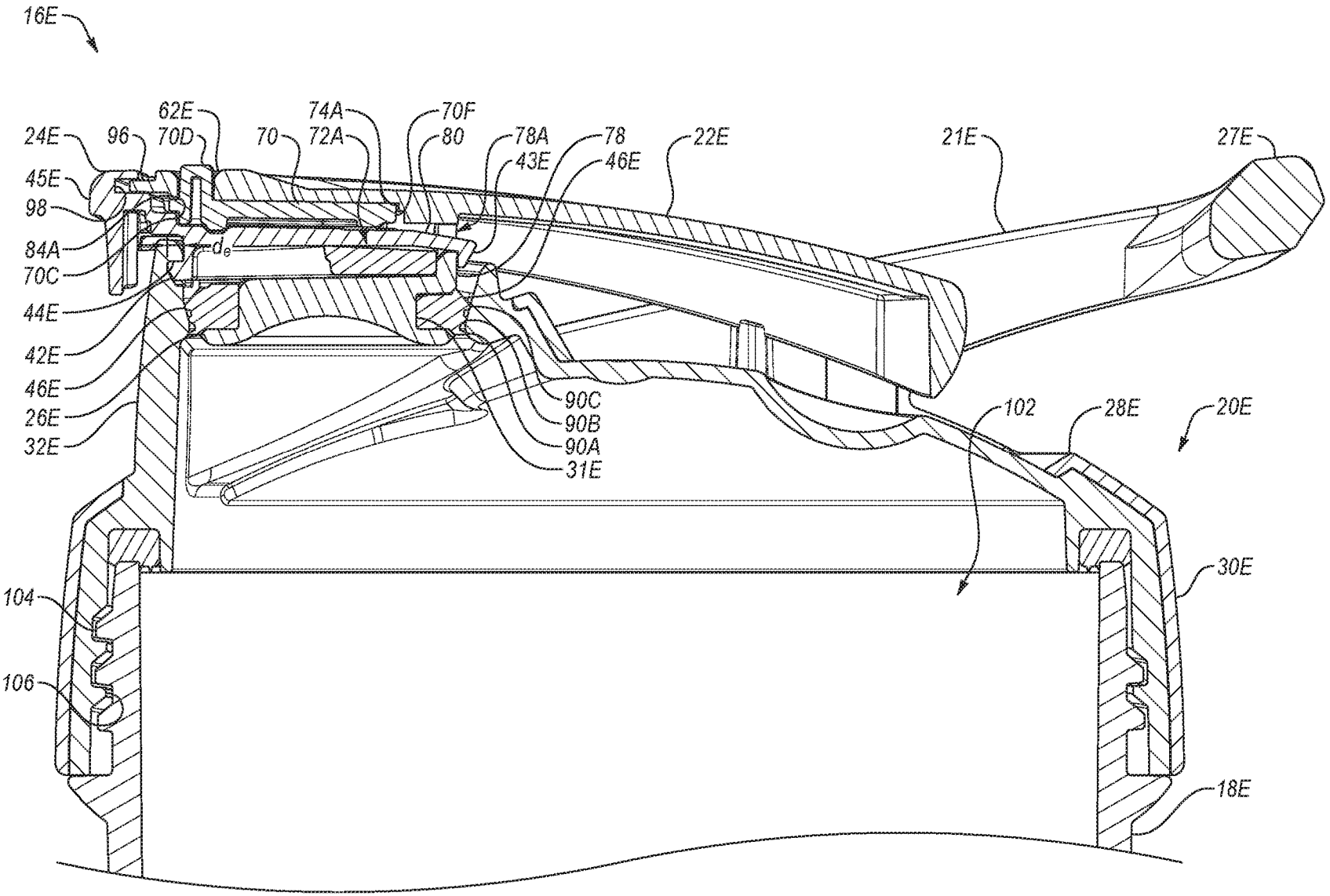
FIG. 29A is a cross-sectional view of the container lid of FIGS. 23A-24 with the lock in a locked position.

The container lid 16E may be selectively connected to the container body 18E. For example, the container lid 16E may be selectively connected to the container body 18E by threading, snapping, twisting, sliding, or screwing the container lid 16E to the container. For example, an upper portion of the container body 18E may include one or more exterior or interior threads 104 and a lower portion of the container lid 16E may include one or more corresponding threads 106. The threads 104, 106 may mate to allow the container lid 16E to be selectively connected to the container body 18E. The threaded connection (e.g., mating of threads 104, 106) of the container lid 16E to the container body 18E may create a secure, airtight, watertight and/or leak-proof seal. The threaded connection may require multiple turns or a single turn or less to securely connect the container body 18E and the container lid 16E. More generally, the container body 18E and the container lid 16E may be connected by any suitable number of turns. The container body 18E and the container lid 16E may also be connected using other suitable types of connections and structures depending, for example, upon the intended use of the container. Other embodiments described herein may be configured similar to the container 18E and container top 16E as illustrated in FIG. 29A, e.g., with a top opening 102 in the corresponding container 18A, 18B, 18C, 18D, and threads 104, 106 or other complementary connectors on the corresponding container 18A, 18B, 18C, 18D and container lid 16A, 16B, 16C, 16D.

Figure 23A:
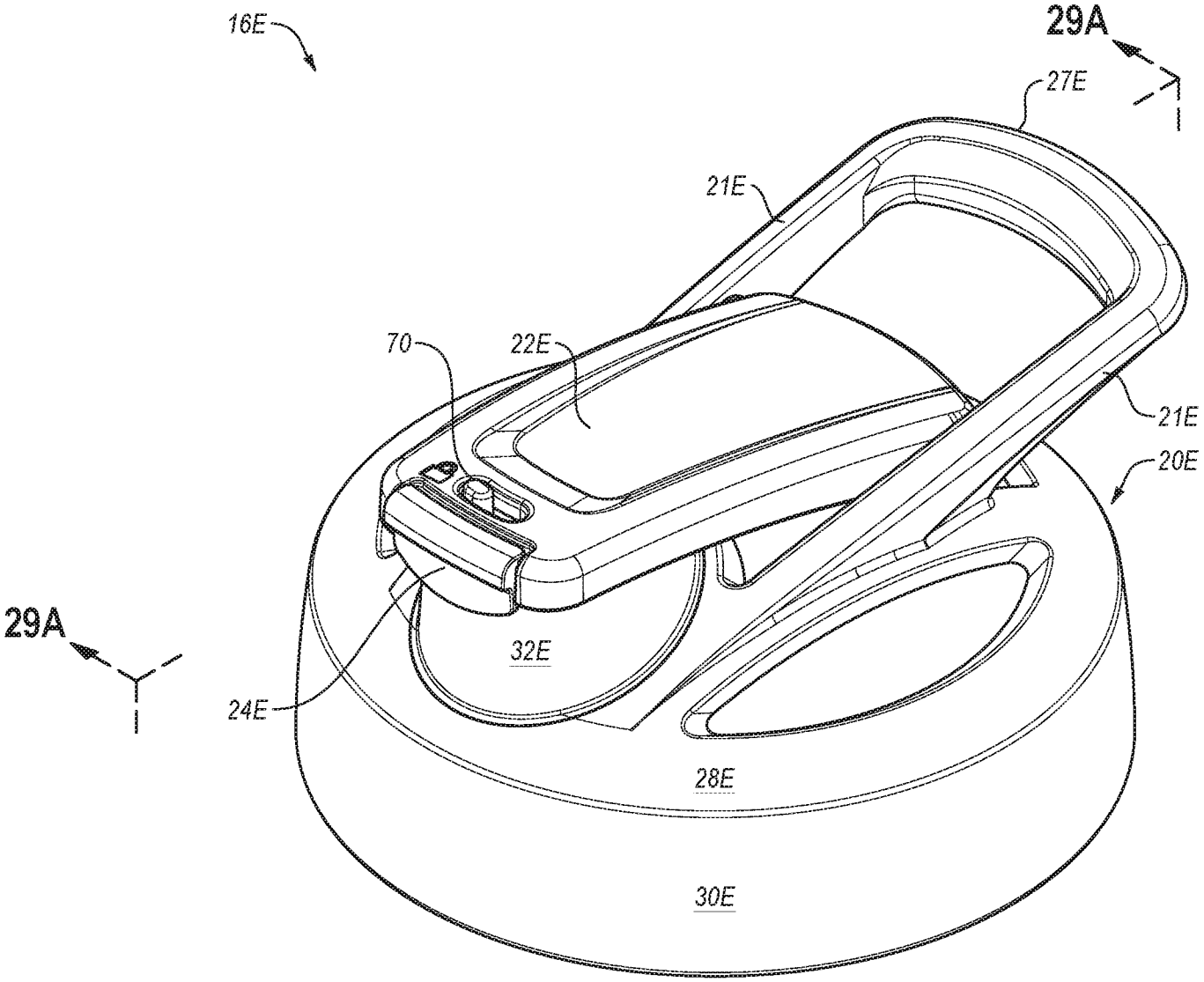
FIGS. 23A-23C are upper perspective views of a container lid of FIG. 22.
Figure 23B:
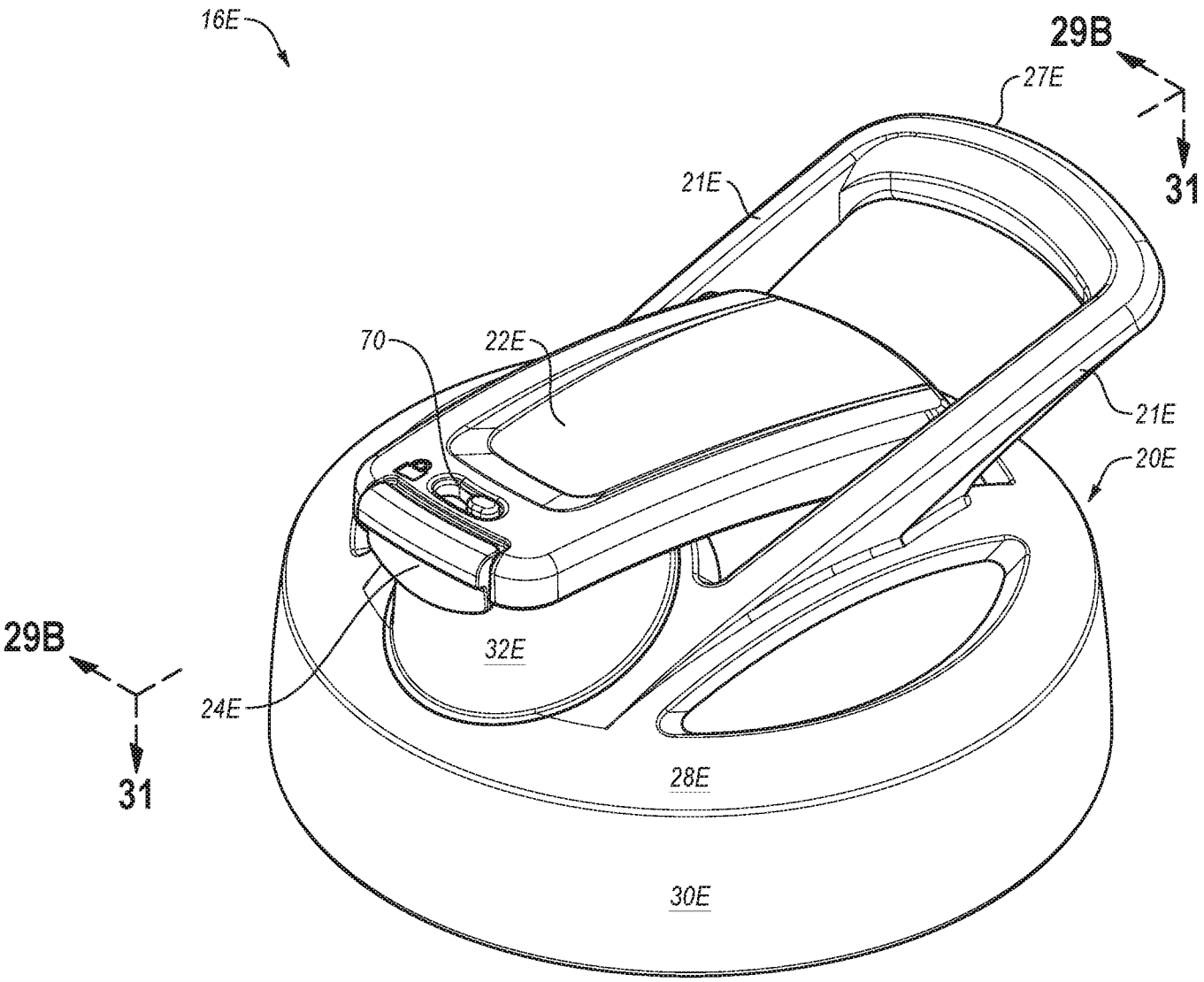
Figure 23C:
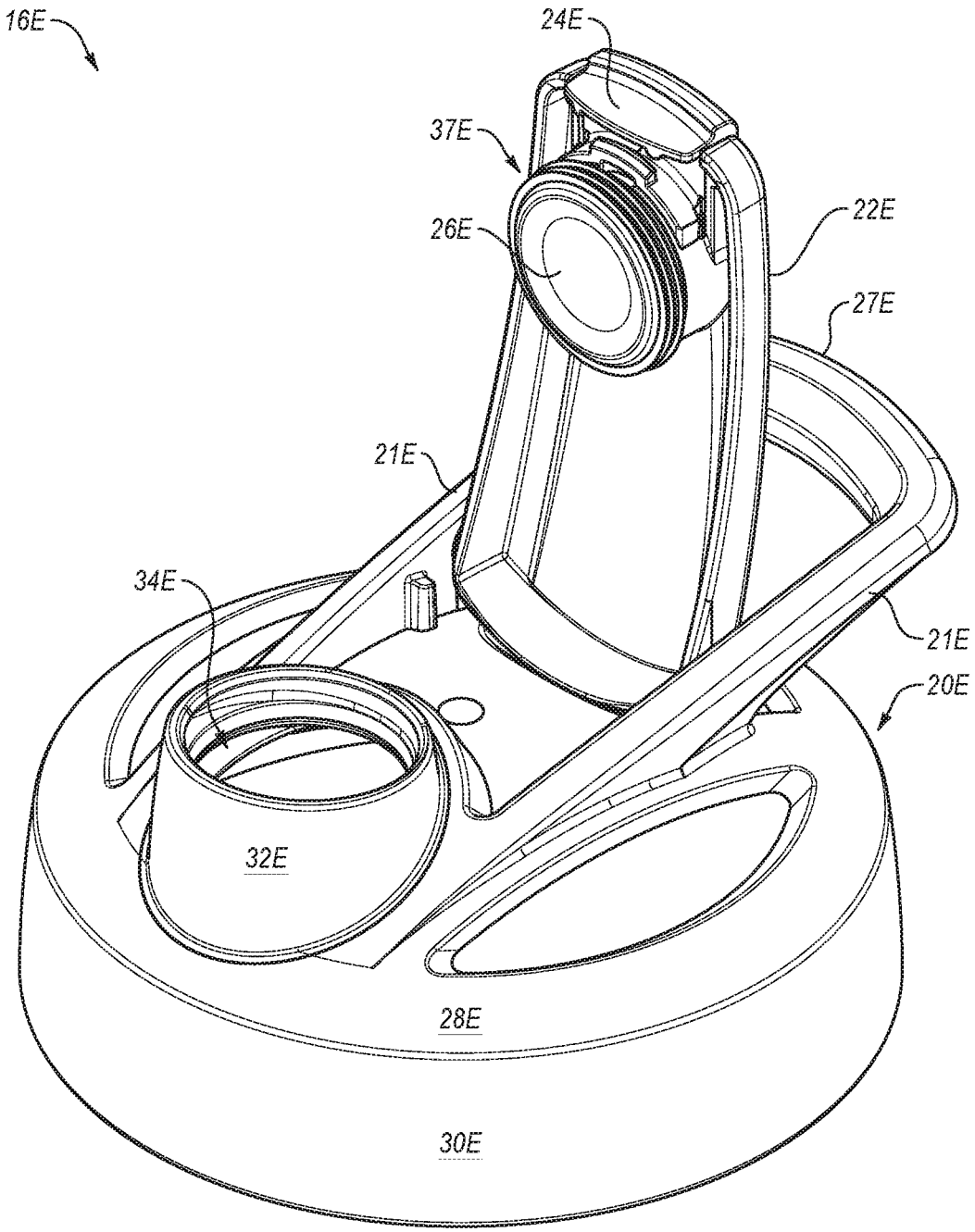
Figure 24:
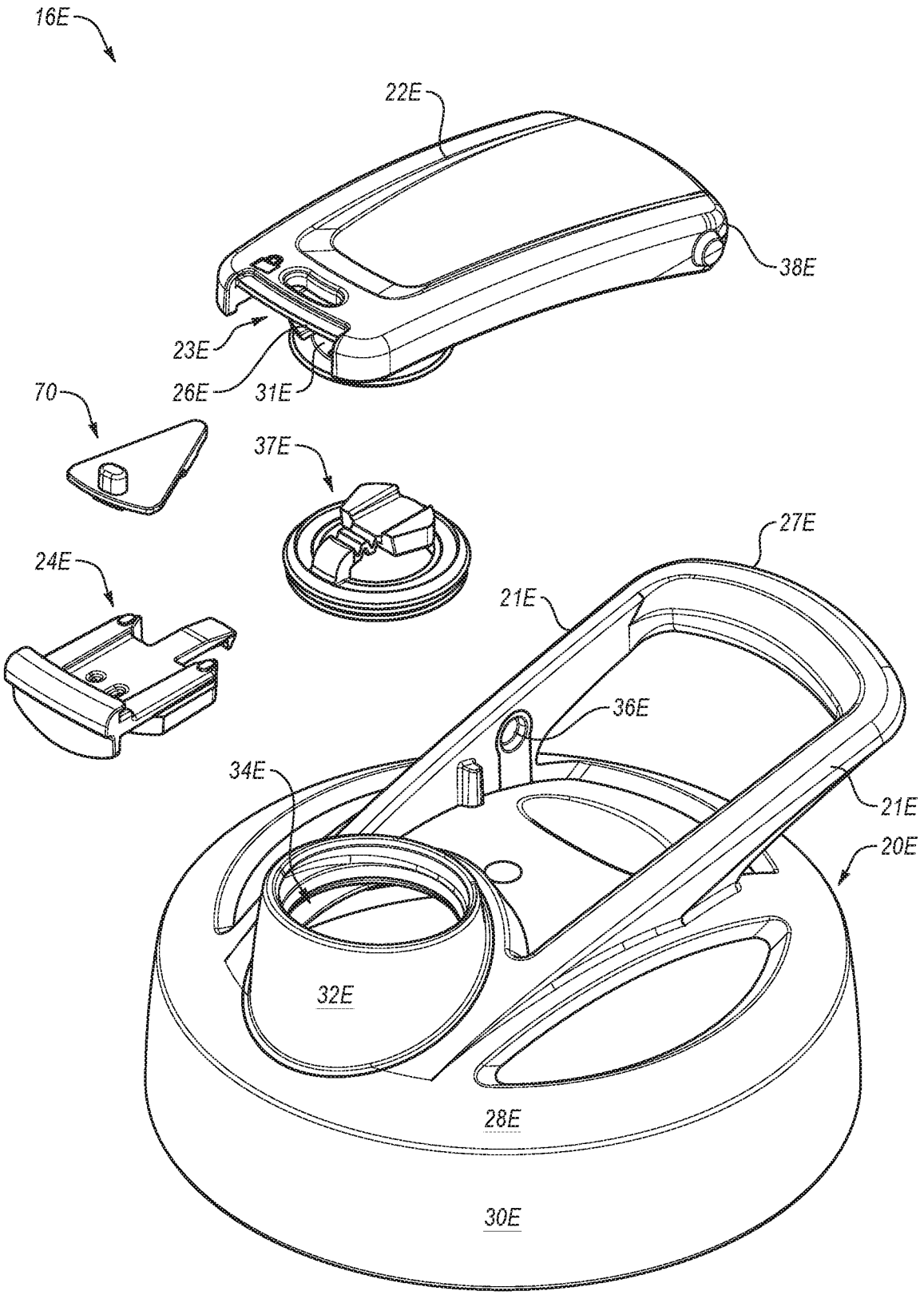
FIG. 24 is an exploded upper perspective view of the container lid of FIGS. 22-23C.

FIGS. 23A-23C are upper perspective views of the container lid 16E, arranged in accordance with at least one embodiment described herein. FIG. 24 is an exploded upper perspective view of the container lid 16E, arranged in accordance with at least one embodiment described herein. As illustrated in FIGS. 23A-24, the container lid 16E may include a container top 20E, a closure 22E, a push button 24E, and a plug 26E (see, e.g., FIG. 23C). Alternatively or additionally, the container lid 16E may include a lock 70 to selectively lock the push button 24E in a particular position, such as in a first push button position described below. FIG. 23A illustrates the lock 70 in a locked position with the closure 22E in a closed closure position, FIG. 23B illustrates the lock 70 in an unlocked position with the closure 22E in the closed closure position, and FIG. 23C illustrates the closure 22E in an open closure position. Although not illustrated, the open closure position of the closures 22A, 22B, 22C, and 22D may be similar to the open closure position of the closure 22E illustrated in FIG. 23C.

The container top 20E may include an end wall 28E, a skirt 30E, a spout 32E and a carry loop 27E. The skirt 30E may generally extend downward from the end wall 28E and may be configured to matingly engage a top of the container body 18E. In this and other embodiments, the skirt 30E may include on an interior or exterior surface thereof one or more container engagement members to selectively secure the container top 20E to the container body 18E. For instance, the skirt 30E may include interior threads (as in FIG. 29A), exterior threads, a bayonet-style mount, or other container engagement members configured to matingly engage with one or more corresponding threads, bayonet-style mounts, or other lid engagement members formed on an upper exterior or interior surface of the container body 18E to secure the container top 20E to the container body 18E.

The spout 32E may extend upward from the end wall 28E. One or more lid openings 34E may pass through the spout 32E. In some embodiments, the spout 32E may define one or more lid openings. A single generally circular lid opening 34E is depicted in FIGS. 23C and 24 as an example; in other embodiments, the spout 32E may define two or more openings of any suitable size and/or shape. When the container lid 16E is coupled to the container body 18E and the closure 22E is moved to the open closure position of FIG. 23C, a user may consume or otherwise remove contents from the container 10E through the lid opening 34E. Alternatively or additionally, the user may add contents to the container 10E through the lid opening 34E.

The closure 22E may be pivotally coupled to the container top 20E and may be configured to selectively cover the lid opening 34E. For instance, the closure 22E may be rotatable between the open closure position (as illustrated in FIG. 23C) in which the lid opening 34E is open and the closed closure position (as illustrated in FIGS. 23A and 23B) in which the lid opening 34E is closed.

In the open closure position of the closure 22E illustrated in FIG. 23C, the closure 22E is rotated approximately 90 degrees from the closed closure position of FIGS. 23A and 23B. The open closure position, however, does not necessarily refer to a specific angular orientation of the closure 22E relative to the container lid 20E. Rather, the open closure position may refer to any angular orientation of the closure 22E relative to the container lid 20E in which the lid opening 34E is sufficiently uncovered by the closure 22E to permit at least partial access to the interior of the container 10E through the lid opening 34E. For example, any angular orientation of the closure 22E relative to the container lid 20E in which the closure 22E has rotated, e.g., 15 degrees to 120 degrees, relative to the container lid 20E from the closed closure position may be considered an open closure position.

The closure 22E may be pivotally coupled to the container top 20E through carry loop arms 21E of the carry loop 27E, which may define a rotational axis of the closure 22E. The carry loop arms 21E can comprise one or more pivot posts similar to pivot posts 33A, 33B, 33C disclosed herein. In some embodiments, the closure 22E can be coupled to the container top 20E through one or more pivot posts that are not comprised by a carry loop arm, while the container lid 16E may or may not comprise a carry loop in such embodiments. In some embodiments, the rotational axis of the closure 22E may be defined by one or more pivot posts, such as disclosed herein for example, while optionally omitting the carry loop 27E. In the illustrated embodiment, each of the carry loop arms 21E defines an opening 36E (only one is visible in FIG. 24) configured to receive a protrusion 38E (only one is visible in FIG. 24) that is retained in the corresponding opening 36E during operation and permits the closure 22E to rotate relative to the container top 20E. The opening 36E that is not visible in FIG. 24 may be a mirror image of, and located in an opposite carry loop arm 21E from, the opening 36E that is visible in FIG. 24. The protrusion 38E that is not visible in FIG. 24 may be a mirror image of, and located on an opposite side of the closure 22E from, the protrusion 38E that is visible in FIG. 24. A similar convention may apply to other openings, protrusions, or components/aspects described herein in pairs where only one member of the pair has been illustrated in other Figures herein.

The push button 24E may be slidably coupled to the closure 22E and may be configured to selectively engage the spout 32E or other portion of the container top 20E to selectively retain the closure 22E in the closed closure position. A resilient member 37E may be configured to urge the push button 24E toward the first push button position in which the push button 24E can engage the container top 20E, e.g., at the spout 32E, and to resiliently deform in response to movement of the push button 24E to a second push button position in which the push button 24E is disengaged from the container top 20E. The resilient member 37E may thereby forward bias the push button 24E, e.g., the push button 24E may be urged forward by the resilient member 37E. In other embodiments, the push button 24E may be rearward biased by the resilient member 37E.

As illustrated in FIG. 24, the closure 22E may have a push button recess 23E. With combined reference to FIGS. 23A-24, the push button 24E may be disposed substantially within the push button recess 23E and may be substantially enclosed by the closure 22E. For instance, a majority of the push button 24E, e.g., by length, width, height, surface area and/or volume, may be covered by and/or enclosed within the closure 22E, for example, as illustrated in FIGS. 23A, 23B, 29A, 29B, and 29C.

Figure 26A:
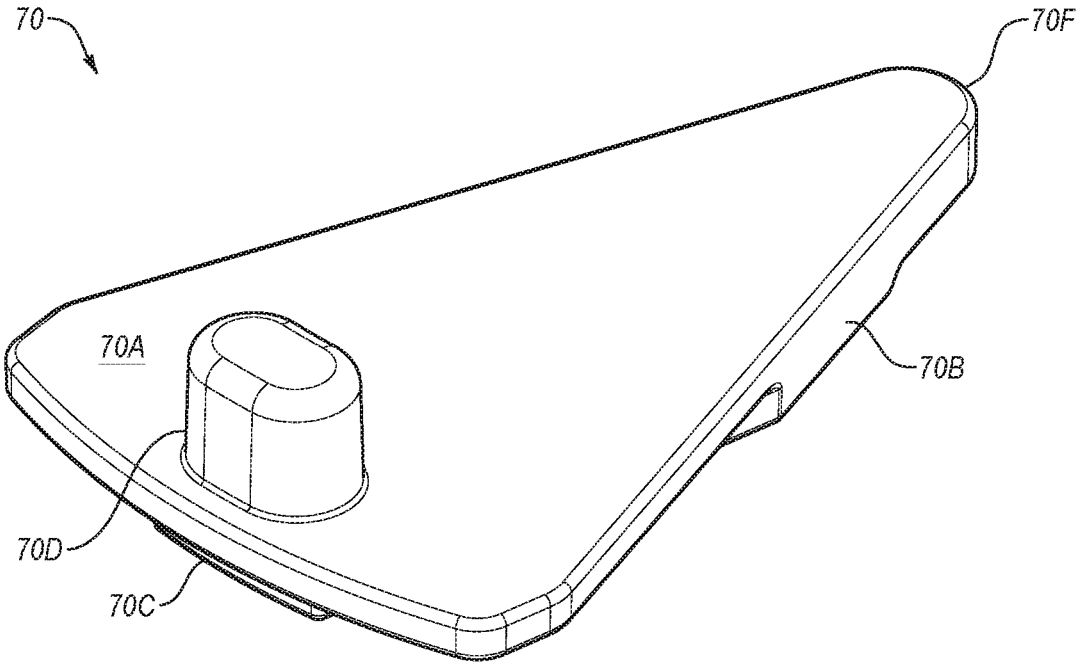
FIGS. 26A and 26B respectively include a front upper perspective view and a front lower perspective view of a lock of FIGS. 23A-24.
Figure 26B:
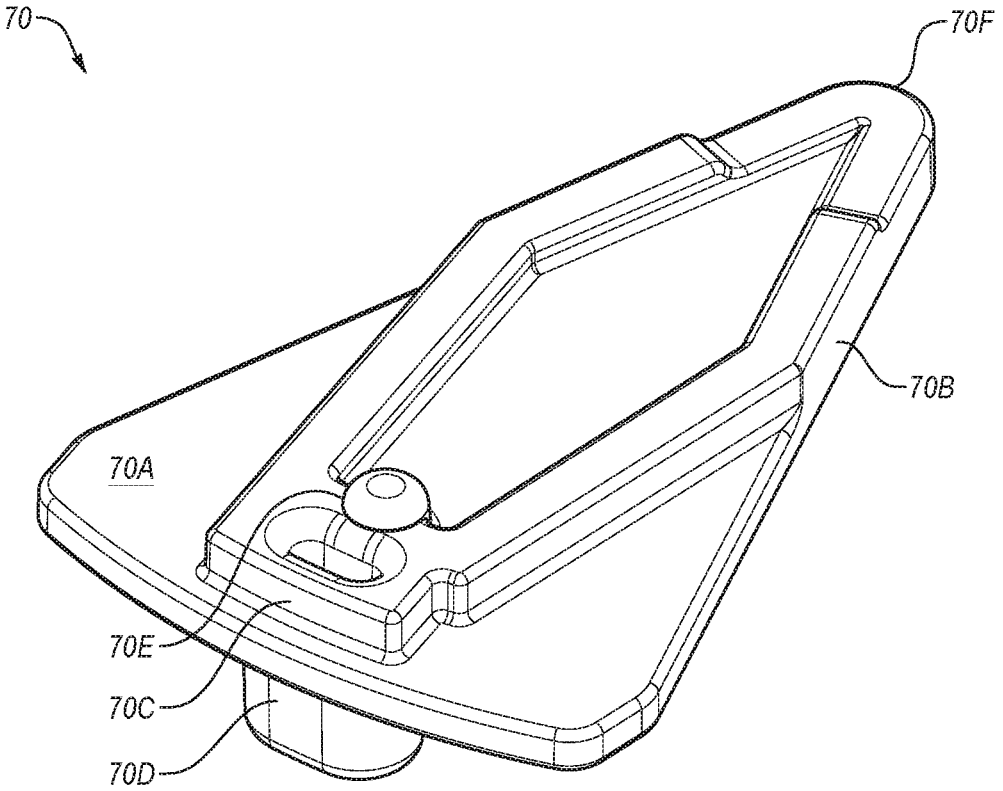
Figure 27A:
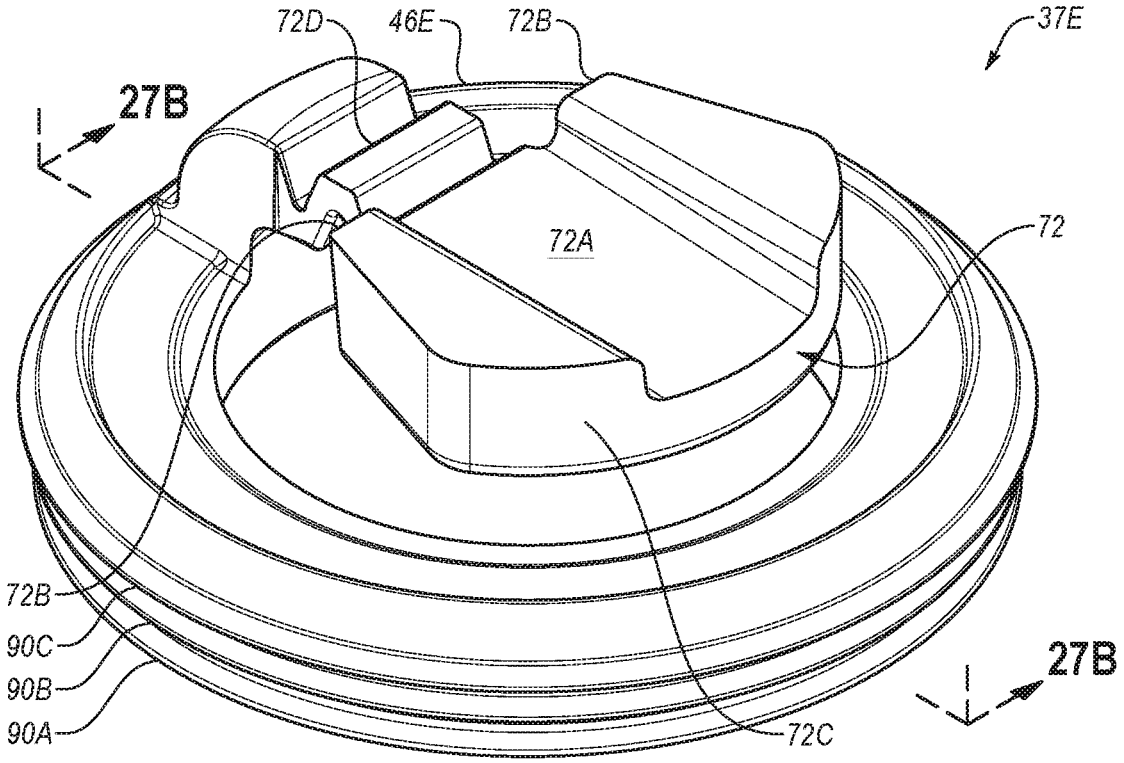
FIGS. 27A and 27B respectively include an upper perspective view and a cross-sectional view of a seal and bias member of FIGS. 23A-24.
Figure 27B:
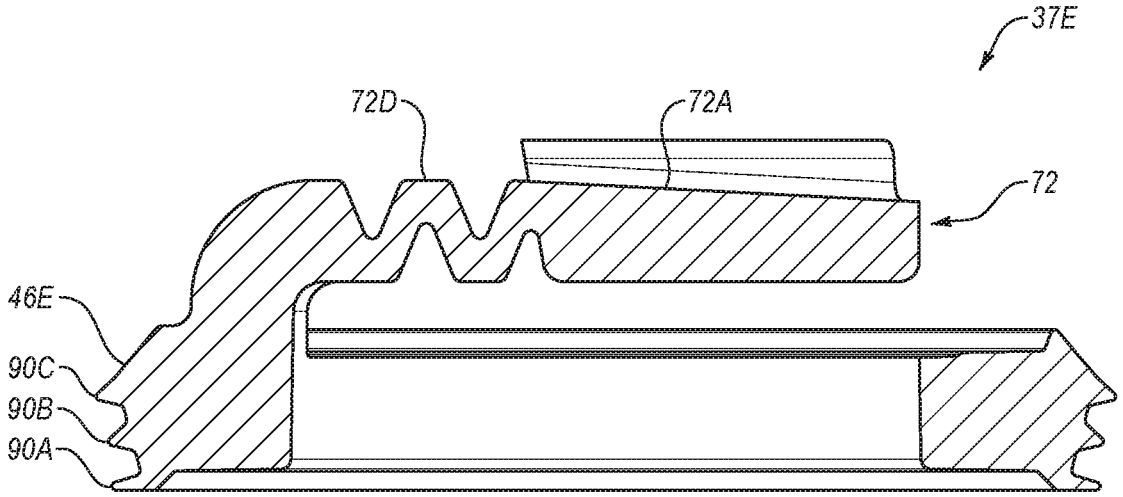
Figure 28A:
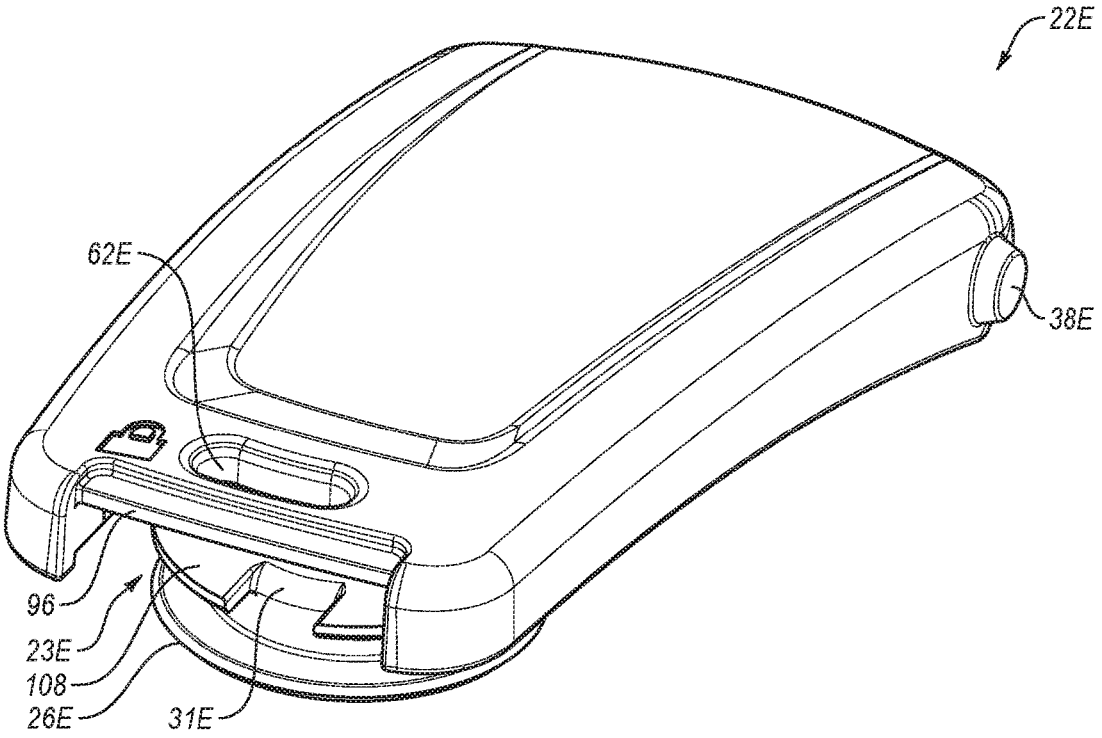
FIGS. 28A and 28B respectively include a front upper perspective view and a front lower perspective view of a closure of FIGS. 23A-24.
Figure 28B:
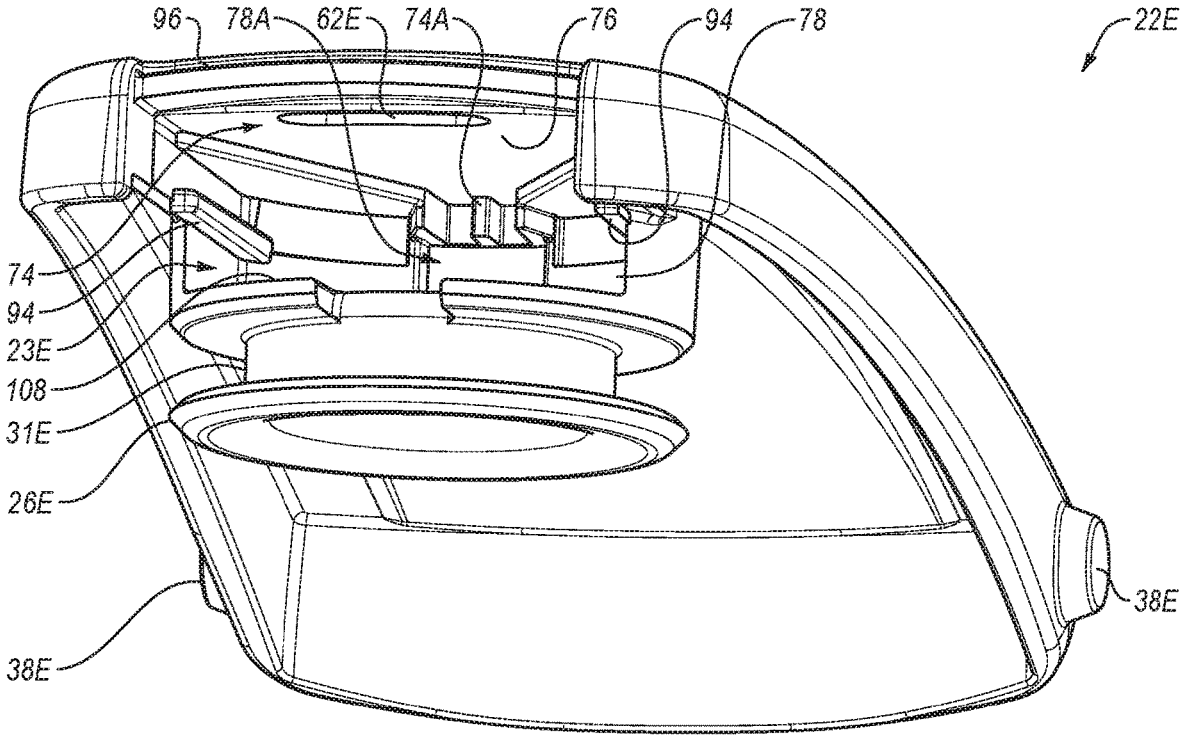

FIGS. 25A-25D respectively include a front upper perspective view, a front lower perspective view, a top view, and a side view of the push button 24E of FIGS. 23A-24, arranged in accordance with at least one embodiment described herein. FIG. 25E includes a cross-sectional view, taken along cutting plane 25E-25E in FIG. 25A, of the push button 24E of FIGS. 23A-24, arranged in accordance with at least one embodiment described herein. FIGS. 26A and 26B respectively include a front upper perspective view and a front lower perspective view of the lock 70 of FIGS. 23A-24, arranged in accordance with at least one embodiment described herein. FIG. 27A includes an upper perspective view of the resilient member 37E of FIGS. 23A-24, arranged in accordance with at least one embodiment described herein. FIG. 27B includes a cross-sectional view, taken along cutting plane 27B-27B in FIG. 27A, of the resilient member 37E of FIGS. 23A-24, arranged in accordance with at least one embodiment described herein. FIGS. 28A and 28B respectively include a front upper perspective view and a front lower perspective view of the closure 22E of FIGS. 23A-24, arranged in accordance with at least one embodiment described herein.

Figure 29B:
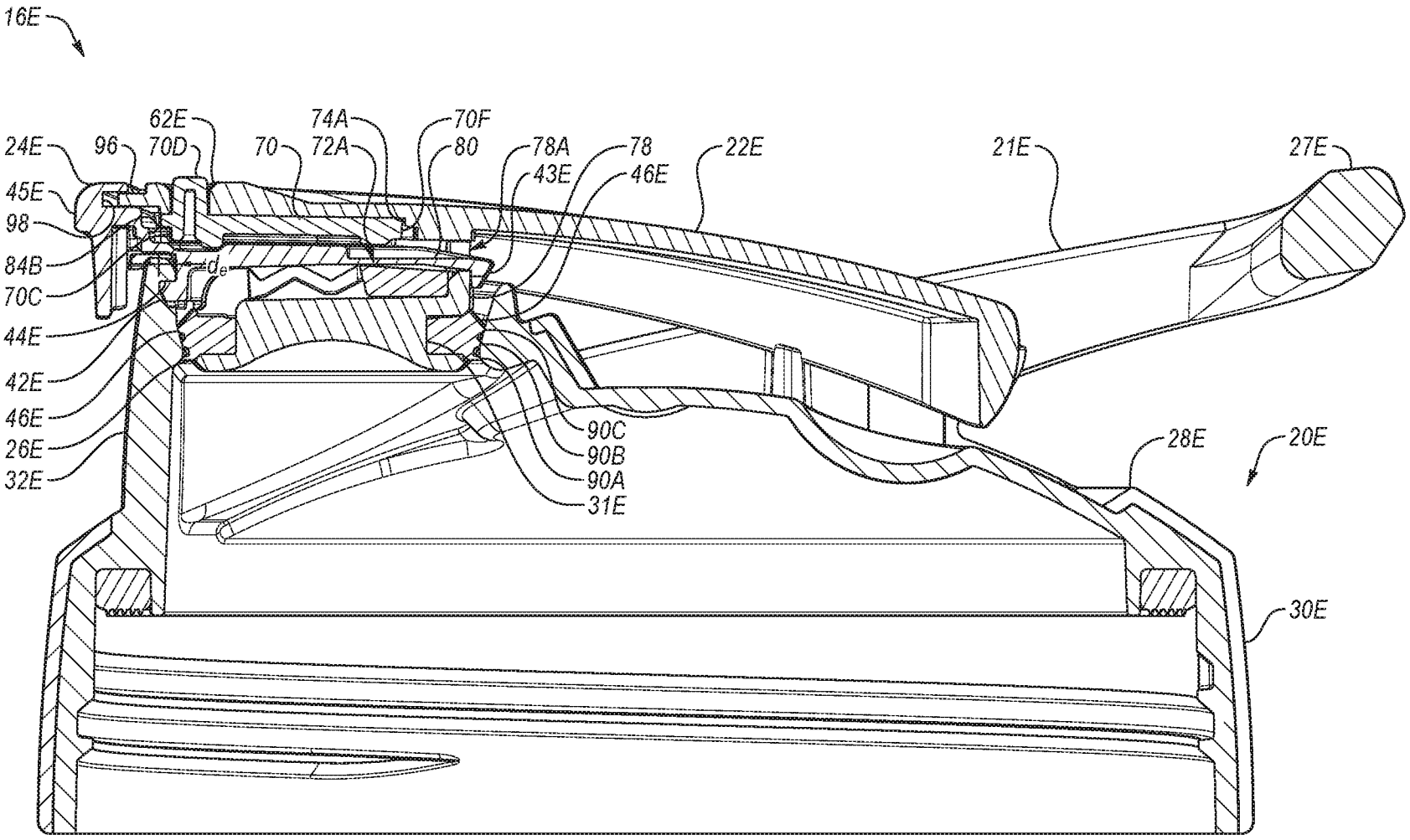
FIG. 29B is a cross-sectional view of the container lid of FIGS. 23A-24 with the lock in an unlocked position.
Figure 29C:
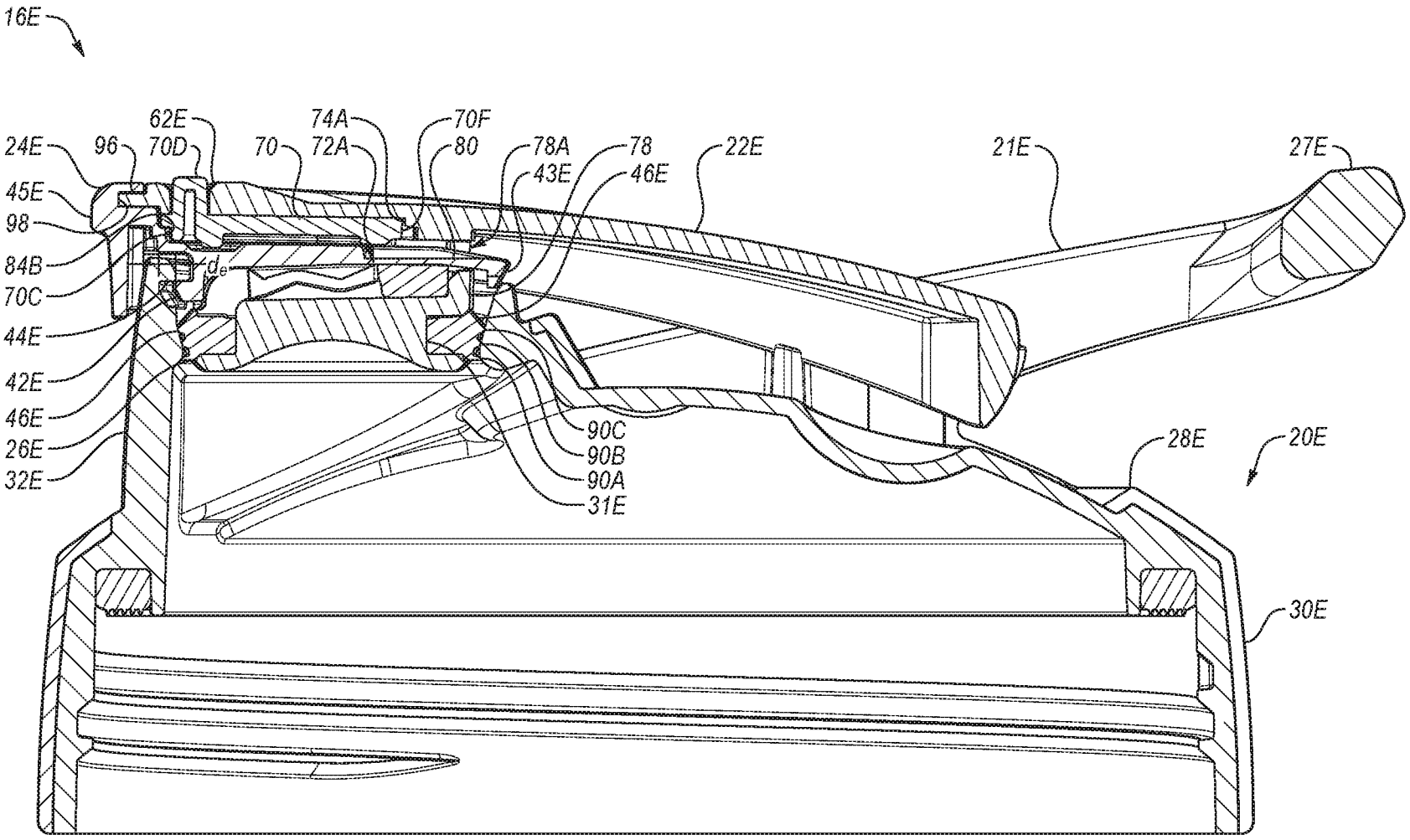
FIG. 29C is a cross-sectional view of the container lid of FIGS. 23A-24 with the push button in a second push button position.
Figure 30:
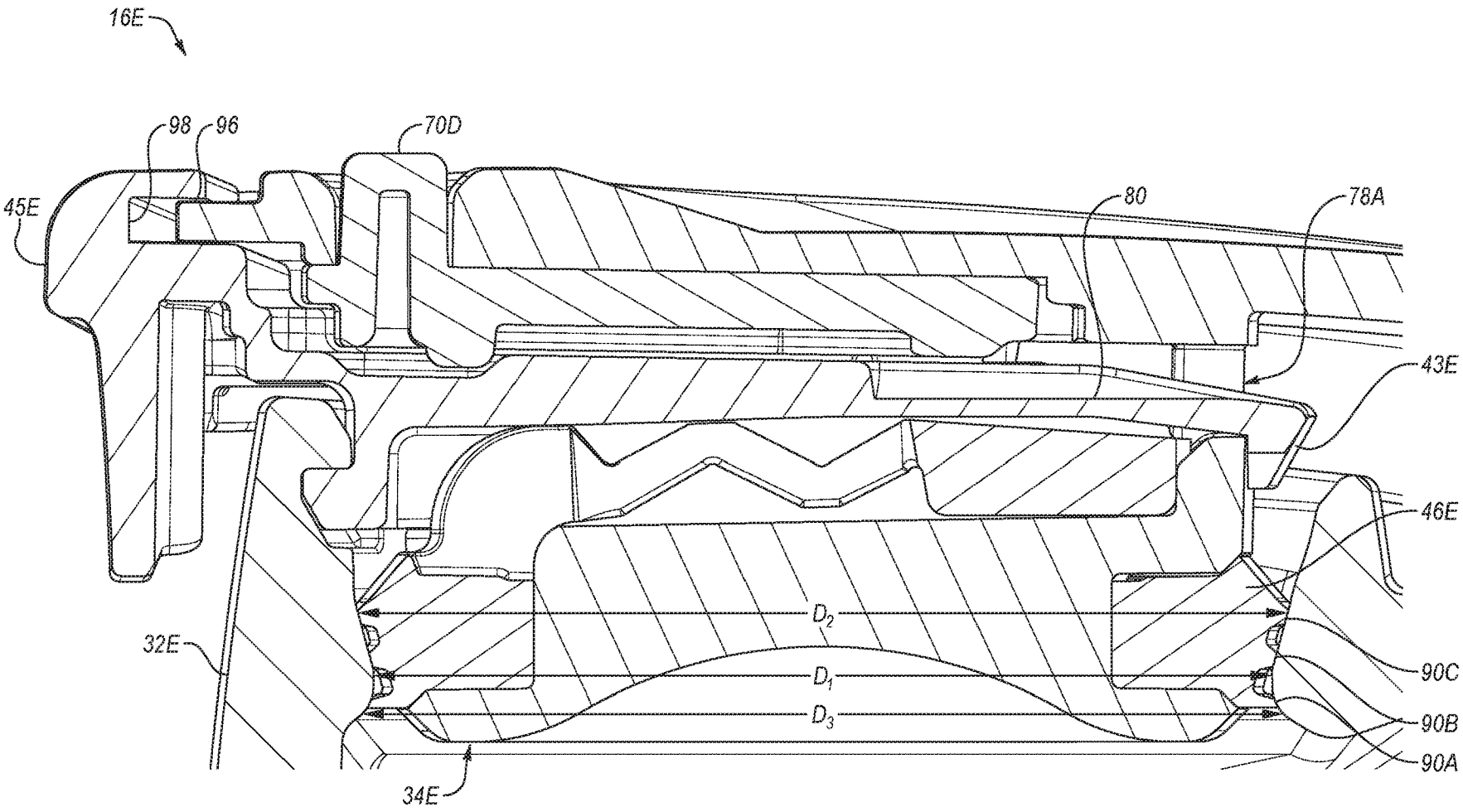
FIG. 30 is an enlarged view of a portion of FIG. 29B.
Figure 31:
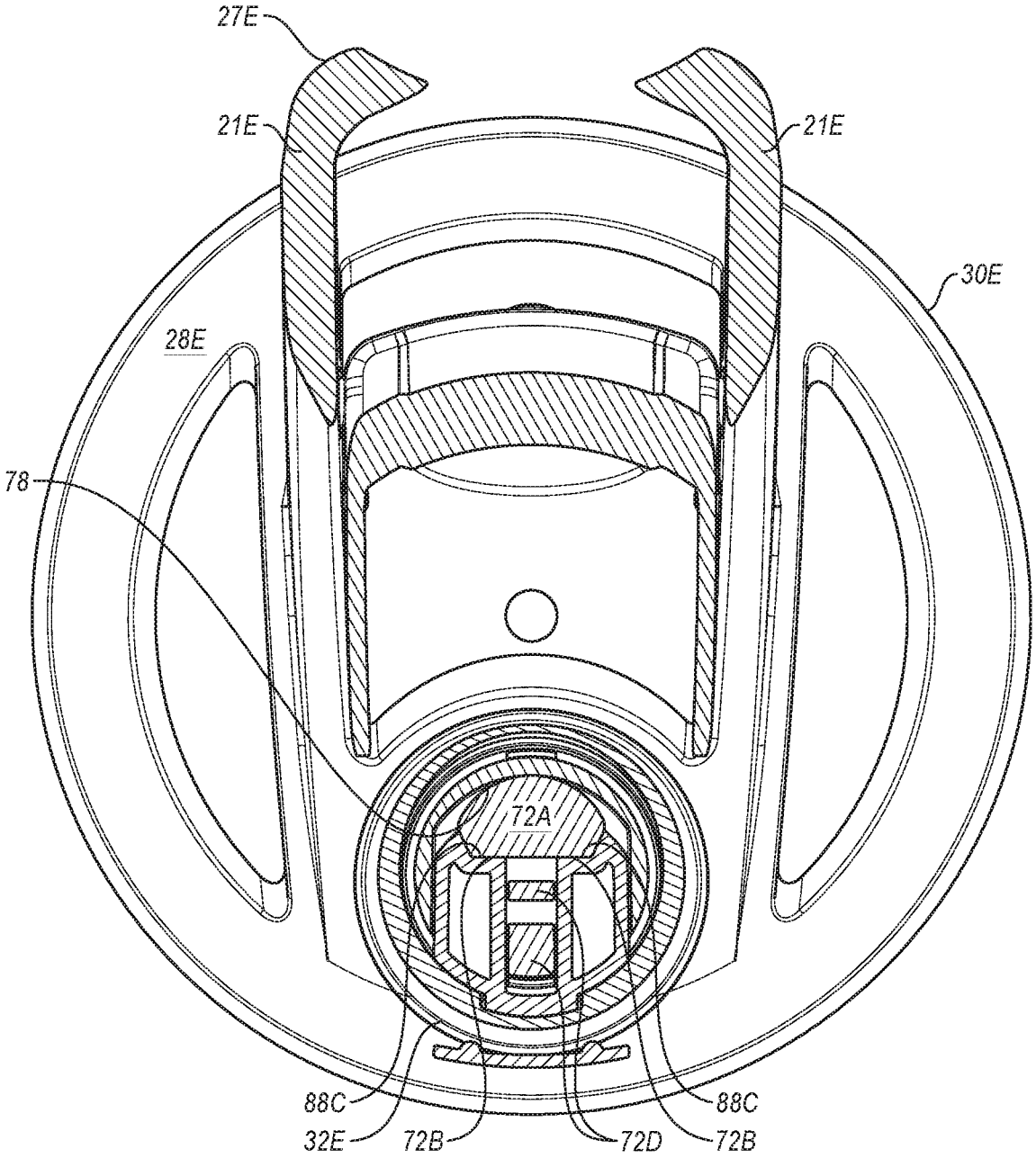
FIG. 31 is a cross-sectional view of the container lid of FIGS. 23A-24 with the push button in a first push button position.

FIG. 29A is a cross-sectional view, taken along cutting plane 29A-29A in FIG. 23A, of the container lid 16E of FIGS. 23A-24 with the lock 70 in the locked position, arranged in accordance with at least one embodiment described herein. The cutting plane 29A-29A is aligned to pass approximately through a middle of a lock switch 70D of the lock 70 with the lock 70 in the locked position. FIG. 29A additionally illustrates a top portion of the container 18E, including the top opening 102 and the threads 104 of the container 18E. FIG. 29B is a cross-sectional view, taken along cutting plane 29B-29B in FIG. 23B, of the container lid 16E of FIGS. 23A-24 with the lock 70 in the unlocked position, arranged in accordance with at least one embodiment described herein. The cutting plane 29B-29B is aligned to pass approximately through the middle of the lock switch 70D with the lock 70 in the unlocked position. FIG. 29C is a cross-sectional view, taken along cutting plane 29B-29B in FIG. 23B, of the container lid 16E of FIGS. 23A-24 with the push button 24E in the second push button position, arranged in accordance with at least one embodiment described herein. FIG. 30 is an enlarged view of a portion of FIG. 29B, arranged in accordance with at least one embodiment described herein. FIG. 31 is a cross-sectional view, taken along cutting plane 31-31 in FIG. 23B, of the container lid 16E of FIGS. 23A-24 with the push button 24E in the first push button position, arranged in accordance with at least one embodiment described herein. The cutting plane 31-31 is aligned to pass horizontally through both the push button 24E and the resilient member 37E.

With combined reference to FIGS. 22-29C, the push button 24E may include a body 40E, an arm 80 that extends rearward from the body 40E, one or more latches 42E, and/or one or more retention tabs 43E. The push button 24E may include a single latch 42E and a single retention tab 43E as illustrated, with the retention tab 43E carried on an arm 80. Alternatively, the push button 24E may include two or more latches 42E, two or more arms 80, or two or more retention tabs 43E. The retention tab 43E may be configured to retain the push button 24E within the push button recess 23E of the closure 22E. One or more retention tabs 43E can be positioned at one or more ends, e.g., rearward ends, of one or more arms. Other retention tabs described herein may be implemented instead of or in addition to the retention tab 43E.

The push button recess 23E of the closure 22E can have a push button recess upper wall 76 and a push button recess rear wall 78. The push button recess upper wall 76 and the push button recess rear wall 78 may together at least partially define the push button recess 23E. At least one hole 78A is formed in the push button recess rear wall 78 that is large enough to accommodate passage of the retention tab 43E through the hole 78A. A number of the holes 78A may equal a number of the retention tabs 43E in some embodiments. In other embodiments, a single hole 78A may accommodate two or more retention tabs 43E.

The arm 80 of the push button 24E may extend through the hole 78A with the retention tab 43E located rearward of a rear surface of the push button recess rear wall 78 when the push button 24E is assembled together with the closure 22E, as illustrated in FIGS. 29A and 29B. The rear surface of the push button recess rear wall 78 may include or function as a tab stop for the retention tab 43E. Accordingly, the retention tab 43E may be configured to engage the rear surface of the push button recess rear wall 78 to inhibit forward movement of the retention tab 43E past the rear surface of the push button recess rear wall 78. Thus, after insertion of the push button 24E into the push button recess 23E to the point that the retention tab 43E of the push button 24E is behind the rear surface of the push button recess rear wall 78 as illustrated in FIG. 29B, the push button 24E may be able to slide rearward and forward relative to the closure 22E within a defined range determined by the retention tab 43E and the rear surface of the push button recess rear wall 78 in the forward direction and one or more other features, such as a back end of the body 40E of the push button 24E and a front surface of the push button recess rear wall 78, in the rearward direction.

The arm 80 may extend rearward from the body 40E in a forward-biased implementation of the push button 24E as illustrated, forward from the body 40E in a rearward-biased implementation, laterally from the body 40E in a laterally-biased implementation, or some combination of forward and laterally or rearward and laterally in a corresponding implementation.

In some embodiments, the retention tab 43E may be selectively disengageable from the rear surface of the push button recess rear wall 78 to permit disassembly and reassembly of the push button 24E and the closure 22E. In other embodiments, the retention tab 43E may not be disengageable from the rear surface of the push button recess rear wall 78 without plastic deformation or detachment of the retention tab 43E or other components or portions thereof. The arm 80 may include a resilient material and the retention tab 43E may be biased by the arm 80 to engage the rear surface of the push button recess rear wall 78. Accordingly, and in response to application of a removal force to the retention tab 43E in a direction toward a top of the closure 22E, the arm 80 may be configured to resiliently deform to permit alignment of the retention tab 43E with the hole 78A to permit removal of the push button 24E from the push button recess 23E. In particular, with the arm 80 resiliently deformed to accommodate alignment of the retention tab 43E with the hole 78A, the retention tab 43E may be pushed forward and at least into the hole 78A, to then pull forward on the push button 24E until the retention tab 43E clears the push button recess rear wall 78 and the push button 24E may then be completely removed from the push button recess 23E. Alternatively or additionally, a bias member 72 may be preloaded (e.g., partially compressed if operated in compression, or partially expanded if operated in expansion) between the push button 24E and the closure 22E such that the bias member 72 may urge the push button 24E forward at least initially after the retention tab 43E is aligned to the hole 78A.

The latch 42E may be configured to selectively engage the container top 20E, e.g., at the spout 32E. For instance, the spout 32E may include one or more latch stops 44E (FIGS. 29A-29C) configured to overhang the latch 42E when the closure 22E is in the closed closure position (as illustrated in FIGS. 29A and 29B) and the push button 24E is in the first push button position (as illustrated in FIGS. 29A and 29B). The latch stop 44E may include a lip formed in the spout 32E, a shoulder formed in the spout 32E, an upper surface of a latch recess formed in the spout 32E, or other suitable latch stop 44E. Moreover, the latch stop 44E may be formed on an interior of the spout 32E, for example as illustrated in FIGS. 29A and 29B, or on an exterior of the spout 32E (not illustrated in FIGS. 29A and 29B) provided the push button 24E is implemented accordingly.

As illustrated in FIGS. 29A and 29B, when the push button 24E is in the first push button position and the closure 22E is in the closed closure position, the latch 42E may extend beneath the latch stop 44E by an engagement distance $d_e$ measured from a rear edge of the latch stop 44E to a front end of the latch 42E. The latch 42E may be disengaged from the latch stop 44E to allow movement of the closure 22E to the open closure position by, e.g., a user pushing the push button 24E rearward through the engagement distance $d_e$ until the front end of the latch 42E clears the rear edge of the latch stop 44E, which may constitute the second push button position as illustrated in FIG. 29C. With the push button 24E in the second push button position of FIG. 29C, there is little or no engagement between the latch 42E and the spout 32E. As such, the closure 22E (and the push button 24E) may be rotated clockwise relative to the container lid 20E in the orientation of FIG. 29C to the open closure position (e.g., FIG. 23C) in which the lid opening 34E is open.

The resilient member 37E may be configured to urge the push button 24E toward the first push button position (illustrated in FIG. 29A) in which the push button 24E engages the spout 32E. The resilient member 37E may also be configured to resiliently deform in response to movement of the push button 24E to the second push button position (illustrated in FIG. 29C) in which the push button disengages the spout 32E.

As illustrated in FIGS. 27A and 27B, the resilient member 37E may include a bias member 72 and a lid opening seal 46E. The bias member 72 and the lid opening seal 46E may be integrally formed as a single and/or monolithic component, for example as illustrated, or may be formed as discrete components that are subsequently coupled together after formation.

In some embodiments, the resilient member 37E may comprise a tongue joining the lid opening seal 46E and the bias member 72. Alternatively or additionally, the bias member 72 may comprise the tongue. The tongue may urge the push button 24E toward the first push button position and may resiliently deform in response to movement of the push button to the second push button position.

Referring to FIGS. 24 and 28A-29C, the plug 26E may define a seal seat 31E generally configured to receive therein at least a portion of the lid opening seal 46E. For instance, the seal seat 31E may include an annular channel formed around the plug 26E, the seal seat 31E or annular channel having a diameter that is about the same as an internal diameter of the lid opening seal 46E. In some embodiments, the diameter of the seal seat 31E may be slightly smaller than the diameter of the lid opening seal 46E, the lid opening seal 46E being formed of a resilient and/or stretchy material such that the lid opening seal 46E may be stretched when installed in the seal seat 31E to fit snugly around the seal seat 31E. In other embodiments, the lid opening seal 46E may be relaxed and not stretched when installed in the seal seat 31E.

Referring to FIGS. 27A, 27B, and 29A-29C, the bias member 72 may extend from the lid opening seal 46E. Alternatively or additionally, the bias member 72 may extend upward from the lid opening seal 46E. As previously indicated, the bias member 72 may comprise a tongue, comprising one or more of a tongue end 72A and a tongue neck 72D. The tongue end 72A may include forward facing surfaces 72B and a rearward facing surface 72C and may be coupled to the lid opening seal 46E via the tongue neck 72D that is narrower than the tongue end 72A. When the container lid 16E is assembled, the rearward facing surface 72C may be positioned adjacent to and/or in direct contact with the push button recess rear wall 78, as illustrated in FIG. 31.

Referring to FIGS. 25A-25E, the push button 24E may comprise a tongue channel 88 that may have a complementary shape to the bias member 72 of the resilient member 37E. The tongue channel 88 may be located at an underside of the push button 24E. The tongue channel 88 may include a tongue end cavity 88A and a tongue neck cavity 88B. In the illustrated embodiment, the tongue end cavity 88A may be sized and configured to receive therein the tongue end 72A of the bias member 72 while the tongue neck cavity 88B may be sized and configured to receive therein the tongue neck 72D. The tongue channel 88 may additionally include rearward facing surfaces 88C. When the bias member 72 of the resilient member 37E is positioned within the tongue channel 88 of the push button 24E, the forward facing surfaces 72B of the tongue end 72A may be positioned adjacent to and/or in direct contact with the rearward facing surfaces 88C of the tongue channel 88 defined by the push button 24E, as illustrated in FIG. 31.

As illustrated in FIGS. 29A-29C and 31, when the container lid 16E is assembled, the lid opening seal 46E of the resilient member 37E may be seated within the seal seat 31E of the plug 26E, with the bias member 72 extending rearward, and optionally upward, from the front of the lid opening seal 46E and into the tongue channel 88 of the push button 24E. With the push button 24E in the first push button position, the tongue end 72A may be positioned in a cavity formed by the push button 24E and the closure 22E (FIG. 31). In particular, the tongue end 72 may be positioned between the push button 24E and the closure 22E with the rearward facing surfaces 88C of the tongue channel 88 of the push button 24E in direct contact with the forward facing surfaces 72B of the tongue end 72A and the push button recess rear wall 78 of the closure 22E in direct contact with the rearward facing surface 72C of the tongue end 72A. In some embodiments, with the push button 24E in the first push button position, the tongue end 72A may be at least partially compressed between the push button 24E and the closure 22E to continually bias the push button 24E forward toward the first push button position. Alternatively or additionally, the tongue neck 72D may be at least partially stretched rearward to continually bias the push button 24E forward toward the first push button position.

Application of sufficient rearward force to the push button 24E, e.g., to a push region 45E, may overcome the continual forward bias provided by the bias member 72 and cause the push button 24E to move rearward toward the second push button position. Rearward movement of the push button 24E toward the second push button position may result in compression of the bias member 72, and particularly of the tongue end 72E, and/or stretching of the tongue neck 72D, as the push button 24E, with its rearward facing surfaces 88C of the tongue channel 88 urging against the forward facing surfaces 72B of the bias member 72, causes the tongue end 72A to compress rearward against the push button recess rear wall 78 of the closure 22E. A front of the tongue neck 72D is coupled to the front of the lid opening seal 46E which in turn is seated in the seal seat 31E of the plug 26E such that the tongue neck 72D may also along its length as rearward movement of the push button 24E causes reward movement of the tongue end 72A.

In some embodiments, the tongue neck 72D may include one or more corrugations or undulations. Inclusion of the corrugations or undulations in the tongue neck 72D may decrease resistance of the tongue neck 72D to stretching, compared to a tongue neck without corrugations. Thus, the corrugations or undulations in the tongue neck 72D may at least partially mechanically isolate the tongue end 72A from the lid opening seal 46E. For instance, when the tongue end 72A is compressed between the push button 24E and the closure 22E by movement of the push button 24E from the first push button position to the second push button position, which movement may also stretch the tongue neck 72D, the tongue neck 72D with the corrugations or undulations may pull less on the lid opening seal 46E than, for example, the tongue necks 29C, 57C may pull on the lid opening seals 46A, 46D discussed above.

When the rearward force is removed from the push button 24E, the compressed tongue end 72A of the bias member 72 may at least partially decompress or expand, and/or the stretched tongue neck 72D of the bias member 72 may at least partially recompress. Either or both of the foregoing actions may urge the push button 24E back to the first push button position. For example, with the rearward facing surface 72C of the tongue end 72A in contact with the push button recess rear wall 78 and the forward facing surfaces 72B of the bias member 72 in contact with the rearward facing surfaces 88C in the tongue channel 88, the at least partial decompression or expansion of the compressed tongue end 72A urges the push button 24E forward. In this and other embodiments, the container lid 16E may have a reduced part count and cost compared to some container lids that have both a bias member and a lid opening seal as discrete components.

The lock 70 may be movable relative to one or both of the push button 24E and the closure 22E. The lock 70 may be movably coupled to one, both, or neither of the push button 24E and the closure 22E. In general, the lock 70 may be movable between the locked position (FIG. 29A) and the unlocked position (FIG. 29B). In the locked position, the lock 70 may be positioned to inhibit or to prevent the push button 24E from moving from the first push button position to the second push button position. In the unlocked position, the lock may be positioned to accommodate or to permit movement of the push button 24E between the first push button position and the second push button position.

In some embodiments, the lock 70 may be at least partially positioned between the push button 24E and the closure 22E. The lock 70 may be positioned at least partially within a cavity and/or recess formed in one or both of the push button 24E and the closure 22E. For example, the closure 22E may define a lock recess 74 (FIG. 20) in a bottom surface of the closure 22E, such as, for example, in a bottom surface of the push button recess upper wall 76. The lock recess 74 illustrated in FIG. 20 has a rearward end that includes a fulcrum 74A for movement of the lock 70. In addition or alternative to inclusion of the lock recess 74, the closure 22E may comprise a lock switch channel or recess 62E to provide access through the closure 22E for a user to move the lock 70 between the locked and unlocked positions.

Figure 25A:
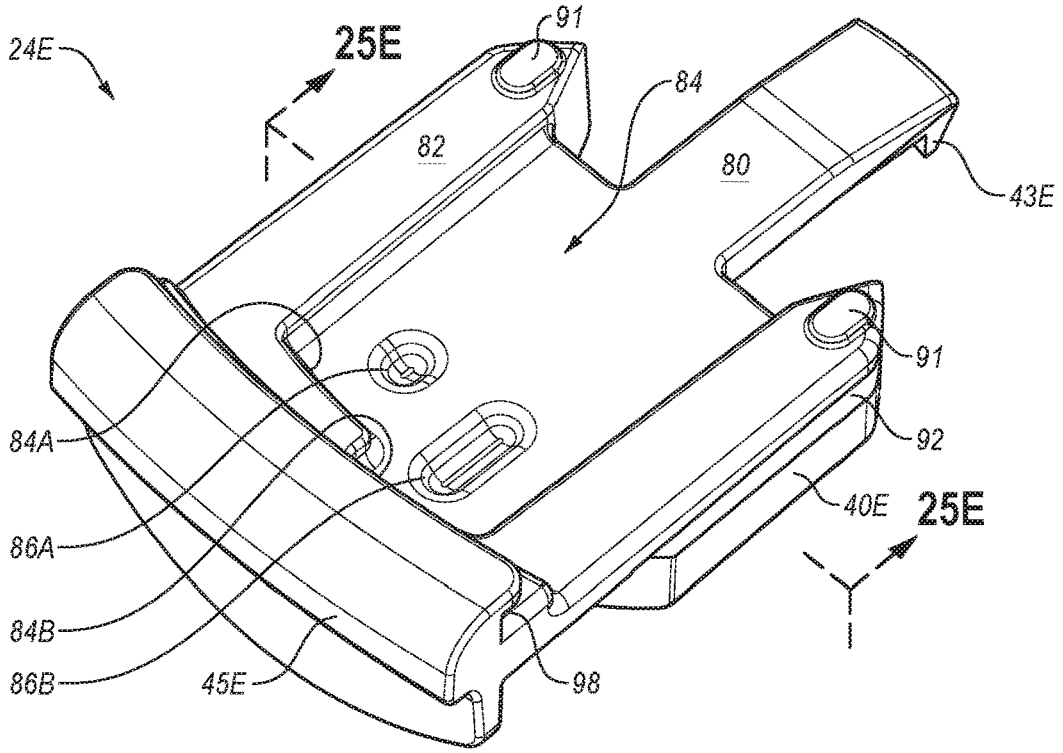
FIGS. 25A-25D respectively include a front upper perspective view, a front lower perspective view, a top view, and a side view of a push button of FIGS. 23A-24.
Figure 25B:
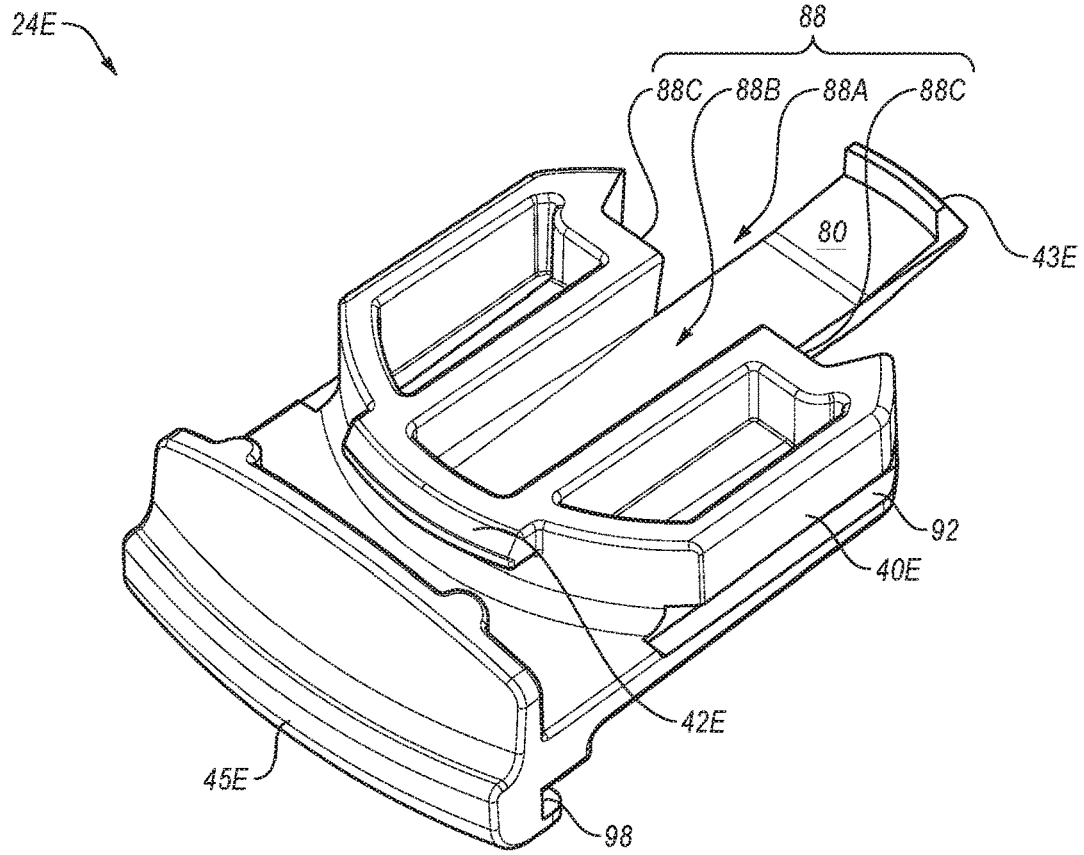
Figure 25C:
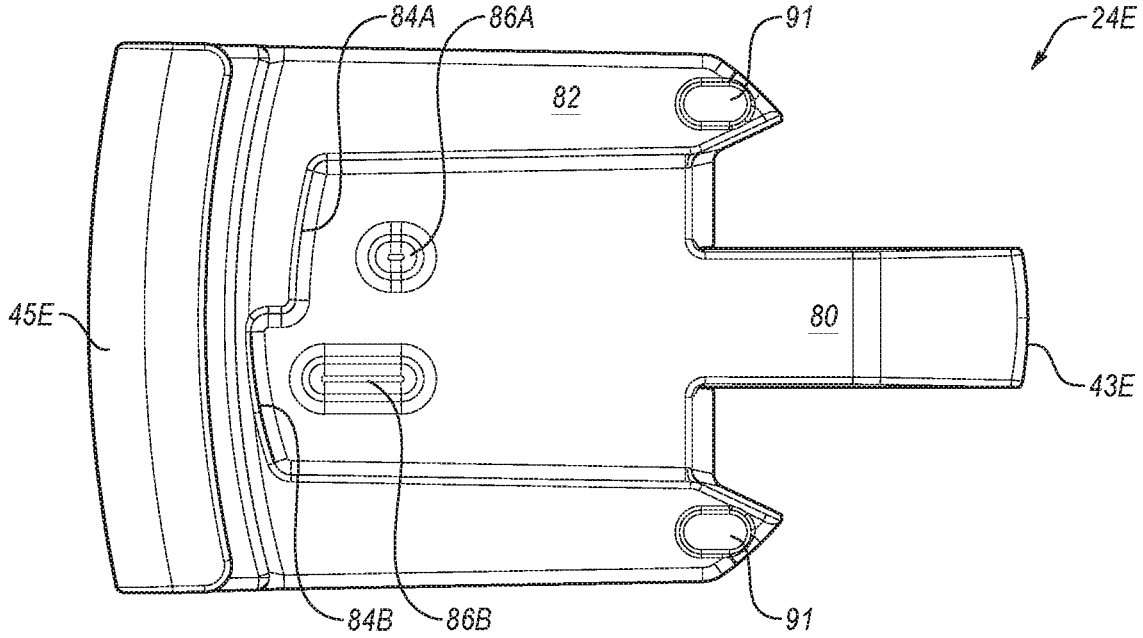
Figure 25D:
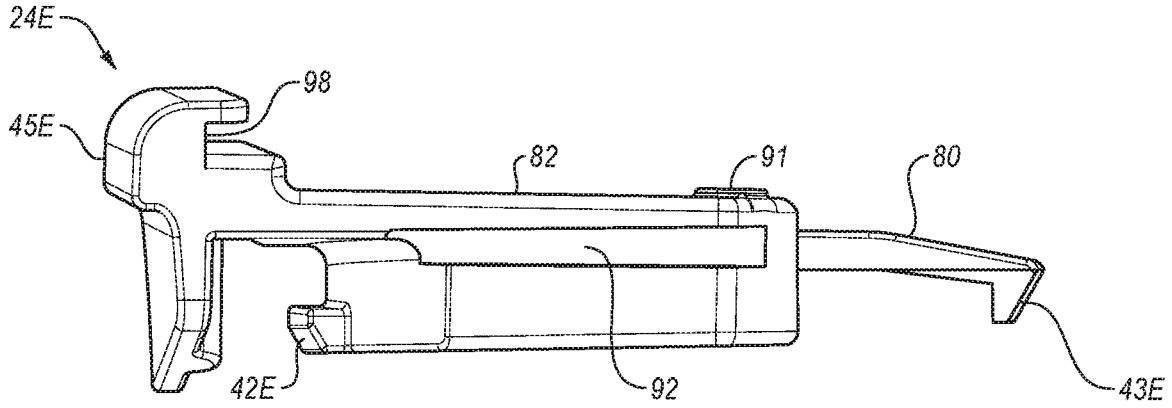
Figure 25E:
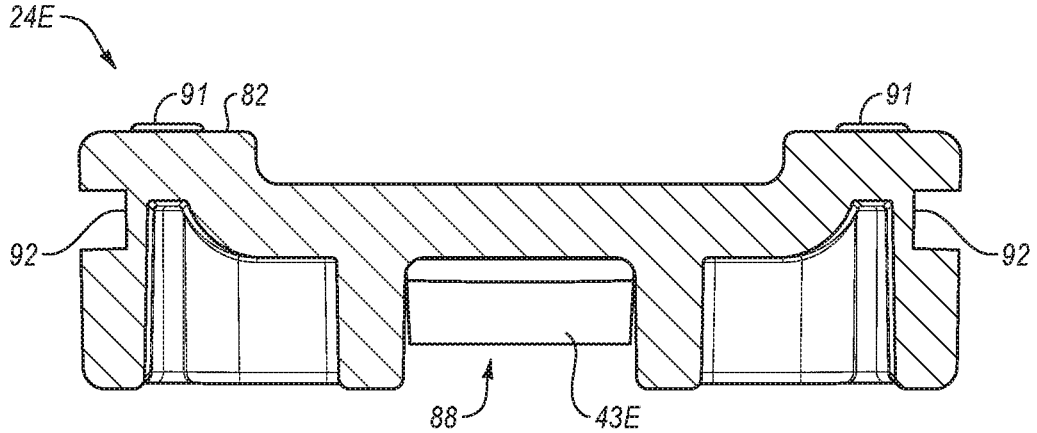
FIG. 25E includes a cross-sectional view of the push button of FIGS. 23A-24.

Referring to FIG. 25A, the push button 24E includes an upper surface 82 and defines a lock cavity 84 in the upper surface 82. The lock cavity 84 includes a first stop 84A in a first portion of the lock cavity 84 and a second stop 84B in a second portion of the lock cavity 84. The second stop 84B is located forward of the first stop 84A. In addition, a bottom surface of the lock cavity 84 may include a first receptacle 86A rearward of the first stop 84A and a second receptacle 86B rearward of the second stop 84B. The second receptacle 86B can have a shape that is elongate in a forward-rearward direction. The receptacles 86A, 86B can comprise dimples, depressions, openings, passages, recesses, or a combination thereof, for example.

Referring to FIGS. 26A and 26B, the lock 70 may include an abutment 70C. The abutment 70C can comprise one or more surfaces arranged for contact with the first stop 84A when the push button 24E is advanced toward the second push button position while the lock 70 is in the locked position. For example, the abutment can comprise one or more forwardly facing surfaces as illustrated in FIGS. 26A and 26B.

The abutment 70C may optionally extend (e.g., downwardly or upwardly) from a base 70A. The base 70A can be planar, for example as illustrated in FIGS. 26A and 26B, or can have other configurations.

The abutment 70C may form a part of a support 70B. The support 70B may extend from the base 70A, if present. The support 70B may optionally be formed as a plateau extending downward from the base 70A. The support 70B may facilitate movement and/or positioning of the lock 70 and/or support the abutment 70C during contact with the first stop 84A resisting movement of the push button 24E. The support 70B may have recesses in one or more sides, e.g., in an upper and/or a lower side.

Referring to FIGS. 25A-26B, the support 70B may be positioned within the lock cavity 84 and the base 70A, if present, may be supported on or by the upper surface 82 of the push button 24E when the lock 70 is in both the locked position and the unlocked position. For example, the base 70A may be supported by the upper surface 82 of the push button 24E along some or all of a front of the base 70A, one or both front corners of the base 70A, and one or more sides of the base 70A, whether the lock 70 is in the locked or the unlocked position.

In addition, referring to FIGS. 26A, 26B, 28A, and 28B, the lock 70 may be at least partially received in the lock recess 74 in the bottom surface of the push button recess upper wall 76 of the closure 22E. For example, the base 70A and/or the support 70B may be at least partially received in the lock recess 74. A pivot 70F of the lock 70 may be positioned at or proximate to the fulcrum 74A of the lock recess 74. The pivot 70F may be formed by the base 70A and/or the support 70B.

Referring to FIG. 29A, when the push button 24E is in the first push button position and the lock 70 is in the locked position, the abutment 70C of the lock 70 may be positioned facing the first stop 84A of the lock cavity 84 of the push button 24E and spaced apart from the first stop 84A by a distance less than the engagement distance $d_e$ and as little as zero. Positioning the abutment 70C relative to the first stop 84A in this manner while the closure 22E is in the closed closure position may prevent the closure 22E from being inadvertently opened through inadvertent rearward movement of the push button 24E. In particular, an inadvertent rearward push, or even an intentional rearward push, on the push button 24E may cause the push button 24E to travel rearward, if at all, from the first push button position only up to the point where the first stop 84A contacts the abutment 70C. Since the first stop 84A is spaced apart from the abutment 70C by the distance less than the engagement distance $d_e$ when the push button 24E is in the first push button position, the push button 24E may be unable to inadvertently travel rearward through the engagement distance $d_e$ to the point where the latch 42E clears the latch stop 44E such that the closure 22E remains in the closed closure position.

Referring to FIGS. 29B and 29C, when the push button 24E is in the first push button position and the lock is in the unlocked position, the abutment 70C of the lock 70 may be positioned facing the second stop 84B of the lock cavity 84 of the push button 24E and spaced apart from the second stop 84B by a distance equal to or greater than the engagement distance $d_e$, which may permit movement of the push button 24E from the first push button position of FIG. 29B to the second push button position of FIG. 29C. In particular, with the lock 70 in the unlocked position, a rearward push on the push button 24E may cause the push button 24E to travel rearward from the first push button position through at least the engagement distance $d_e$, at which point the latch 42E clears the latch stop 44E as illustrated in FIG. 29C, such that the closure 22E can then be opened.

Referring again to FIGS. 18A and 18B, the lock 70 may further include the lock switch 70D and/or a protrusion 70E. The lock switch 70D can extend upward from the base 70A, support 70B, and/or abutment 70C. The lock switch 70D can extend upward at or near a front of the base 70A, as illustrated in FIG. 26A for example, or may be positioned at other locations, such as between the front and a rear of the base for example. As illustrated in FIGS. 29A-29C, the lock switch 70D extends upward through the lock switch channel 62E formed in the push button recess upper wall 76 of the closure 22E. The switch 70D can be manipulated, e.g., by a user, to move the lock 70 between the locked and unlocked positions.

The protrusion 70E may be received in either of the first and second receptacle 86A and 86B of the lock cavity 84. The first receptacle 86A may be associated with the locked position of the lock 70 while the second receptacle 86B may be associated with the unlocked position of the lock 70. For example, the protrusion 70E may be received in the first receptacle 86A when the lock 70 is in the locked position, and the protrusion 70E may be received in the second receptacle 86B when the lock 70 is in the unlocked position. In some embodiments, an interaction of the protrusion 70E with the first and second receptacles 86A and 86B may provide tactile feedback to indicate when the lock 70 has been moved into a corresponding one of the locked and unlocked positions. Alternatively or additionally, the interaction of the protrusion 70E with the first and second receptacles 86A and 86B may inhibit inadvertent movement of the lock 70 between the locked and unlocked positions.

Referring to FIGS. 25A-25E, the push button 24E may include one or more channels 92 that extend front to back along at least a portion of the body 40E. For example, the channels 92 may be formed in opposing sides of the body 40E. The push button 24E is illustrated in FIGS. 25A-25E as having two channels 92 along two sides of the body 40E. In other embodiments, the push button 24E may have a single channel 92 or three or more channels 92 at the same or other locations of the push button 24E.

Referring to FIGS. 28A and 28B, the closure 22E may include one or more rails 94 within the push button recess 23E that extend front to back and are complementary to the channels 92 of the push button 24E. The rails 94 may be formed at opposing sides of the push button recess 23E and may extend both partially into the push button recess 23E and at least partially lengthwise along the sides of the push button recess 23E. Each of the rails 94 may be configured to receive a corresponding one of the channels 92. The closure 22E is illustrated in FIGS. 28A and 28B as having two rails 94 along two sides of the push button recess 23E. In other embodiments, the closure 22E may have a single rail 94 or three or more rails 94 at the same or other locations of the push button recess 23E. The channels 92 of the push button 24E may mate and/or engage with the rails 94 of the closure 22E to permit horizontal translational motion of the push button 24E relative to the closure 22E while inhibiting and/or preventing rotational motion and/or vertical translational motion of the push button 24E relative to the closure 22E.

The positions of the channels 92 and the rails 94 may be reversed. For example, the push button 24E may include one or more rails (instead of the one or more channels 92) while the closure 22E may include the one or more complementary channels (instead of the one or more rails 94). Alternatively, the push button 24E may include one or more rails and one or more channels, while the closure 22E may include one or more complementary channels and one or more complementary rails.

As illustrated in FIGS. 25A-25E, the push button 24E may further include one or more protrusions 91. The protrusions 91 may extend upward from and/or above the upper surface 82. The protrusions 91 may prevent and/or inhibit the push button 24E from tipping or rotating relative to the closure 22E, for example when a generally rearward force is applied to the push button 24E or when the push button 24E is urged forward. The protrusions 91, together with flexibility in the arm 80, may retain the push button 24E coupled to the closure 22E absent a deliberate alignment of the retention tab 43E to the hole 78A in the push button recess rear wall 78 to remove the push button 24E from the push button recess 23E of the closure 22E.

Referring to FIGS. 25A-25E, and 28A-30B, in some embodiments, a part of the push button 24E, e.g., behind the push region 45E, may wrap around and extend rearward over a front portion of the closure 22E. In particular, the closure 22E may include a front rail 96 and the push button 24E may include a rearward facing channel 98 (hereinafter "channel 98") configured to receive therein at least a portion of the front rail 96. In some embodiments, an amount of the front rail 96 received in the channel 98 may be less when the push button 24E is the first push button position (FIGS. 29A, 29B, 30) than when the push button 24E is in the second push button position. The interaction of the channel 98 and the front rail 96 may constrain motion of the push button 24E relative to the closure 22E. For example, the channel 98 and the front rail 96 may mate and/or engage to permit horizontal translational motion of the push button 24E relative to the closure 22E while inhibiting and/or preventing rotational motion and/or vertical translational motion of the push button 24E relative to the closure 22E.

The carry loop 27E, including carry loop arms 21E, is illustrated in FIGS. 23A-24 and 29A-30 as attached to or formed with the container lid 20E. The carry loop 27E and/or the carry loop arms 21E may be flexible and/or semi-flexible and/or may be movable relative to some or all of the container lid 20E.

The plug 26E may be integrally formed with the closure 22E, for example as illustrated, or may be formed as a discrete component that is coupled to the closure 22E. Alternatively or additionally, the plug 26E may be integrally formed with the lid opening seal 46E although they are illustrated as discrete components in FIGS. 22-31.

The lid opening seal 46E may be configured to seal the lid opening 34E of the spout 32E when the closure 22E is in the closed closure position and may be coupled to the closure 22E, e.g., through the plug 26E. The lid opening seal 46E may include an o-ring gasket as in the embodiment of FIGS. 1-5, 14-21B, and 22-31, a resilient oversized annular plug protrusion as in the embodiment of FIGS. 10-13, a resilient inverse dome seal as in the embodiment of FIGS. 6-9, or other suitable lid opening seal.

Referring to FIGS. 27A, 27B, and 30, the lid opening seal 46E may include one or more circumferential flanges, such as first circumferential flange 90A, second circumferential flange 90B, and/or third circumferential flange 90C (collectively "circumferential flanges 90"). The first circumferential flange 90A is located below the second circumferential flange 90B, both of which are located below the third circumferential flange 90C. The lid opening 34E may have a cross-sectional profile with a waist or constriction that has a first diameter $D_1$. The diameter of the lid opening 34E may increase from the first diameter $D_1$ moving from the waist or constriction upward and downward along the lid opening 34E. For example, moving upward from the waist or constriction, the diameter of the lid opening 34E may increase to, e.g., a second diameter $D_2$. Similarly, moving downward from the waist or constriction, the diameter of the lid 34E may increase to, e.g., a third diameter $D_3$.

When the closure 22E is positioned in the closed closure position as in FIG. 30, the lid opening seal 46E may be positioned within the lid opening 34E such that at least one of the circumferential flanges 90 is positioned above the waist or constriction and at least one of the circumferential flanges 90 is positioned below the waist or constriction. In particular, as illustrated in FIG. 30, the second and third circumferential flanges 90B, 90C may be positioned above the waist or constriction, while the first circumferential flange 90A may be positioned below the waist or constriction.

Alternatively or additionally, the lid opening 34E may have a variable diameter along a height of the lid opening 34E. The lid opening 34E may have the first diameter $D_1$ at an intermediate height of the lid opening 34E. The variable diameter of the lid opening 34E may increase moving upward from the intermediate height for at least an upper portion of the lid opening 34E, e.g., to the second diameter $D_2$. Similarly, the variable diameter of the lid opening 34E may increase moving downward from the intermediate height for at least a lower portion of the lid opening 34E.

When the closure 22E is positioned in the closed closure position as in FIG. 30, the lid opening seal 46E may be positioned within the lid opening 34E such that at least one of the circumferential flanges 90 is positioned above the intermediate height and at least one of the circumferential flanges is positioned below the intermediate height. In particular, as illustrated in FIG. 30, the second and third circumferential flanges 90B, 90C may be positioned above the intermediate height, while the first circumferential flange 90A may be positioned below the intermediate height.

The configuration of the lid opening seal 46E with at least one of the circumferential flanges 90 positioned below the waist or constriction and/or the intermediate height of the lid opening 34E may increase a pressure rating of the container lid 16E. For example, the lid opening seal 46E may remain sealed to a higher pressure than lid opening seals that do not have at least one circumferential flange located below a waist or constriction of a corresponding lid opening when a corresponding closure is in a closed closure position.

The seal between the lid opening seal 46E and the lid opening 34E may be sufficiently tight to prevent unintentional leakage of fluids or other contents from the container 10E when the lid opening 34E is closed by the closure 22E, without being so tight as to retain by itself the closure 22E in the closed closure position under a relatively modest opening force. Instead, the latch 42E may cooperate with the latch stop 44E to retain the closure 22E in the closed closure position when the push button 24E is in the first push button position.

As previously indicated, the push button 24E may be disposed substantially within the push button recess 23E of the closure 22E and may be substantially enclosed by the closure 22E. In more detail, for example, the push button 24E may be disposed substantially (e.g., greater than 50% by length, width, height, surface area, and/or volume) between the push button recess upper wall 78 and a push button recess lower wall 108 of the closure 22E.

In some embodiments, the push region 45E, the bias member 72 and the latch 42E may be arranged with the latch 42E positioned between the push region 45E and the bias member 72 in a direction the push button 24E moves from the first push button position to the second push button position. In some embodiments, the push region 45E, the bias member 72 and the latch 42E may be arranged with the bias member 72 positioned between the push region 45E and the latch 42E in a direction the push button 24E moves from the first push button position to the second push button position. In some embodiments, the push region 45E, the bias member 72 and the latch 42E may be aligned, or at least substantially aligned, front to back, e.g., in the direction the push button 24E moves from the first push button position to the second push button position. Alternatively or additionally, a projection of the bias member 72A in a direction the push button 24E moves from the second push button position to the first push button position may intersect the latch 42E and/or the push region 45E of the push button 24E. One or more of the foregoing aspects may aid smoother movement and/or operation of the push button 24E relative to the closure 22E, which may avoid or at least reduce a likelihood of the push button 24E inadvertently binding to the closure 22E when operated.

The push button 24E has been described as being removably coupled to the closure 22E by the interaction of the retention tab 43E, which is formed at the end of the arm 80, with the push button recess rear wall 78 of the closure 22E, and in particular with a rearward facing surface of the push button recess rear wall 78. In particular, the retention tab 43E may be configured to selectively engage the closure 22E to selectively couple the push button 24E to the closure 22E. In this and other embodiments, the retention tab 43E may be disengageable from the closure 22E externally relative to the closure 22E. For example, as illustrated in, e.g., FIG. 29A, the retention tab 43E is disengageable from the closure 22E externally relative to the closure 22E, and in particular from the rear surface of the push button recess rear wall 78. More generally, the retention tab 43E may be disengageable externally relative to the closure 22E from a rearwardly facing surface of the closure 22E.

Some embodiments described herein may generally include a push button, such as the push button 24E, movably coupled to a closure, such as the closure 22E, and configured to selectively engage a container top, such as the container top 16E to selectively retain the closure in the closed closure position. The push button may comprise a retention tab, such as the retention tab 43E that engages the closure to inhibit forward movement of the retention tab beyond the engagement of the retention tab with the closure.

The push button may comprise a resilient portion that biases the retention tab toward the closure and is resiliently deformable to selectively disengage the retention tab toward the closure and is resiliently deformable to selectively disengage the retention tab from the closure to allow the push button to be decoupled from the closure. The arm 80 is one example of such a resilient portion of a push button.

The retention tab may engage a rearwardly facing surface of the closure to inhibit forward movement of the retention tab past the rearwardly facing surface. The rearward facing surface of the push button recess rear wall 78 is one example of such a rearwardly facing surface. Alternatively or additionally, such a rearwardly facing surface may be formed on or included in an upper wall, a lower wall, or a side wall(s) of a push button recess of the closure. For example, a side wall of the push button recess 23E of the closure 22E may comprise the rearwardly facing surface. The side wall, or at least a portion thereof, may be disposed at a rear of the push button recess.

Alternatively or additionally, a hole may be formed in the side wall of the push button recess, and an arm of the push button, such as the arm 80, may extend into the hole formed in the push button recess side wall. The retention tab may engage the push button recess side wall to inhibit forward movement of the retention tab past the rearwardly facing surface.

The various components and features of the embodiments disclosed herein may be combined or substituted, as desired. For instance, any of the plugs 26A, 26B, 26C, 26D, 26E (hereinafter "plugs 26") and/or lid opening seals 46A, 46B, 46C, 46D, 46E (hereinafter "lid opening seals 46") may be used in any of the container lids 16A, 16B, 16C, 16D, 16E (hereinafter "container lids 16"). Alternatively or additionally, modifications may be made. For example, the resilient members 37A and 37D illustrated in FIGS. 3, 4B, 5, 16, 19, 21A, and 21B have been described as being operated in expansion but could instead be operated in compression with appropriate modifications. Analogously, the bias members 37B and 58 illustrated in FIGS. 8 and 9, the bias member 37C illustrated in FIGS. 12 and 13, and the seal and bias member 37E illustrated in FIGS. 23C, 24, 27A, 27B, and 29A-31 have been described as being operated in compression but could instead be operated in expansion with appropriate modifications.

The resilient members 37A, 37D. and 38E, and in particular the tongues 29, 57, and 72, are depicted in some of the figures as a non-coiled elastomer spring while the bias members 37B, 37C, 58 are depicted in some of the Figures as helical coil springs. The resilient members 37A, 37D, and 37E and the bias members 37B, 37C, and 58 (hereinafter "bias members 37") may take other forms in other embodiments depending on the implementation. For example, with appropriate modifications to one or more components of the corresponding container lid 16, any of the bias members 37, 58 may alternatively or additionally be implemented as a helical coil spring, a torsion spring, a volute spring, a leaf spring, an elastomer spring, a band, or any other suitable bias member configuration.

The container bodies 18A, 18B, 18C, 18D, 18E (hereinafter "container bodies 18") may be sized and configured to hold, retain and/or store one or more liquids and/or solids. In particular, the container bodies 18 may each include a vessel or bottle used to store liquids such as water, flavored water, vitamin enhanced water, and the like. The container bodies 18 may also store fluids and solutions such as juices, energy drinks, thirst-quenchers, and other types of beverages. The container bodies 18 may also be used to store solids such as powders, concentrates, mixes, and foodstuffs.

The container bodies 18 may be of any suitable size. For example, the container bodies 18 may hold approximately 8, 12, 16, 20, or 24 ounces (or about 200, 300, 400, 500, 600, 700, 800, 900 ml or a liter). The container bodies 18 may have any suitable size, including smaller and larger sizes. In addition, the container bodies 18 may have other shapes and configurations other than those disclosed herein, depending, for example, upon the intended use of the container. Further, the container bodies 18 may be insulated to help keep the contents at a desired temperature. The container bodies 18 may be made of plastic, glass, metal, and/or other materials with suitable properties and characteristics.

The container lids 16 may have any suitable size and/or shape that may in general be complementary to the size and shape of the container bodies 18 at least where the two are coupled together. Further, the container lids 16 may be insulated to help keep the contents within the container bodies 18 at a desired temperature. The container lids 16 may be made of plastic, glass, metal, and/or other materials with suitable properties and characteristics. The plugs 26, the bias members 37, 58, and/or the lid opening seals 46 may be constructed from materials that are elastic, malleable, flexible, bendable, expandable, and/or resilient. For example, the plugs 26 and/or the lid opening seals 46 may be constructed from one or more of silicone, polymer, rubber, plastic, or other materials with suitable properties and characteristics. The bias members 37, 58 may include and/or be constructed from one or more of silicone, polymer, rubber, plastic, steel or other metal, or other materials with suitable properties and characteristics. The resilience of the plugs 26 and/or the bias members 37 may contribute to operation of the push buttons 24A, 24B, 24C, 24D, 24E (hereinafter "push buttons 24") as described elsewhere, while the resilience of the lid opening seals 46 may contribute in forming a watertight seal with the lid openings 34A, 34B, 34C, 34D, 34E (hereinafter "lid openings 34").

In some embodiments of the disclosed technology, the container may be used to store, transport, and/or dispense one or more liquids, such as water, beverages, drinks, juices, vitamin enhanced beverages, energy drinks, thirst-quenchers, flavored waters, protein drinks, shakes, foodstuffs, dressings, sauces, liquid meal replacements, solutions, suspensions, and the like. The container may also be used to store, transport, and/or dispense solutions and/or solids such as energy drinks, protein drinks, shakes, liquid meal replacements, etc.

In some embodiments, the container may be a shaker cup and the contents may be shaken, stirred, mixed and/or blended as desired, such as supplements, vitamins, protein powders, etc. This may allow the container to be used to create protein drinks, shakes, smoothies, dressings, sauces, etc. The container may be used as a water bottle in which water and other types of fluids may be transported and/or consumed. The container could further include foodstuffs such as fruits, vegetables, soups, and the like.

Advantageously, in some embodiments, the container may be reusable and refillable, which may allow the container to be used for many different purposes over an extended period of time. The container may also be easily carried and portable. For example, the container may be conveniently held in one-hand by the user and/or may have a carry loop. Additionally, the container may be insulated to help keep the contents at a desired temperature, such as at a lower or higher temperature.

In some embodiments, the container may include a small number of parts and components, which may facilitate manufacturing and assembly. In some embodiments, the container may be easily disassembled and cleaned. As discussed elsewhere, the container may include a container lid and/or a closure that allows the container to be easily filled from various sources. The container, container body, and container lid may include any number of parts and components depending, for example, upon the intended use of the container.

A phrase such as "an aspect" does not imply that such aspect is essential to the subject technology or that such aspect applies to all configurations of the subject technology. A disclosure relating to an aspect may apply to all configurations, or one or more configurations. An aspect may provide one or more examples of the disclosure. A phrase such as "an aspect" may refer to one or more aspects and vice versa. A phrase such as "an embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples of the disclosure. A phrase such "an embodiment" may refer to one or more embodiments and vice versa. A phrase such as "a configuration" does not imply that such configuration is essential to the subject technology or that such configuration applies to all configurations of the subject technology. A disclosure relating to a configuration may apply to all configurations, or one or more configurations. A configuration may provide one or more examples of the disclosure. A phrase such as "a configuration" may refer to one or more configurations and vice versa.

A reference to an element in the singular is not intended to mean "one and only one" unless specifically stated, but rather "one or more." Pronouns in the masculine (e.g., his) include the feminine and neuter gender (e.g., her and its) and vice versa. The term "some" refers to one or more. Moreover, nothing disclosed herein is intended to be dedicated to the public regardless of whether such disclosure is explicitly recited in the above description.

The present disclosure is not to be limited in terms of the particular embodiments described herein, which are intended as illustrations of various aspects. Many modifications and variations can be made without departing from its spirit and scope. Functionally equivalent methods and apparatuses within the scope of the disclosure, in addition to those enumerated herein, are possible from the foregoing descriptions. Such modifications and variations are intended to fall within the scope of this disclosure. Also, the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

In general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation, no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general, such a construction is intended in the sense one having skill in the art would understand the convention (e.g., "a system having at least one of A, B, and C" would include but not be limited to systems that include A alone, B alone, C alone, A and B together, A and C together, B and C together, and/or A, B, and C together, etc.). In those instances where a convention analogous to "at least one of A, B, or C, etc." is used, in general, such a construction is intended in the sense one having skill in the art would understand the convention (e.g., "a system having at least one of A, B, or C" would include but not be limited to systems that include A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

For any and all purposes, such as in terms of providing a written description, all ranges disclosed herein also encompass any and all possible sub ranges and combinations of sub ranges thereof. Any listed range can be easily recognized as sufficiently describing and enabling the same range being broken down into at least equal halves, thirds, quarters, fifths, tenths, and/or others. As a non-limiting example, each range discussed herein can be readily broken down into a lower third, middle third and upper third, etc. All language such as "up to," "at least," and the like include the number recited and refer to ranges which can be subsequently broken down into sub ranges as discussed above. Finally, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, various embodiments of the present disclosure have been described herein for purposes of illustration, and various modifications may be made without departing from the scope and spirit of the present disclosure. Accordingly, the various embodiments disclosed herein are not intended to be limiting.

What is claimed is:

1. A container lid, comprising:

a container top sized and shaped to be selectively connected to a container body, the container top having a lid opening;

a closure coupled to the container top and movable between a closed closure position in which the lid opening is closed and an open closure position in which the lid opening is open;

a push button movably coupled to the closure, the push button including a latch configured to selectively engage the container top when the closure is in the closed closure position, the push button movable between a first push button position in which the latch is engageable with the container top and a second push button position in which the latch is disengaged from the container top; and a lock movable relative to the closure and the push button between a locked position and an unlocked position, the lock configured to selectively inhibit the push button from moving from the first push button position to the second push button position, wherein the closure defines a push button recess, and the push button is disposed substantially within the push button recess and substantially enclosed by the closure.

2. The container lid of claim 1, wherein the closure includes an upper wall and a lower wall that at least partially define the push button recess and wherein the push button is disposed substantially between the upper wall and the lower wall of the closure.

3. The container lid of claim 1, further comprising a bias member configured to urge the push button toward the first push button position and to resiliently deform in response to movement of the push button to the second push button position.

4. The container lid of claim 3, wherein the push button comprises a push region and at least one of:

the push region, the bias member, and the latch are arranged with the latch positioned between the push region and the bias member in a direction the push button moves from the first push button position to the second push button position; or a projection of the bias member in a direction the push button moves from the second push button position to the first push button position intersects the push region of the push button.

5. The container lid of claim 3, wherein:

the bias member comprises a bias spring having a first end positioned against a rearward directed face of the push button and an opposite second end positioned against a forward directed face of the closure;

the bias spring extends between the rearward directed face of the push button and the forward directed face of the closure; and the bias spring is configured to compress between the rearward directed face of the push button and the forward directed face of the closure in response to movement of the push button from the first push button position to the second push button position.

6. The container lid of claim 1, further comprising an integrally formed resilient member comprising a lid opening seal and a bias member, the bias member configured to urge the push button toward the first push button position and to resiliently deform in response to movement of the push button to the second push button position, the lid opening seal configured to selectively seal the lid opening.

7. The container lid of claim 6, wherein the bias member includes a tongue end and a tongue neck that couples the tongue end to the lid opening seal, the tongue neck comprising one or more corrugations to at least partially mechanically isolate the tongue end from the lid opening seal.

8. The container lid of claim 6, wherein the bias member includes a tongue end positioned between a rearward facing surface of the push button and a forward facing surface of the push button recess, the tongue end configured to compress between the two surfaces in response to movement of the push button from the first push button position to the second push button position and to resiliently expand in response to movement of the push button from the second push button position to the first push button position.

9. The container lid of claim 1, wherein:

the push button includes a body and at least one of a channel or a rail that extends front to back along at least a portion of the body;

the closure includes at least one of a rail or a channel within the push button recess that is complementary to the channel or the rail of the push button; and the rail or the channel of the closure engages the channel or the rail of the push button to inhibit vertical movement of the push button relative to the closure.

10. The container lid of claim 1, wherein:

the lock in the locked position is configured to inhibit the push button from moving from the first push button position to the second push button position; and the lock in the unlocked position is configured to permit movement of the push button between the first push button position and the second push button position.

11. The container lid of claim 1, wherein:

the push button travels an engagement distance between the first push button position and the second push button position;

the closure defines a lock recess, the lock recess having a rearward end that forms a fulcrum for the lock;

the push button defines a lock cavity in an upper surface of the push button;

the lock cavity includes a first stop in a first portion of the lock cavity and a second stop in a second portion of the lock cavity, the second stop being forward of the first stop;

the lock comprises an abutment, wherein:

when the push button is in the first push button position and the lock is in the locked position, the abutment is positioned facing the first stop of the lock cavity of the push button and spaced apart from the first stop by a distance less than the engagement distance; and when the push button is in the first push button position and the lock is in the unlocked position, the abutment is positioned facing the second stop of the lock cavity and spaced apart from the second stop by a distance equal to or greater than the engagement distance.

12. The container lid of claim 11, wherein:

a bottom surface of the lock cavity of the push button includes a first receptacle rearward of the first stop and a second receptacle rearward of the second stop; and the lock further comprises a protrusion positioned to be received in the first receptacle when the lock is in the locked position and to be received in the second receptacle when the lock is in the unlocked position.

13. The container lid of claim 1, wherein:

the closure includes a lock switch channel; and the lock further comprises a lock switch that extends through the lock switch channel to provide access to the lock.

14. A container lid, comprising:

a container top having a lid opening;

a closure coupled to the container top and movable between an open closure position in which the lid opening is open and a closed closure position in which the lid opening is closed; and a push button movably coupled to the closure and configured to selectively engage the container top to selectively retain the closure in the closed closure position, the push button comprising a retention tab, the retention tab engaging the closure to inhibit forward movement of the retention tab beyond the engagement of the retention tab with the closure, wherein the push button comprises a resilient portion that biases the retention tab toward the closure and is resiliently deformable to selectively disengage the retention tab from the closure to allow the push button to be decoupled from the closure without disassembling the closure.

15. The container lid of claim 14, wherein:

the retention tab engages a rearwardly facing surface of the closure to inhibit forward movement of the retention tab past the rearwardly facing surface;

the closure comprises a push button recess side wall that at least partially defines a push button recess, the side wall comprising the rearwardly facing surface; and the push button is positioned at least partially within the push button recess.

16. The container lid of claim 15, wherein:

the resilient portion is an arm carrying the retention tab;

a hole is formed in the push button recess side wall;

the arm of the push button extends into the hole formed in the push button recess side wall; and the retention tab engages the push button recess side wall to inhibit forward movement of the retention tab past the rearwardly facing surface.

17. The container lid of claim 16, wherein in response to application of a removal force to the retention tab, the arm resiliently deforms to permit alignment of the retention tab with the hole formed in the push button recess side wall to permit removal of the push button from the push button recess of the closure.

18. A container lid, comprising:

a container top having a lid opening;

a closure coupled to the container top and movable between an open closure position in which the lid opening is open and a closed closure position in which the lid opening is closed;

a push button movably coupled to the closure and configured to selectively engage the container top to selectively retain the closure in the closed closure position; and a resilient member comprising both a lid opening seal and a bias member, the lid opening seal configured to form a seal between the lid opening and the closure, the bias member urging the push button toward a first push button position in which the push button engages the container top, and the bias member resiliently deforming in response to movement of the push button to a second push button position in which the push button is disengaged from the container top.

19. The container lid of claim 18, wherein the resilient member comprises a tongue joining the lid opening seal and the bias member.

20. The container lid of claim 18, wherein the bias member comprises a tongue, the tongue urging the push button toward a first push button position in which the push button engages the container top, and the tongue resiliently deforming in response to movement of the push button to a second push button position in which the push button is disengaged from the container top.

21. The container lid of claim 20, wherein:

the tongue includes a tongue end and a tongue neck that couples the tongue end to the lid opening seal; and at least one of:

movement of the push button from the first push button position to the second push button position is configured to compress the tongue end between the push button and the closure; or movement of the push button from the first push button position to the second push button position is configured to stretch the tongue neck.

22. The container lid of claim 18, wherein:

the lid opening seal includes a first circumferential flange and a second circumferential flange positioned above the first circumferential flange, the container top comprises a spout that defines the lid opening, the lid opening having a variable diameter along a height of the lid opening, the lid opening having a first diameter at an intermediate height, the variable diameter increasing moving upward from the intermediate height for at least an upper portion of the lid opening and the variable diameter increasing moving downward from the intermediate height for least a lower portion of the lid opening, and when the closure is positioned in the closed closure position, the lid opening seal is positioned within the lid opening of the spout, the first circumferential flange of the lid opening seal is positioned below the intermediate height, and the second circumferential flange is positioned above the intermediate height.

23. A beverage container lid, comprising:

a container top sized and shaped to be selectively connected to a container body, the container top comprising a spout extending upward from a wall of the container top, the spout defining a lid opening; and a closure coupled to the container top and movable between a closed closure position in which the lid opening of the spout is closed and an open closure position in which the lid opening of the spout is open, wherein the closure comprises a push button, the push button including a latch configured to selectively engage the container top when the closure is in the closed closure position, the push button movable between a first push button position in which the latch is engageable with the container top and a second push button position in which the latch is disengaged from the container top, wherein the closure comprises a lock, the lock movable between a locked position and an unlocked position, the lock configured to selectively inhibit the push button from moving from the first push button position to the second push button position, and wherein a body of the closure defines a push button recess, and the push button is disposed substantially within the push button recess and substantially enclosed by the body of the closure.

24. The beverage container lid of claim 23, wherein:

the lock in the locked position is configured to inhibit the push button from moving from the first push button position to the second push button position; and the lock in the unlocked position is configured to permit movement of the push button between the first push button position and the second push button position.

25. The beverage container lid of claim 23, wherein:

the push button travels an engagement distance between the first push button position and the second push button position;

the body of the closure defines a lock recess, the lock recess having a rearward end that forms a fulcrum for the lock;

the push button defines a lock cavity in an upper surface of the push button;

the lock cavity includes a first stop in a first portion of the lock cavity and a second stop in a second portion of the lock cavity, the second stop being forward of the first stop;

the lock comprises an abutment, wherein:

when the push button is in the first push button position and the lock is in the locked position, the abutment is positioned facing the first stop of the lock cavity of the push button and spaced apart from the first stop by a distance less than the engagement distance; and when the push button is in the first push button position and the lock is in the unlocked position, the abutment is positioned facing the second stop of the lock cavity and spaced apart from the second stop by a distance equal to or greater than the engagement distance.

26. The beverage container lid of claim 25, wherein:

a bottom surface of the lock cavity of the push button includes a first receptacle rearward of the first top and a second receptacle rearward of the second stop; and the lock further comprises a protrusion positioned to be received in the first receptacle when the lock is in the locked position and to be received in the second receptacle when the lock is in the unlocked position.

27. The beverage container lid of claim 23, wherein:

the body of the closure includes a lock switch channel; and the lock further comprises a lock switch that extends through the lock switch channel to provide access to the lock.

28. The beverage container lid of claim 23, wherein the latch is configured to selectively engage a latch stop formed on the spout of the container top.

* * * * *